US005468098A

United States Patent [19]

Babcock

[11] Patent Number: 5,468,098

[45] Date of Patent: Nov. 21, 1995

[54] SEGMENTAL, ANCHORED, VERTICAL PRECAST RETAINING WALL SYSTEM

[76] Inventor: John W. Babcock, 510 S. 7500 East, Huntsville, Utah 84317

[21] Appl. No.: 93,171

[22] Filed: Jul. 19, 1993

[51] Int. Cl.[6] ..... E02D 5/00

[52] U.S. Cl. ..... 405/262; 405/258; 405/284; 405/286

[58] Field of Search ..... 408/284, 285, 408/262, 258, 286, 287

[56] References Cited

U.S. PATENT DOCUMENTS

| | | | |
|---|---|---|---|
| 3,421,326 | 1/1969 | Vidal . | |
| 3,686,873 | 8/1972 | Vidal . | |
| 3,922,864 | 12/1975 | Hilfiker . | |
| 4,045,965 | 9/1977 | Vidal . | |
| 4,050,254 | 9/1977 | Meheen et al. . | |
| 4,068,482 | 1/1978 | Hilfiker . | |
| 4,116,010 | 9/1978 | Vidal | 405/262 |
| 4,124,983 | 11/1978 | Weatherby | 405/262 X |
| 4,266,890 | 5/1981 | Hilfiker | 405/286 |
| 4,407,611 | 10/1983 | Murray et al. | 405/284 |
| 4,440,527 | 4/1984 | Vidal | 405/262 X |
| 4,572,711 | 2/1986 | Benson et al. | 405/286 |
| 4,655,646 | 4/1987 | Babcock et al. | 405/286 |
| 4,668,129 | 5/1987 | Babcock et al. | 405/284 |
| 4,684,287 | 8/1987 | Wojciechowski | 404/6 |
| 4,904,124 | 2/1990 | Egan | 405/262 |
| 4,914,887 | 4/1990 | Meheen | 52/565 |
| 4,961,673 | 10/1990 | Pagano | 405/287 |
| 5,030,035 | 7/1991 | Babcock | 405/262 |
| 5,193,324 | 3/1993 | Fellows | 405/284 X |

OTHER PUBLICATIONS

"Development and Worldwide Application of Reinforced Earth", Advertising Brochusre, Reinforced Earth Co., Date: Unknown.

"Lenton Rebar Splicing" Advertising Insert by ERICO Products, 1986.

"Dywidur—the new tension member", Advertising insert, Date: Unknown.

*Primary Examiner*—Dennis L. Taylor

*Attorney, Agent, or Firm*—Duane Burton

[57] ABSTRACT

A segmental, anchored, vertical, precast, retaining wall system includes an array of wall panels which can be assembled edge to edge to form a multi-tiered structure. The wall panels are formed with vertical tee stems having bearing surfaces for interlocking wall panels on different tiers and for distributing earth loads between the tiers. Tie rods attached to the tee stems connect the wall panels to precast anchor blocks embedded in the backfill at different vertical levels. The tie rods are protected from corrosion by a sealed tie rod sleeve. The tie rod sleeve is displaced relative to the tie rods during vertical settlement of the backfill to prevent stresses in the tie rod. The retaining wall is self supporting during assembly and can be assembled on a cast-in-place foundation beam without the requirement of additional bracing.

34 Claims, 49 Drawing Sheets

SEGMENTAL, ANCHORED, VERTICAL PRECAST RETAINING WALL SYSTEM

FIELD OF THE INVENTION

The present invention relates generally to retaining wall systems and more specifically to a modular retaining wall system which includes precast anchor elements for securing precast wall elements.

BACKGROUND OF THE INVENTION

Various methods have been used in the past to construct precast walls for retaining earth, soil, sand or other fill, generally referred to as soil. A typical precast wall system is disclosed in U.S. Pat. No. 3,922,864 issued to William Hilfiker on Dec. 2, 1975. The Hilfiker patent illustrates the typical anchored wall using anchor elements which are connected between precast retaining wall panels and deadman members. The deadman members provide resistance to the horizontal forces exerted by the backfill on the wall and function to hold the wall in place. If a solid surface is available, such as rock, the anchor elements can be attached to the rock instead of the deadman members utilizing conventional anchoring techniques.

A disadvantage of such a system is that a considerable amount of labor is required to install the anchor elements and deadman members, and to connect the anchor elements with the proper tension to the retaining wall. Moreover, the anchor elements are typically formed of metal rods (i.e., rebar) which are prone to failure due to occasional defects in the material and progressive weakening due to corrosion of the metal. Furthermore, if the retained soil should settle, vertical motion between the adjacent panels is restricted.

To overcome some of the limitations of utilizing concrete deadman members and metal anchor elements, other retaining wall systems have been developed. As an example, the Reinforced Earth Company (RECO) of Arlington, Va., has developed a system using metal strips which function as both anchor elements for a retaining wall and to provide stability to the soil mass being retained. U.S. Pat. No. 4,961,673 issued Oct. 9, 1990 to Pagnono et al. along with U.S. Pat. Nos. 3,421,326; 3,686,873; 4,045,965 and 4,116,010 to Vidal describe such a wall system. The metal reinforcing strips used in this type of wall system are connected to retaining wall facia panels to hold the retaining wall in position and to provide stability to the backfill material. Such a system uses both the consistency and the density of the backfill material to produce friction between the metal reinforcing strips and the backfill and to render the entire retaining mass stable. The consistency of the backfill is controlled by the size distribution of the particles of the backfill, while the density of the backfill is controlled by compaction of the fill as it is placed in position.

A disadvantage of such a system is that a great deal of expense is involved in obtaining backfill of the proper consistency. If proper materials are available, the size distribution of the particles required can be obtained from local sources using crashing and sifting techniques. Otherwise, backfill must be transported from a location where backfill having the proper consistency is available. In either case, a great deal of expense is involved in obtaining the required backfill at the construction project.

In addition to the costs involved in obtaining and processing the proper backfill, them are significant costs related to the labor intensive process of grading and compacting the backfill. Typically, each layer of reinforcing strips must be precisely compacted to ensure that the requisite friction is provided between the reinforcing strips and backfill for providing a stable soil mass. The labor intensive backfill process thus increases both the costs and installation time associated with the retaining wall.

Additionally, the reinforcing strips used in such a system are subject to the corrosive effect of minerals present in the backfill material. Numerous catastrophic failures have resulted from the effect of unchecked corrosion on the reinforcing strips. Although the metal strips can be galvanized to reduce certain oxidation processes, minerals are present in the backfill material which react with the zinc used in galvanization so as to reduce its effectiveness in a short period of time. Other techniques have also been used to prevent or reduce corrosion of the metal reinforcing strips, including the use of epoxy coatings. Although epoxy coatings are effective against the corrosive chemicals in the backfill, the epoxy coatings are easily scratched during handling, installation, and implementation which exposes the metal strips to the corrosive chemicals. Also, epoxy coatings considerably increase the overall costs of this type of system.

Another problem with this type of wall system is that the system is not flexible and does not accommodate vertical differential settlement. Such setting may result from weak or inconsistent insitu wall foundation material. Since the tensile strength of the reinforcing strip is exceeded when the retained soil mass settles relative to the wall face, failures can occur when the straps or connecting bolts fail. Numerous sliding type connectors have been devised and installed on these wall systems to prevent such failures. Because of the high horizontal loads on the individual connections however, the relative vertical motion desired at the connections has not been achieved. Consequently, high friction forces are generated at these connections as a result of horizontal earth pressure loads on the wall face panels.

Another broad classification of retaining walls systems is the cantilevered wall. A representative cantilevered wall system is disclosed in U.S. Pat. No. 4,050,254 issued Sep. 27, 1977 to Meheen, et al. Design analysis of such cantilevered systems is accomplished by summing the forces of the horizontal tieback element and comparing them with the horizontal component of soil forces acting on the face of the wall. The horizontal tieback base is then increased in size and length until the vertical forces on the tieback element exceed the horizontal component of the soil forces by a predetermined factor of safety. This results in retaining walls having extremely long tieback elements which required a large cut into the backfill material to erect the wall. Consequently, cantilevered walls have not been suitable for implementation as high vertical walls (e.g. over 20 ft) because of the required cut into the backfill. Because of the unsuitability of cantilevered walls as high vertical walls, they have generally been implemented as tiered walls with each successively higher tier set back into retained soil.

U.S. Pat. No. 4,668,129 issued May 26, 1987 to Babcock et al. discloses a multi-tiered retaining wall system which employs soil arching to produce a substantially vertical wall. In this system, each tier acts independently of other tiers and generates shears and soil arching to maintain the stability of the wall. The face of the wall system has a "shiplap" design and each of the column portions of the tieback elements protrudes by a predetermined distance from the face of the retaining wall panels. However, in certain instances, such as when a wall is installed adjacent a roadway, it has been found desirable to have a smooth faced wall without vertical column portions projecting from the wall. A smooth wall reduces the likelihood of contact between the wall and a motor vehicle.

U.S. Pat. No. 4,655,646 issued Apr. 7, 1987 to Babcock et al., discloses a multi-tiered retaining wall system which employs soil arching to produce a vertical wall without vertically aligned protrusions. The multi-tiered retaining wall system uses a plurality of tieback elements which act independently of each other to prevent the transference of forces and moments to lower tiers. This design provides a high degree of flexibility in the horizontal spacing of the tieback elements. Specifically, the horizontal spacing is independent of the width of the retaining wall panel, so as to meet specified technical conditions and allow the use of standard sized prefabricated concrete components. However, the exterior wall surface is not free from protrusions and for retaining wall applications with limited fight of way it has been found desirable to construct the exterior wall surface free of protrusions.

In addition to the shortcomings of the above-cited retaining wall systems, them are additional problems associated with the prior art. Firstly, all of these systems make use of relatively small panels for the wall face (e.g. 25 $ft^2$). This requires many precast wall panels and reinforcing strips and/or anchor rods to assemble a wall.

In addition, small panel wall systems cannot be built in cut wall applications which require shoring or other top down construction techniques. Conventional methods of top down construction include systems which use shoulder piles or soil nailing. Typically, shoulder piles such as steel H beams, are driven into an existing embankment at the face of the proposed retaining wall and lagging is inserted between the beam flanges. The lagging is displaced downward as the soil below the beams is removed. A permanent face is typically cast over the beams in the field with the wall face reinforcement integrated to the beams. As is apparent, this is an expensive and time consuming process. Accordingly, permanent walls of this type are extremely expensive.

Soil nailing is also a conventional method to accomplish top down wall construction. With soil nailing, rebars are inserted horizontally into an embankment and grouted. The embankment is then removed in lifts as subsequent tiers of rebars are inserted. The exposed vertical soil face of the wall is covered with reinforced shotcrete as the soil is removed. Walls of this type are less costly than the shoulder beam system previously described but are prone to corrosion related failures of the rebar.

In view of these and other shortcomings of the prior art there is a need in the art for improved wall systems in the construction of various structures. Accordingly, it is an object of the present invention to provide an improved precast retaining wall system.

It is another object of the present invention to provide an improved precast retaining wall system that is corrosion resistant and which is formed of components that can be easily and inexpensively protected from corrosion.

It is yet another object of the present invention to provide an improved precast retaining wall system that is self-supporting during assembly and backfilling and which can be assembled without the requirement of erection braces.

It is a further object of the present invention to provide an improved precast retaining wall system that can accommodate settling of the retained soil without excessively loading or tensioning the connecting members or connection points of the system.

It is a still further object of the present invention to provide an improved precast retaining wall system that includes large precast panels that when assembled are free of protrusions and which do not require patching during assembly.

It is a still further object of the present invention to provide an improved precast retaining wall system that includes precast panels that can be leveled and plumbed without external wedges.

It is a still further object of the present invention to provide an improved precast retaining wall system that includes precast panels formed with integral vertical columns having a generally T-shaped cross-section that improves the assembly, support, and load distribution of the panels.

It is another object of the present invention to provide an improved precast retaining wall system that does not require precise backfill grading and which will accommodate different backfill consistencies.

It is a further object of the present invention to provide an improved precast retaining wall system having connecting members and anchors that can be assembled and pretensioned on the backfill side of the wall.

It is yet another object of the present invention to provide an improved precast retaining wall system that incorporates rebar couplers (or threadbar connectors) to facilitate installation of the connecting members of the wall system and which can be preassembled to specification without the necessity of field testing.

It is yet another object of the present invention to provide an improved precast retaining wall system wherein the top wall panels can be extended over the backfill line to provide a wall for pedestrian or vehicular traffic.

It is a further object of the present invention to provide an improved precast retaining wall system adaptable for use as seawall or an erosion control structure and adaptable for use in conjunction with other structures such as sheet pile cut off walls.

SUMMARY OF THE INVENTION

In accordance with the present invention, a precast retaining wall system is provided. The retaining wall system, generally stated, includes: an assembly of interconnected wall panels; a plurality of elongated anchor blocks embedded in backfill material for securing the wall panels against horizontal displacement; and tie rod assemblies which connect the wall panels and anchor blocks. The wall system provides a permanent precast segmented anchored wall that allows for economical corrosion protection and vertical settlement of the backfill material.

The wall panels of the retaining wall system are relatively large in size (e.g. 80 to 120 $ft^2$) and are assembled edge to edge to form a tier. Multiple tiers can be stacked on a foundation beam to form a tiered structure of a desired height. Each wall panel has a flat exterior face and includes two (or more) integrally formed vertical columns or tee stems with threaded couplings for attachment to the tie rod assemblies. The tee stems include rectangular notches at the top and bottom to enable formation of an interlocking structure in which loading forces are transmitted between the different tiers of the wall system. In addition, anchor bolts and base plates are attached to the tee stems for securing the wall panels to one another and to the foundation beam.

The anchor blocks, of the retaining wall system, are assembled end to end and interconnected to form a unitary elongated anchor structure for securing the wall panels against horizontal displacement. Each wall panel may connect to multiple anchor block which may be vertically spaced from one another. In addition, the anchor blocks on a vertical level may be interconnected using shiplap joints to form a unitary elongated anchor structure. The size of the anchor blocks along with the length of the tie rod assemblies, are determined by the wall geometry and the soil used for the backfill.

The tie rod assemblies, of the retaining wall system, include threaded tie rods which are contained within sealed tie rod sleeves. Each tie rod attaches at one end to a threaded coupler cast in a tee stem of a wall panel. At an opposite end, each tie rod is placed through a counterbored void in an anchor block and secured with a nut and washer. Slotted gaskets at either end of the tie rod sleeve along with grout, completely seal the tie rods. The tie rods are therefore protected from the corrosive effects of chemicals and moisture.

Assembly and attachment of the tie rods can be accomplished entirely on the backside of the wall. Furthermore, during assembly, the tie rods are located within the tie rod sleeves in a manner which accommodates any subsequent settling of the backfill. The sleeves can move vertically around the tie rods without shear forces being introduced in the tie rod at its points of connection with a wall panel and anchor block.

During assembly and backfilling of the retaining wall system, each wall panel is secured against wind and assembly loads by connection to anchor bolts attached to the foundation beam. After assembly the temporary anchor bolt load is completely relieved by the resisting effect of the tie rod/anchor bolt assembly. Upon completion of the backfill operation, the anchor blocks form a unitary aligned structure which resists any loads placed on the wall panels. Earth loads are offset by the tie rods and anchors. Moreover, loads are transferred between adjacent tiers by the cantilever effect of the tee stems of a wall panel bearing on an adjacent tee stem.

The wall system may be constructed with horizontal offsets between adjacent tiers, if landscaping is required, or if it is geotechnically conservative to use that design configuration. Furthermore, the individual wall panel faces can be assembled with an inclined orientation to produce an essentially vertical wall face with horizontal offsets between tiers for landscape materials.

In an alternate embodiment of the invention, the wall system is formed as a cantilevered wall system. The cantilevered wall system includes tee stems that extend past the face of the wall panels and are embedded in a concrete base during assembly. In another alternate embodiment the wall system is constructed as an erosion control structure on a sheet pile cut off wall. In yet another alternate embodiment of the invention, the wall panels are formed with a hollow box beam construction. During assembly the box beam panels are secured to anchored beam members. The box beam panels can also be constructed in a U-beam configuration.

In another alternate embodiment of the invention, a wall system includes horizontally offset tiers with each tier supported by a cast-in-place foundation beam. In this embodiment, the foundation beams of each upper or intermediate tier function as an anchor structure for an adjacent lower tier.

In yet another embodiment of the invention, a horizontal setback inclined face wall assembly is provided. In this embodiment, the support panels are formed with inclined bearing flanges. Each pair of inclined bearing flanges supports a flat panel therebetween at an inclined orientation.

In yet another embodiment of the invention hollow box beam panels include an internal bracket assembly for attachment to vertical tie rods embedded in a cast-in-place foundation beam. An opening is provided in the face of each panel for accessing the internal bracket assemblies.

These and other objects, features and advantages of the invention will be apparent from the following more particular description of the preferred embodiments of the invention as illustrated in the accompanying drawings.

DETAILED DESCRIPTION OF THE PREFERRED EMBODIMENTS

Figure 1:
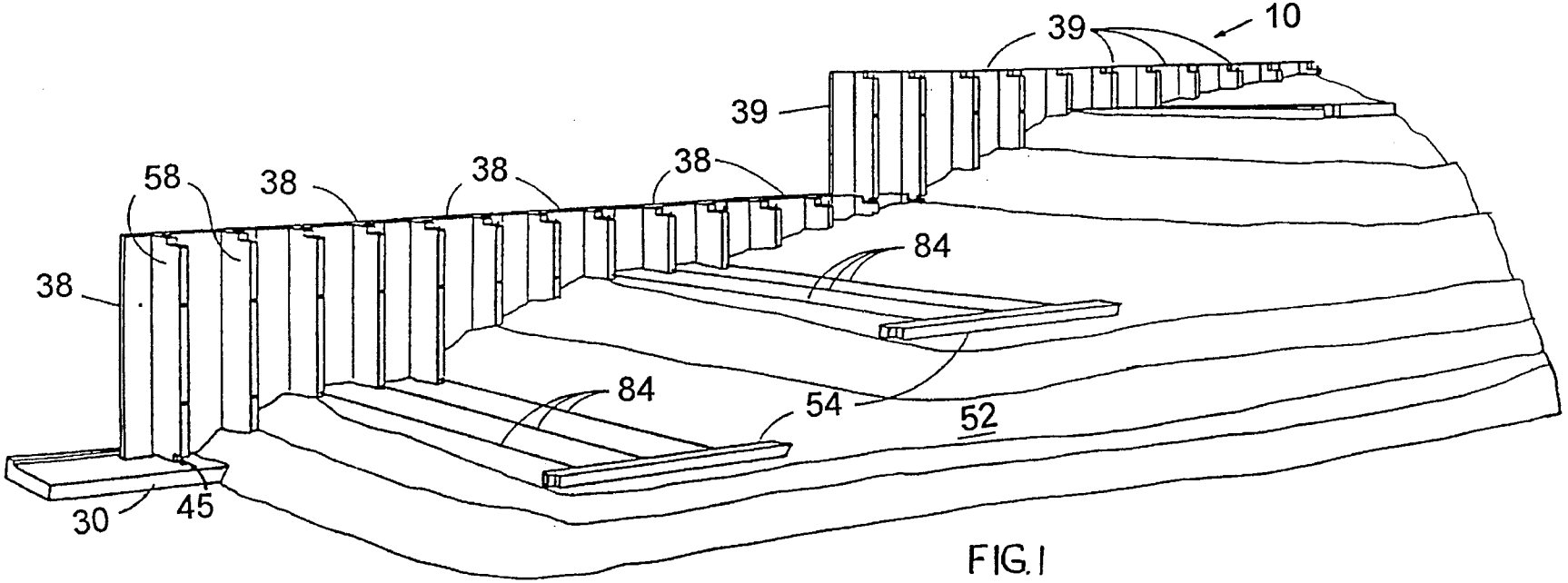
FIG. 1 is a perspective view of a segmental anchored wall system constructed in accordance with the invention and shown under construction.
Figure 2:
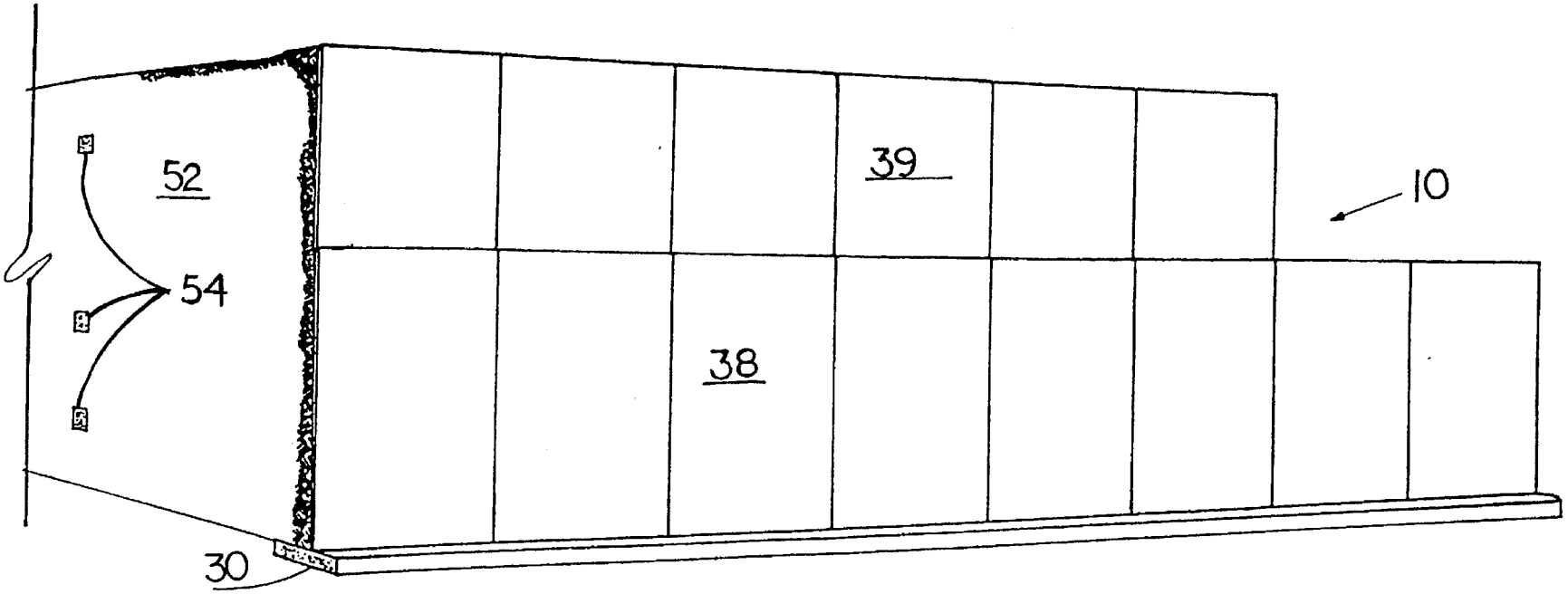
FIG. 2 is the corresponding front perspective view of the system shown in FIG. 1, with the left side of the view showing a cut view of the backfill and anchor blocks behind the wall.
Figure 3:
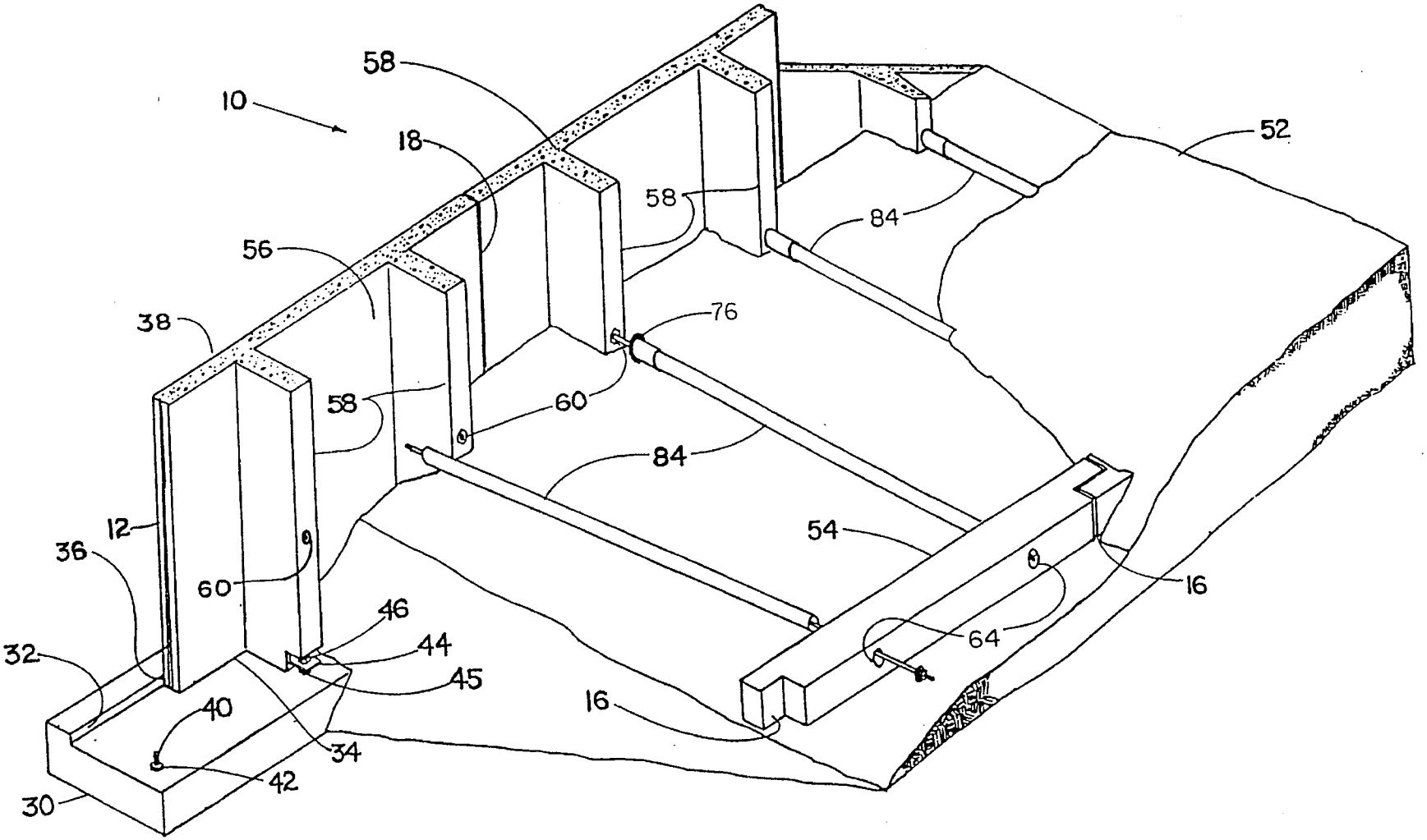
FIG. 3 is a rear isometric view of three partial base tier wall panels being installed showing the tie rod assemblies being attached to the wall panels and to anchor blocks.

Referring now to FIGS. 1–3, a two tiered retaining wall system is shown under construction and is generally designated as 10. FIG. 1 is cut away to illustrate the manner in which the tiers of the retaining wall system 10 are constructed. In general, the retaining wall system 10 comprises an assembly of precast wall panels 38, 39 which are restrained from horizontal movement by tie rod assemblies 84 connected to precast anchor blocks 54. The tie rod assemblies 84 and anchor blocks 54 are completely embedded in backfill 52.

Each wall panel 38, 39 has a generally rectangular peripheral configuration and is formed of a precast material such as precast concrete. Base wall panels 38 form a base tier of the assembly and upper tier wall panels 39 form an upper tier of the assembly. Each wall panel includes a pair of integrally formed vertical columns. These vertical columns are referred to herein as tee stems 58. The tee stems 58 are formed integrally with the wall panel 38. Viewed from the top each tee stem 58 is generally T-shaped in cross-section substantially as shown in FIG. 3. The tee stems 58 connect to the tie rod assemblies 84 and function to distribute horizontal loads between adjacent wall panels 38, 39.

Figure 4:
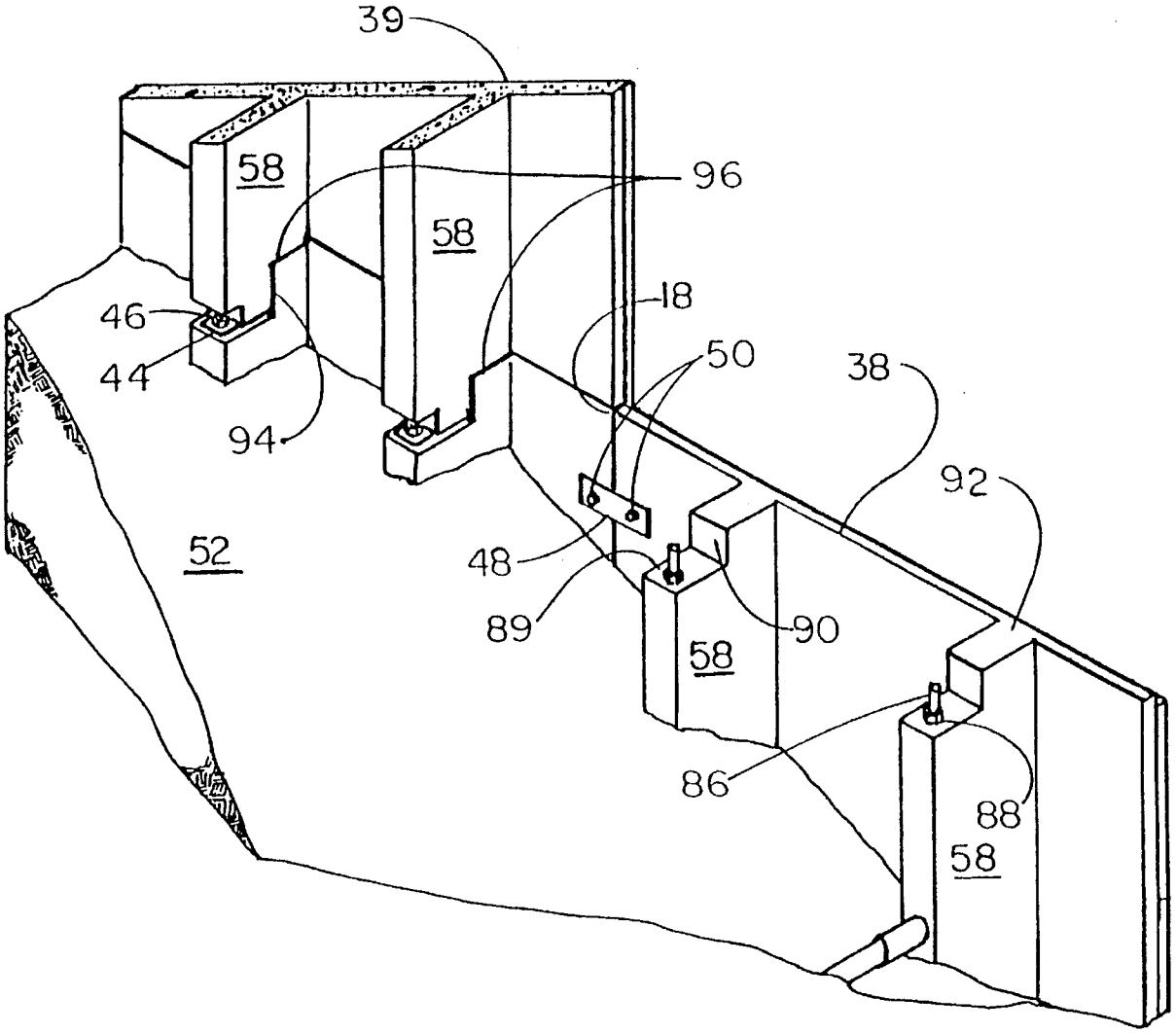
FIG. 4 is a rear isometric view of the top of the base panels, and a top panel place onto a base panel.

As shown in FIGS. 3 and 4, a vertical edge 12 of each base wall panel 38, 39 may be formed of mating shiplap on joining edges. Adjacent base wall panels 38 can therefore interlock using the mating tongue and groove structure. A horizontal top edge of each base wall panel 38 is substantially smooth to form a top horizontal bearing surface 92 for transferring loads between panels on adjacent tiers. This horizontal bearing surface 92 is cantilevered at the tee stems 58. In addition, each tee stem 58 of a base wall panel 38 is formed with a rectangular notch (or vertical shiplap) at the top and bottom edges. A top most notch of the tee stem 58 includes the horizontal bearing surface 92 along with a vertically disposed bearing surface 90. In addition, a cast-in-place anchor bolt 86 extends from a horizontal surface 89 formed by the notch. The bottom most notch includes a cast-in-place base plate ,14. Additionally, each tee stem 58 includes a cast-in-place threaded coupling or coupler 60 for attaching the tie rod assembly 84 to the base wall panel 38.

The wall system 10 is assembled on a foundation beam 30. The foundation beam 30 may be formed of a material such as concrete which may be cast-in-place. As shown in FIG. 3, the foundation beam 30 is formed with an L-shaped top surface which includes a bearing flange 32 for contact with the face of the base wall panels 38. During assembly and backfill, the base wall panels 38 are held in a vertical position on the foundation beam 30 by an anchor bolt assembly 45. As shown in FIG. 3, each anchor bolt assembly 45 includes an anchor bolt 40 cast into the foundation beam 30, an adjusting nut 42, the base plate 44 cast into the tee stem 58, and a securing nut 46.

The upper tier wall panels 39 are substantially identical in construction to the base wall panels but may be slightly smaller than the base wall panels. The height and width of the wall panels 38, 39 for each design can be selected as appropriate for the specific site requirements. In general, the wall panels 38, 39 are relatively large as compared to panels of prior art wall systems. As an example, the base wall panels 38 may be formed with a surface area of about 80 to 120 $ft^2$. The upper tier wall panels 39 may be formed with a surface area of about 80–100 $ft^2$.

Initially, for assembling the retaining wall system 10, the base wall panels 38 are secured to the foundation beam 30 utilizing the anchor bolt assemblies 45. The anchor blocks 54 are placed on level compacted backfill 52 at an elevation corresponding to the location of a threaded coupler 60 formed on the tee stems 58 of the base wall panels 38. The anchor blocks 54 are displaced behind the base wall panels 38 at a distance approximately equal to the length of the tie rod assembly 84. This dimension is specific to each wall design and depends on the overall structure height and geotechnical parameters of the wall backfill material 52.

A tie rod assembly 84 is then connected to both tee stems 58 of a wall panel 38 and to an anchor block 54 to transfer the resisting force of the anchor block 54 to the base wall panels 38. The individual components of the retaining wall system, i.e. the tie rod assembly 84, anchor block 54 and base wall panels 38 are restrained from horizontal movement by the resistance of the backfill 52 surrounding the anchor blocks 54.

After the tie rod assemblies 84 have been attached to the tee stems 58 of the base wall panels 38 and to the anchor blocks 54, additional backfill 52 is placed over the anchor blocks 54 and behind the base wall panels 38 to an elevation slightly below the base elevation of the upper tier panels 39. The upper tier panels 39 are then placed and secured in a similar fashion to that described for the base wall panel 38 installation.

FIG. 2 shows a typical wall under construction with two tiers partially completed. Multiple tier walls (over two tiers) are constructed in the same repetitious manner as has been outlined for the two tier wall shown. That is, a lower tier panel structurally supports a subsequent upper tier panel without requiting the use of erection braces. Each panel is placed adjacent to the preceding panel in each tier. Following the completion of that tier, the panels in the next subsequent tier are vertically placed over the panel that is backfilled in the previously constructed tier. This process can be continued until the designed numbers of tiers is attained.

The base wall panels 38 require two rows of anchor blocks 54 and the associated tie rod assemblies 84 for stability against wall sliding. The upper tier panels 39 on the other hand, require only one row of anchor blocks 54 and tie rod assemblies 84. This is because horizontal earth pressures at the lower portion of an upper tier panel 39 are transferred into the top portion of an adjacent base panel 38 at the horizontal bearing surface 92 formed by the top edge 14 of the base wall panels 38. In addition, forces are transferred by contact of the bearing surfaces 90, 92 of the interlocking tee stems 58 of adjacent panels 38, 39.

As shown in FIG. 3, initially each base panel 38 is set over a pair of anchor bolts 40. The base wall panel 38 is thus leveled with the adjusting nut 42 attached to the anchor bolts 40 with securing nuts 46. A horizontal leveling shim (not shown) may be placed under the front of the tee stems 58 to accommodate surface deviations of the cast-in-place foundation beam 30. In addition, bearing shims 36 or grout may be placed between the front side of the base wall panel 38 face and the raised bearing flange 32 formed in the cast-in-place foundation beam 30. This prevents the base wall panels 38 from sliding forward due to partial backfill horizontal earth pressures.

After securing the base wall panels 38 to the foundation beam 30, backfill 52 is placed behind the base wall panels 38 (the backfill is shown as sloping away from the panels). The backfill 52 is initially placed to an elevation equal to the elevation of the base of the anchor blocks 54 for the base wall panels 38. The short section of anchor block 54 shown in FIG. 3 is shown with a shiplap connection to another anchor block 54 that has had fill placed over it. This forms an interlocking anchor structure. Proper implementation of the design requires that a vertical joint 18 (FIG. 3) between adjacent base wall panels 38 be supported by a continuous anchor block 54. Therefore, the anchor block 54 is shown as connected to two base wall panels 38 on the either side of the vertical joint 18 between adjacent base wall panels 38.

The tie rod assembly 84 located on the fight side of FIG. 3 is shown as partially installed. A front portion of the tie rod assembly 84 is placed within a void space 62 (see FIG. 5A) formed in the anchor block 54. Since the tee stem 58 extends away from the back face of the base wall panel 38, the tie rod assembly 84 can be inserted into the anchor void space 62 and then pulled back and inserted into a threaded tie rod coupler 60 formed in the back of the tee stem 58. Additional backfill 52 is then placed over the tie rod assembly 84 and the anchor block 54 after the tie rod assembly 84 has been secured.

Referring now to FIG. 4, the assembly of an upper tier to a base tier is shown. In FIG. 4, base wall panels 38 have been backfilled and an upper tier panel 39 has been erected on the top of a base wall panel 38. During assembly, the adjacent panel clip 48 and clip bolts 50 prevent movement of adjacent base wall panels 38 at the joint 18. The adjacent panel clip 48 and clip bolts 50 are typically removed and mused as subsequent tiers are erected. Prior to placing the upper tier panel 39 over base wall panel 38, horizontal bearing pads 96 are placed on the horizontal bearing surface 92 of the tee stems 58 and the adjusting nuts 88 are set to the proper elevation. A vertical bearing pad 94 is also attached with adhesive to vertical bearing surface 90 prior to placing upper tier panel 39 on base wall panel 38. The bearing pads 94, 96 may be formed of a resilient elastomeric material. Following placement of the upper tier panel 39, the securing nut 46 is tightened in place over the panel base plate 44. The adjacent panel clip 48 is mused to connect the upper tier wall panels 39 as they are erected. The panel base plate 44 and associated panel securing hardware is not epoxy coated or corrosion resistant because all loads that are resisted by the securing hardware are resolved into the tie rod assemblies 84, the bearing flange 32 on the foundation beam 30 (FIG. 3) and the panel bearings pads 94 and 96 following the placement of the backfill.

Figure 5A:
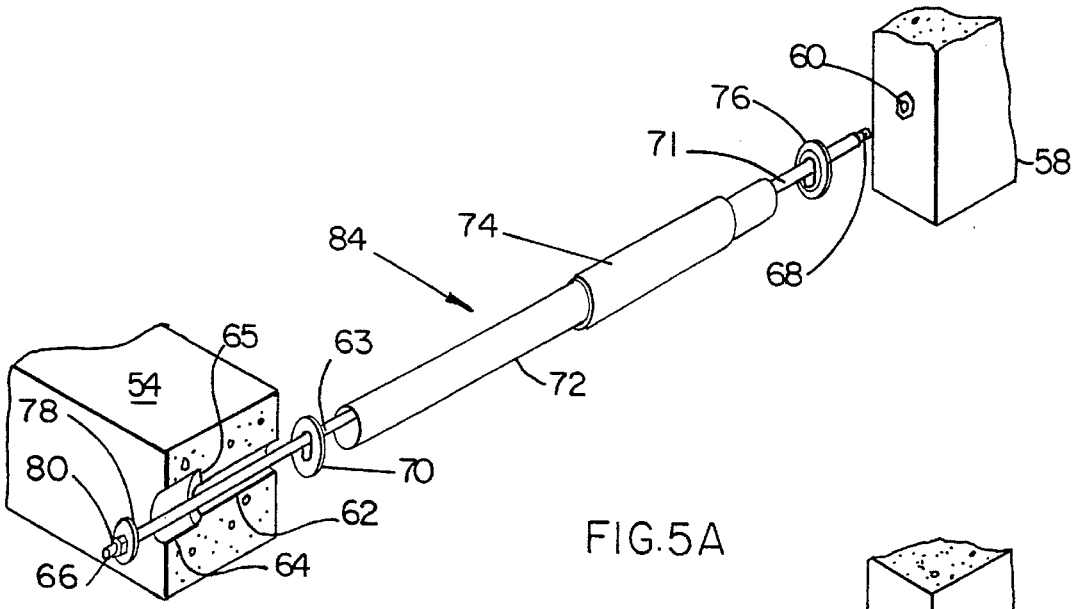
FIGS. 5A–5C are isometric views of a tie rod assembly showing in sequence its attachment to a wall panel and to an anchor block.
Figure 5B:
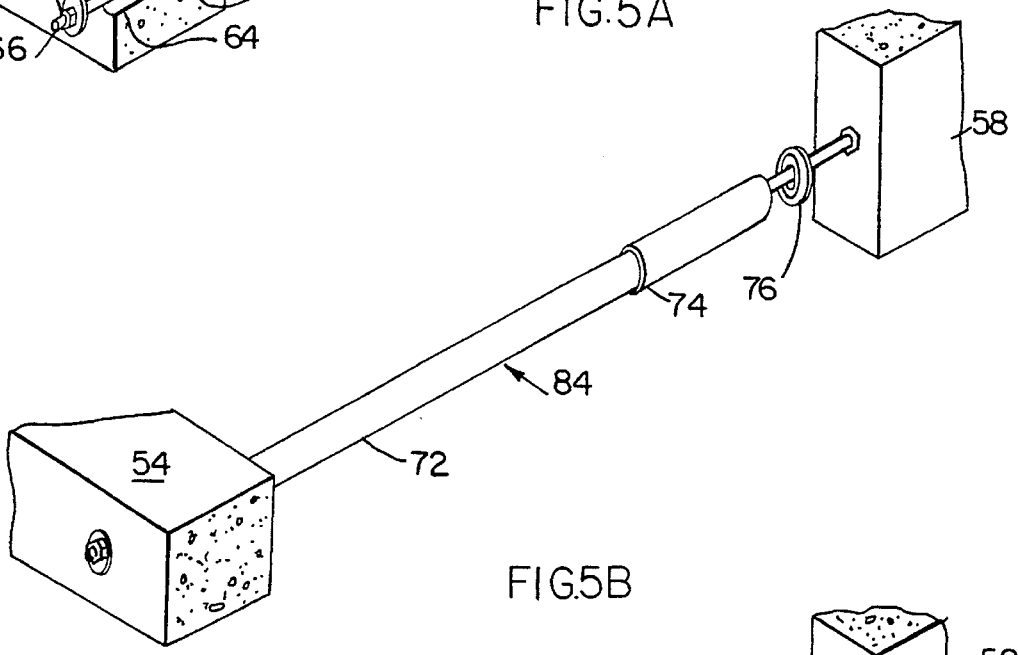
Figure 5C:
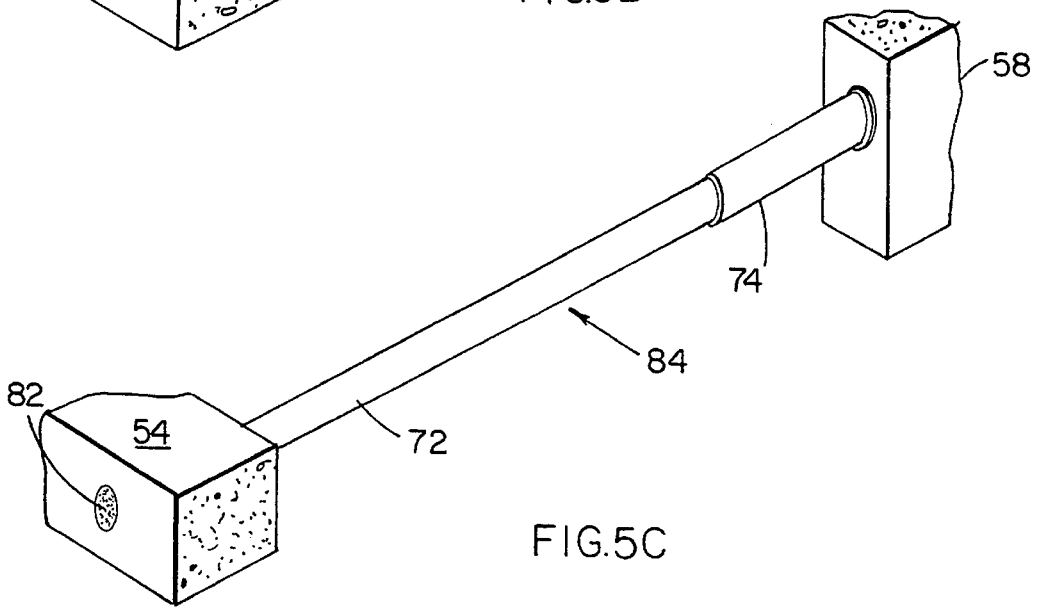

Referring now to FIGS. 5A–5C, a sequential installation of a tie rod assembly 84 between an anchor block 54 and a tee stem 58 of a wall panel 38, 39 is shown. Each tie rod assembly 84 includes a tie rod 63 enclosed within a tie rod sleeve 72. Each tie rod assembly 84 also includes a sliding sleeve 74, a slotted anchor gasket 70 and a slotted stem gasket 76. The anchor gasket 70 and slotted stem gasket 76 may be formed of a resilient durable material such as neoprene. The tie rods 63 may be formed of a material such as rebar having threaded ends (see FIG. 8A). The tie rod sleeve 72 and sliding sleeve 74 may be formed of plastic tubing out of a material such as PVC. Initially and as shown in FIG. 5A, a threaded tie rod end 66 is inserted through a void space 62 and counterbore 64 in the anchor block 54. In FIG. 5A, the tie rod 63 is shown completely inserted and extended beyond the back of the anchor block 54. This is required so that a threaded stem tie-rod end 68 of the tie rod 63 can be inserted into the threaded coupler 60 of the tee stem 58. All of the components of the tie rod assembly 84 are shown unassembled. It is anticipated that the installation contractor will pre-assemble the tie rod assemblies 84 prior to placement in the field, so that the only part to be reattached will be an anchor nut 80 and anchor washer 78. After the tie rod 63 is inserted into the threaded coupler 60 of the tee stem 58 and torqued to the proper value, the anchor nut 80 is tightened to place the anchor washer 78 against an annular shoulder 65 formed by the counterbore 64 in the anchor block 54.

The sliding sleeve 74 is required to cover any unexposed tie rod 63 not covered by the tie rod sleeve 72. Following initial tightening of the anchor nut 80, the tie rod sleeve 72 is placed onto the anchor gasket 70 and these components are held in place against the face of the anchor block 54. Simultaneously an adhesive such as PVC adhesive is applied to the tie rod sleeve 72 surface at the stem end of the tie rod sleeve 72. The sliding sleeve 74 is then pushed along with the stem gasket 76 against the tee stem 58. Holding the outer tie rod sleeve 72 and sliding sleeve 74 in opposition against the anchor block 54 and tee stem 58 for a moment until the adhesive sets up, results in an effectively continuous encasement over the tie rod 63. It is anticipated that a contractor will perform this tie rod assembly 84 installation for numerous tie rods 63 at once so that the adhesive between tile tie rod sleeve 72 and sliding sleeve 74 on the first tie rod assembly 84 has secured the two sleeves 72 and 74 by the time the last assembly has been installed and adhered. After the PVC bond is complete, usually in a few minutes, the anchor nut 80 can be torqued to the correct pretension value. The pretension adds a slight compressive force to the tie rod 63 and tie rod sleeve 72 and increases the contact pressure of the gaskets 70 and 76 to the surface at both the anchor 54 and the tee stem 58. The pretensioning also secures the tie rod assembly 84 between the wall panel 38 and the anchor block 54 and provides an adequate barrier to prevent moisture in the backfill 52 from reaching the tie rod 63. The initial deflection of the tie rod 63 has been anticipated and compensated for by the pretensioning so that when the earth load is applied, horizontal movement of the base wall panel 38 will be negligible. As shown in FIG. 5C, following pretensioning the anchor void 62 is filled with grout 82 to completely cover all of the exposed parts of the tie rod 63. The PVC sleeve 72 and sliding sleeve 74 also provide corrosion protection as well as a compression sleeve for the pretension torque requirement for the tie rod 63.

A key design feature of the retaining wall system is the ability to install the tie rod assembly 84 from within the wall confines. The tee stems 58 formed on the wall panels 38, 39 provide the required space to position the tie rod 63 through the anchor block 54. By using the threaded coupler 60 in the tee stem 58, the threaded tie rod end 68 can be attached to the wall panels 38, 39 without the necessity of providing a void in the panel faces that would be required if a bar had to be inserted from outside the wall confines. A void or hole in a wall panel face would require scaffolds to install the tie rod 63 and require unsightly grouting over the hole at the face of the panel.

Figure 6A:
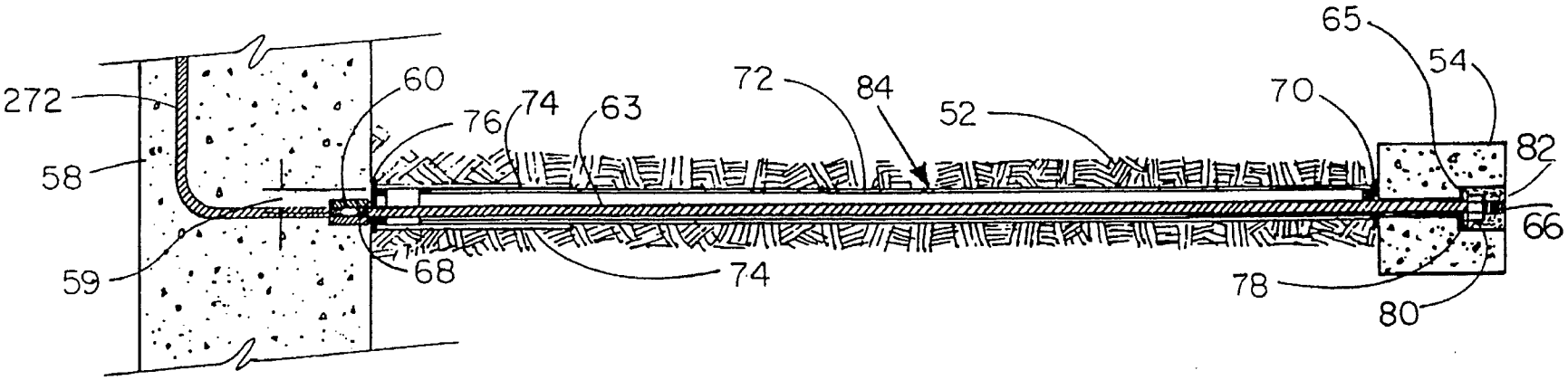
FIG. 6A is a section through an installed wall panel, tie rod assembly and anchor block showing the assembly following the construction of a wall.
Figure 6B:
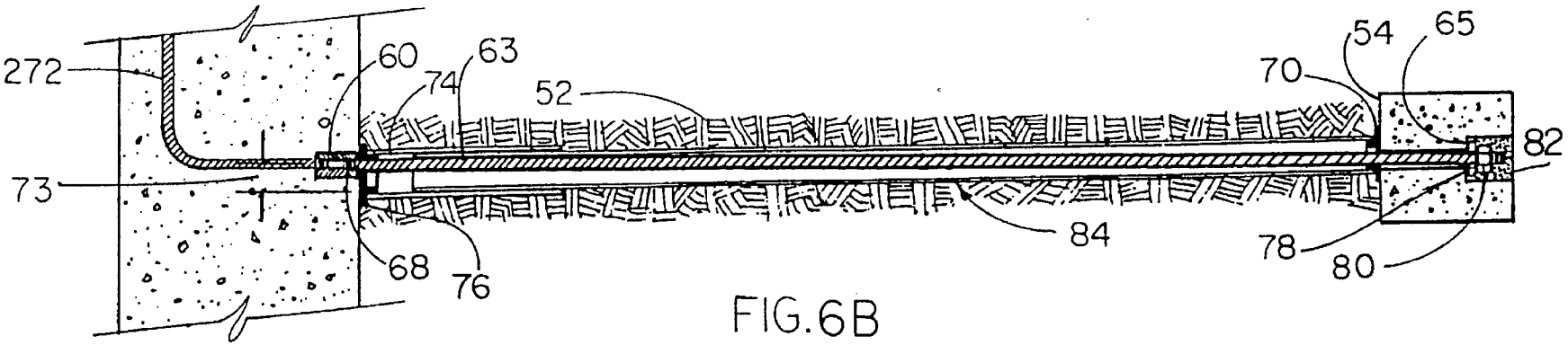
FIG. 6B is a section through an installed wall panel, tie rod assembly and anchor block showing the effect of differential settlement and movement of a sleeve component of the tie rod assembly to prevent the inducement of shear loads on the tie rod.
Figure 6C:
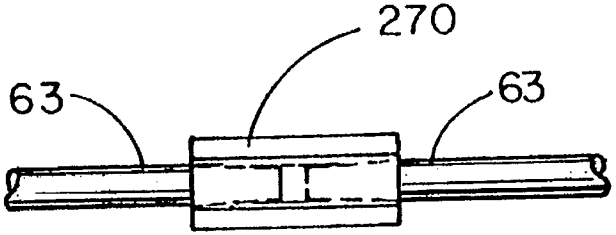
FIG. 6C is a side elevation view of a rebar coupler for forming a tie rod of the wall system out of multiple lengths of rebar.

Referring now to FIGS. 6A–6C, the function of the wall panels 38, 39 and wall system 10 during vertical movement or settling of the backfill 52 is shown. In FIG. 6A, the threaded end 68 of the tie rod 63 is attached to the threaded coupler 60 of the tee stem 58 of a wall panel. The threaded coupler 60 is cast into place in the tee stem 58 and reinforced by connection to a reinforcing member 272. As will be more fully explained, the reinforcing member 272 may be formed of rebar or a glassfibre construction material. Furthermore, the threaded connector 60 may be designed to accommodate some flexure at the connection point between the tie rod 63 and threaded coupler 60. The outer sliding sleeve 74 and inner tie rod sleeve 72 are shown firmly in place forcing the gaskets 70, 76 against their bearing surfaces at the tee stem 58 and the anchor block 54. The anchor nut 80 and tie rod end 66 have been pretensioned and covered with grout 82. A vertical distance 59 is shown at the tee stem 58 gasket 76 interface. The vertical distance 59 is equal to the slot length 71 (FIG. 5A) of the gaskets 70, 76. The vertical distance 59 is also equal to the difference between the outer diameter of the tie rod 63 and the inner diameter of the tie rod sleeve 72. This vertical distance 59 or clearance dimension is determined in the initial design and the tie rod sleeve 72 is sized to correspond to this dimension. The slot lengths 71 (FIG. 5A) for gaskets 70, 76 are sized to correspond to the maximum expected vertical differential settlement. By providing this range of relative vertical displacement, the possibility of producing shear forces on the tie rod 63 is virtually eliminated. The ability of the soil mass to move with the tie rod sleeve 84 is another key design aspect of the present invention.

FIG. 6B depicts a condition that can occur in retaining structures which in the field is referred to as a differential settlement. For the settlement condition depicted in FIG. 6B, the backfill 52 surrounding the tie rod sleeve 72 and sliding sleeve 74 has settled or moved downward with respect to a wall panel 38 or 39. This movement is typically the result of insitu foundation material under the wall settling or deforming slightly due to the weight and overturning forces of the wall mass on the material under the wall base. Although soil borings are typically completed prior to wall construction and are done at specific locations in the wall vicinity, these borings do not always predict what the insitu material will be under the wall excavation. Therefore, if a weak material is not encountered by the soil testing, and it is located in the insitu material under the wall mass, a slight differential movement can result. Due to the oversized tie rod sleeve 72 and slotted end gaskets 70, 76 a vertical deflection 73 can be accommodated without inducing shear forces on the tie rod 63. The ability of the system to accommodate differential settlement by relative displacement of the corrosion resistant tie rod sleeve 72 without adding stresses to the wall components (e.g. shear to the tie rod 63) is a key design feature of the present invention.

The tie rod 63 may be formed as a continuous section of a material such as rebar having threaded ends. Alternately, a rebar coupler 270 may be used for splicing together lengths of rebar to form a tie rod 63 of a desired length. FIG. 6C illustrates a rebar coupler 270. The coupler 270 includes threaded ends for receiving and joining opposite ends of the tie rod 63. This type of rebar coupler 270 is commercially available. One suitable coupler is manufactured by ERICO Products, Inc. and is sold under the trade name "Lenton Rebar Splicing".

Figure 7:
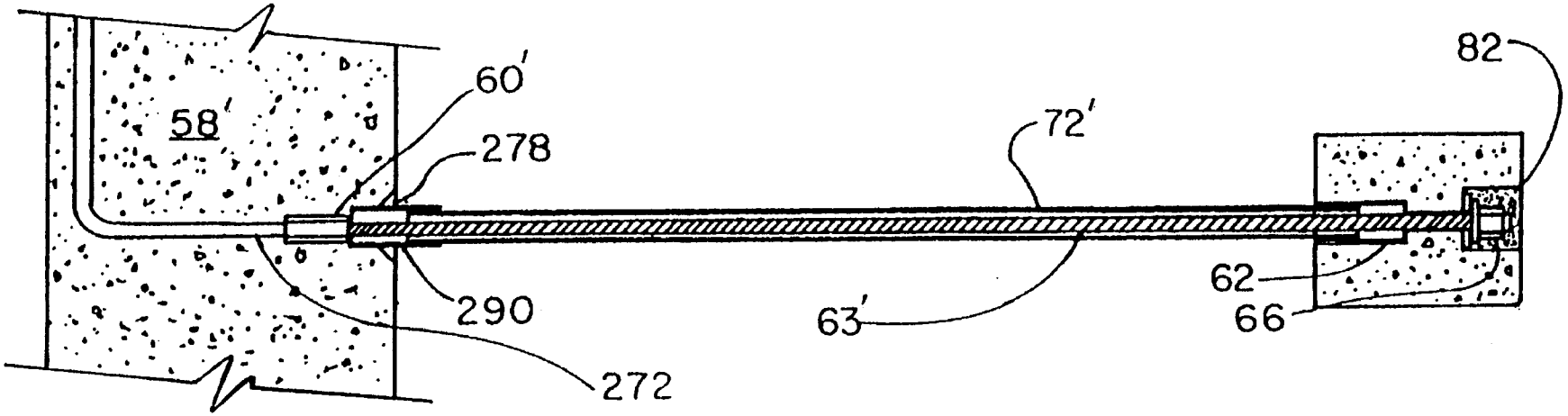
FIG. 7 is a section equivalent to FIG. 6A but showing an alternate embodiment, tie rod attached to a flexible coupling.

With reference to FIG. 7, a tie rod 63' may also be constructed of a glassfibre bar with formed threads. Suitable glassfibre bars are manufactured by Dywidag Systems International. The reinforcing member 272 may also be formed of a glassfibre bar. As shown in FIG. 7, the glassfibre tie rod 63' may be used in conjunction with a flexible connector 290 connected to a tie rod sleeve 72'. Such flexible connectors 290 are commercially available from a manufacturer such as Dywidag or NPC.

Flexible connectors 290 formed of a material such as robber are typically used in utility applications such as for connecting drain pipes to man holes. The flexible nature of these connectors is an advantage in such applications (drainage) because they can accommodate pipe elevation differences and still maintain a water fight seal.

Since flexible connectors 290 accommodate shear (the load induced by vertical settlement) by bending, their use requires a void space 278 in the tee stem 58'. This space 278 allows the tie rod 63' to flex or bend without binding. The use of the flexible connector 290 either cast into the tee stem 58' or inserted into the void 278 in front of the threaded coupler (threaded bar connector) 60' eliminates the use of the sliding outer sleeve 74 and gaskets 70, 76 shown in other embodiments. The additional step of gluing the sliding sleeve is also not required with the flexible connector. This would be the preferred embodiment on wall panels where sufficient depth is available in the tee stem 58' to allow for the settlement void to be cast into the stem.

Figure 8B:
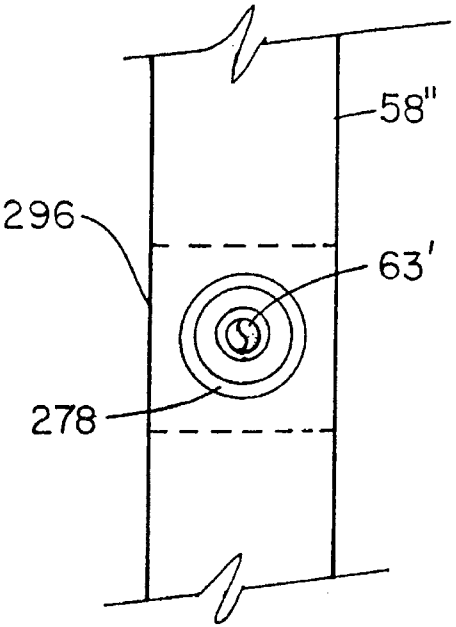
FIG. 8B is a partial front view, taken from the fight side of FIG. 8A, of a tee stem with a tie rod inserted therein.
Figure 8A:
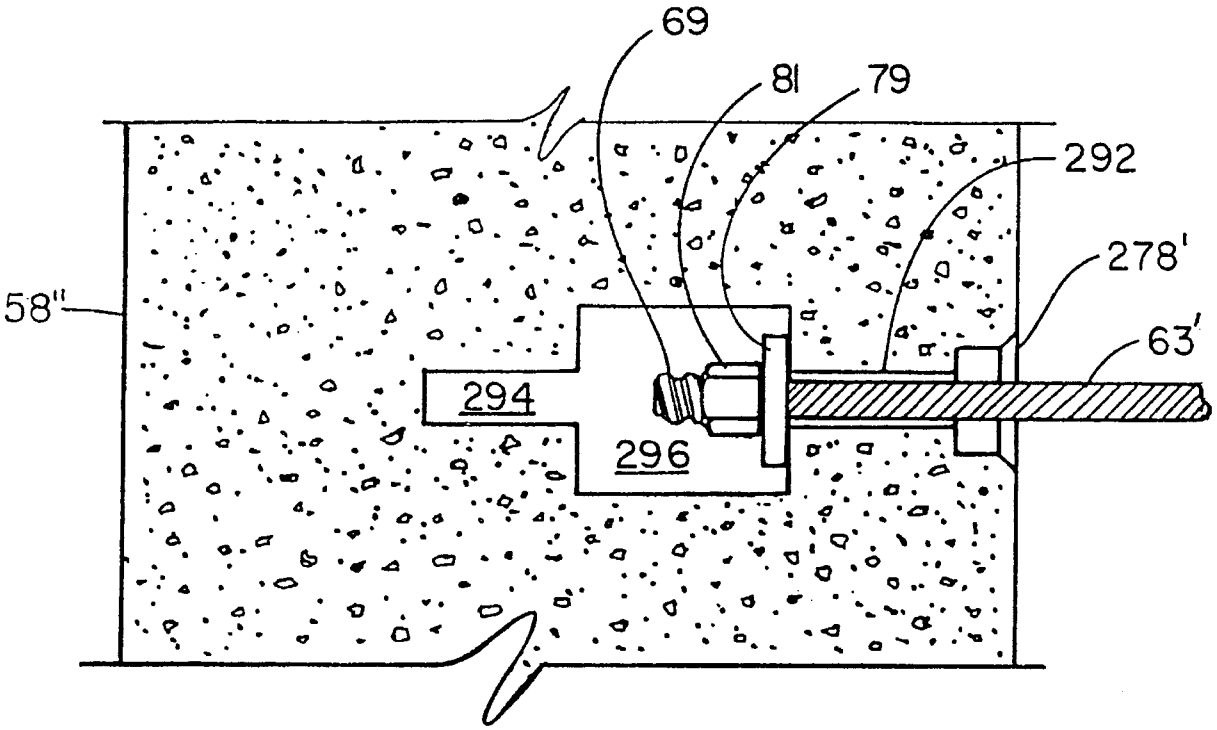
FIG. 8A is a vertical cross-section through the center of an alternate embodiment tee stem at the tie rod connection showing a preferred embodiment of an alternate construction for attaching the tie rod to the tee stem.

With reference to FIGS. 8A and 8B, the connection of the tie rod 63' to an alternate embodiment tee stem 58" is shown. As shown, the tee stem 58" may include a first void 294 to accommodate longitudinal adjustment of the tie rod 63' during assembly. A second void 296 is provided for securing the tie rod end 69 using a nut 81 and washer 79. As with the tee stem 58' (FIG. 7), a void space 278' may be provided to accommodate vertical displacement of the tie rod 63'. The voids 294, 296 are cast into the tee stem 58". The nut 81 and tie rod washer 79 are shown attached to the tie rod end 69. The cylindrically shaped void 294 is shown extending beyond the back of cylindrically shaped void 296. The void 294 enables the tie rod 63' to be pushed back into the tee stem 58" a distance equal to or greater than the difference between the length of the tie rod 63' and the distance between the face of the tee stem 58" and the anchor block 54. The rod 63' can now be lined up with the threaded coupler 60 at the anchor block 54 (FIG. 3) and inserted. This push back void 294 type of tie rod connection is desirable when it is impractical to access the end of the tie rod mounted within the anchor block 54. If a steel tie rod 63 is used, it is necessary to grout the void 296 to cover any exposed steel parts.

FIG. 8B is a partial front view, taken from the fight side of FIG. 8A, of the tee stem 58" with the tie rod 63' inserted. The rod 63' is shown in place installed into the counter bore void 278 and tie rod hole 292. The counter bore void 278 is sized to accommodate a flexible coupler such as coupler 290 shown in FIG. 7.

Figure 9:
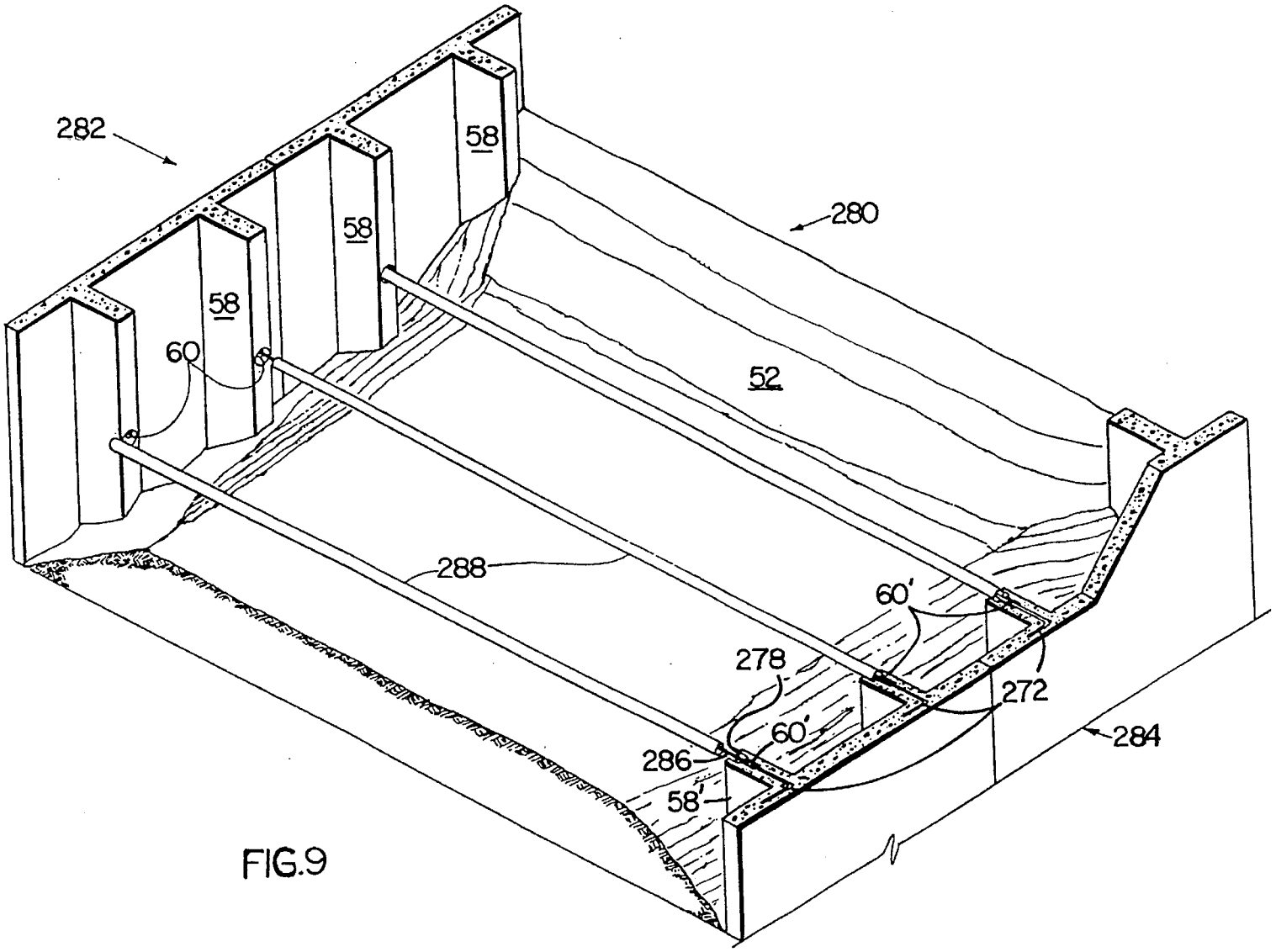
FIG. 9 is a perspective view of a retaining wall system having parallel spaced walls that are cross-tied together.

With reference to FIG. 9, such a flexible coupling 60' can also be used to form a cross-tied structure 280. Such a cross-tied structure 280 includes parallel spaced retaining walls 282, 284 assembled substantially as previously explained. The retaining walls 282, 284 are connected by a cross tie rod 286 enclosed in a tie rod sleeve 288. The tie rod 286 is preferably formed of a Dywidag glassfibre threadbar or its equal. A threaded coupler 60 is cast into the tee stems 58 on the wall panels of retaining wall 282. This may be a standard connector. The connectors 60' for the wall panels of retaining wall 284, on the other hand, may be flexible connectors 60' as previously explained. Such flexible connectors 60' will accommodate any differential vertical settlement between the retaining walls 282, 284.

Tie Rod Force Determination

Figure 4A:
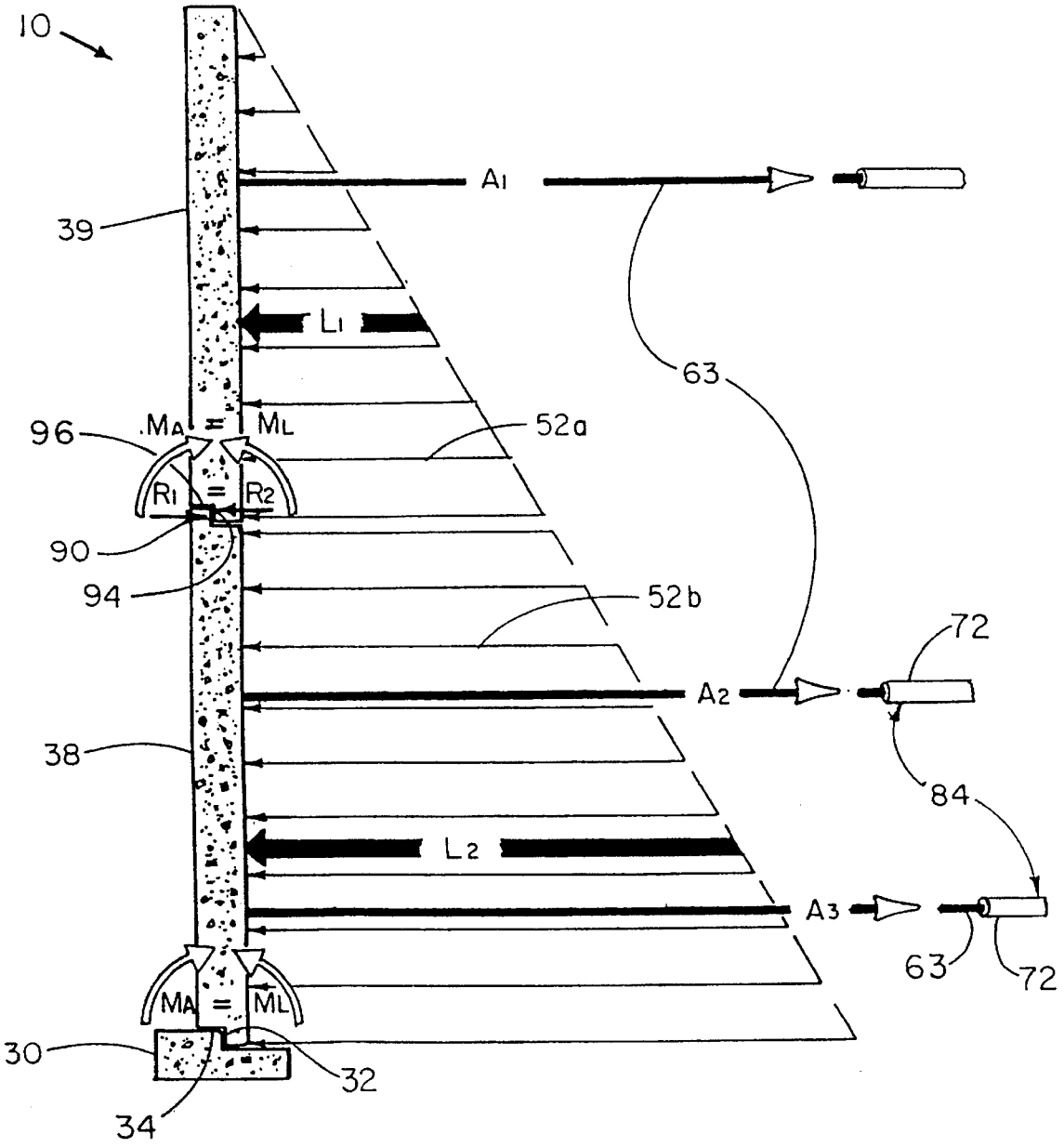
FIG. 4A is a cross-sectional schematic illustrating a tie rod force determination for the retaining wall system shown in FIGS. 1–4.

Typically retaining walls are built from the bottom up, but to determine the earth loads and subsequent anchor resisting force, it is necessary to proceed from the top down and calculate the opposing forces that keep the structure in equilibrium. FIG. 4A depicts a section cut vertically through the face of a segmental anchored wall 10 as shown in FIG. 1. For the wall system 10 shown in FIG. 4A, the equivalent fluid pressure method is used to calculate the horizontal earth loads on the wall. The shaded rectangle at the top left portion of FIG. 4A represents the top upper tier panel 39 for a two tier vertical wall. The horizontal load L1 imposed on the upper tier panel 39 is the result of the horizontal earth pressure **52*a* acting on panel 39. This load is resisted by the horizontal tensile force A1 transmitted by the tie rod 63 through the tie rod assembly 84 to the anchor block 54** (not shown).

The other restraining force acting on the panel 39 is located at the bottom of the panel at the vertical bearing surface 90 transmitted through the vertical bearing pad 94. Since the panel is restrained from horizontal movement at the bottom, the sum of the moments of the load ML and the anchor moment MA taken at the bottom of the panel is zero. These moments are represented by MA and ML. By equaling these moments, the anchor force A1 can be calculated following the determination of L1. The result of the horizontal forces are zero, so R1 can be computed by determining the difference between L1 and A1.

The load L2 imposed on panel 38 is the resultant of the horizontal earth pressure **52*b* that includes the surcharge earth loads from the top tier earth loads 52*a*. Since the foundation beam 30 is typically not designed to resist sliding, the horizontal load L2 acting on panel 38 is resisted by the tension restraining forces A2 and A3. These forces A2 and A3 also resist the load R2, which acts on the vertical bearing surface 90 of panel 38. Load R2 is imposed on panel 38 from the load L1 exerted on panel 39. As shown in FIG. 4A, the forces R1 and R2 are equal. Since R1 has been previously computed for panel 39, that value along with load L2 can be used to express one anchor load A1 with respect to A2 in the moment analysis computed at the base of panel 38 in the horizontal load force equilibrium equation. The anchor force relationship can then be used in the moment equilibrium equation to determine the value of the anchor force A2 or A3. After this value is determined, the previous relationship (determined from equating the horizontal loads and resisting forces) can be used to quantify both anchor tension forces A2 and A3**.

If the base tier formed of base wall panels 38 has one anchor, as is typically the case for a horizontal offset wall, the bottom restraining force is from the bearing flange 32 on the cast-in-place foundation beam 30, and a similar analysis can be done that was described previously to determine the forces acting on an intermediate tier. In all cases the overall wall anchor forces total should equal the total earth loads that were determined for each tier by the equivalent fluid method.

Conventionally designed tied back anchored walls have heretofore used post-tensioned anchors. The post-tensioning (applying tension to the anchor) is required with these rigid, nonsegmental face wall so that the anchor loads will be determinate.

The indeterminate nature of these post-tensioned anchored walls (more unknown than equations) are forced to equilibrium and defining anchor loads by imposing a passive condition (pushing against the soil) on the wall face by the post tensioning. This results in high loads on the anchors and wall face; subsequently wall costs are extremely high with this conventional method of earth retention.

The segmental anchored wall design (e.g., 10 FIG. 1), by utilizing a maximum of two ties at the same elevation per panel, allows the face to articulate (maintain an active soil condition). The interdeterminate problem is therefore eliminated with the present design and anchor loads and panel reactions can be determined.

A key design aspect of the present invention is the articulating (hinged) effect of the panels at the vertical bearing surface 90. This slight movement that is allowed by the horizontal bearing pad 96 prevents a passive condition from developing within the wall structure, and allows the designer to use active earth loads. By maintaining an active condition (allowing slight infinitesimal movements), the tie rod assembly 84 length is kept to a minimum.

Retaining walls (e.g., 10 FIG. 1) are typically used to support improvements behind the wall such as bridge approaches, etc. and the long term performance is of the utmost importance. This criteria is met with the use of the present invention that has not heretofore been possible.

Since vertical differential settlement of fill between the wall face and the backfill can occur over time, it is essential for the wall's design performance to be unaffected by this phenomenon. The non-corrosive tie rod sleeve 72, by moving with the fill over time without touching the tie rod, is a key design feature of the present invention. Because of the allowable vertical movement of the sleeve 72 with the backfill, tension is the only force that can be placed on the tie rod 63. By eliminating the possibility of inducing shear at the points of connection of the tie rod with the wall panels 38, 39 and anchor block 54, structural failure of connecting wall element (e.g., threaded coupler 60) is virtually eliminated. Of equal significance for wall performance is the predictable strength characteristics of the tie rod 63. This is not a concern, because section reduction due to corrosion is again virtually eliminated with the tie rod 63. The double function of the sleeve 72 results in indefinite wall life.

Alternative Embodiments

Referring now to FIGS. 10, 11A, 11B and 12, a cantilevered wall system 20 is shown. The cantilevered wall system 20 is similar in construction to the wall system 10 previously described except for the construction and anchoring of the base panels. A cantilever "T" panel 108 for the cantilevered wall system 20 includes tee stem extensions 110 that extend past a lower horizontal edge 274 of the base panel. This is clearly shown in FIGS. 11A and 11B. The lengths of the tee stems 110 vary depending on the overall height of the base wall panel 108. As with the previously described base panels 38, the cantilevered base panels 108 include a cast threaded coupler 60 for securing the tie rod assembly 84, and anchor bolts 86 for securing an upper tier panel as previously described.

Figure 10:
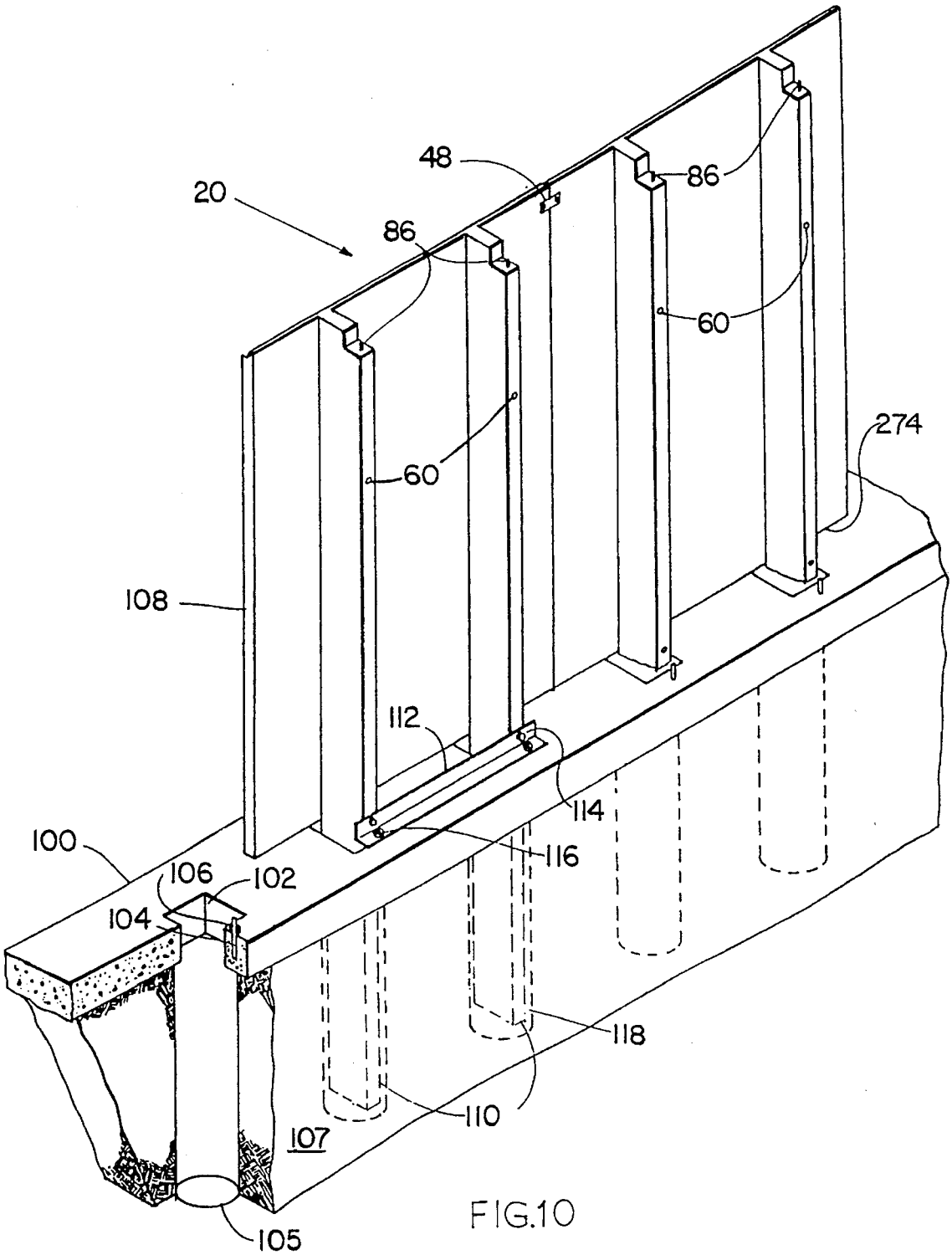
FIG. 10 is a rear isometric view of two base tier panels being installed for a cut wall application and showing the foundation beam with the panels set on it and with the panel leg extensions set into the drilled shafts.
Figure 11A:
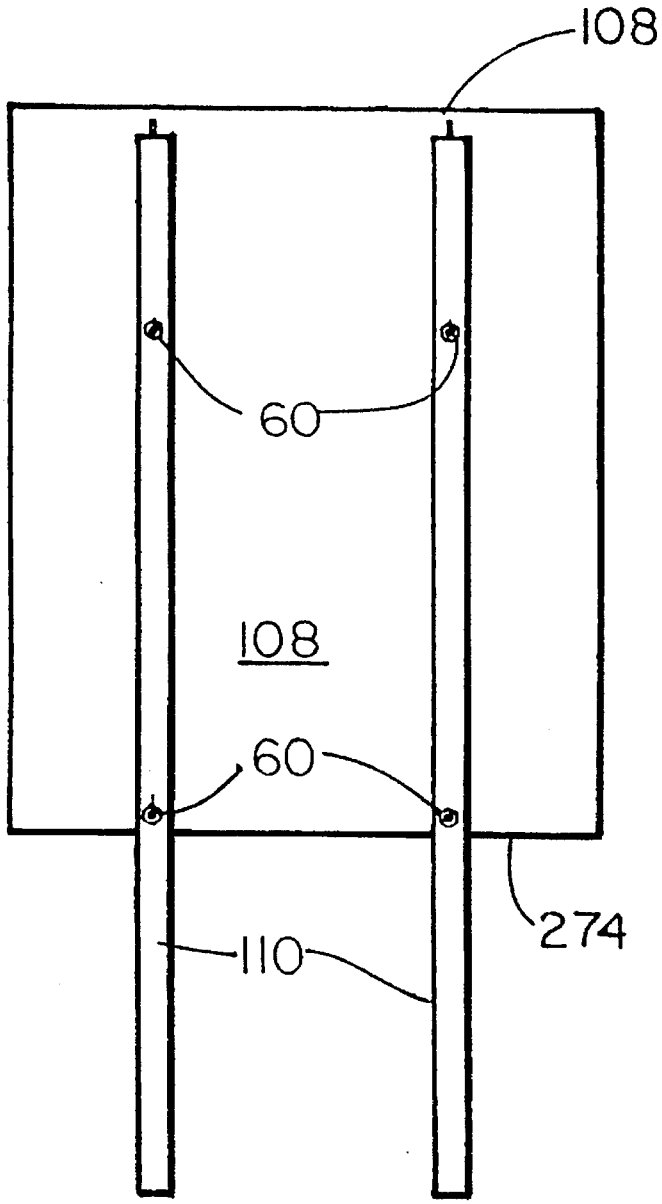
FIGS. 11A and 11B show a back and side view of a tee stem extension panel for a wall system constructed in accordance with the invention.
Figure 11B:
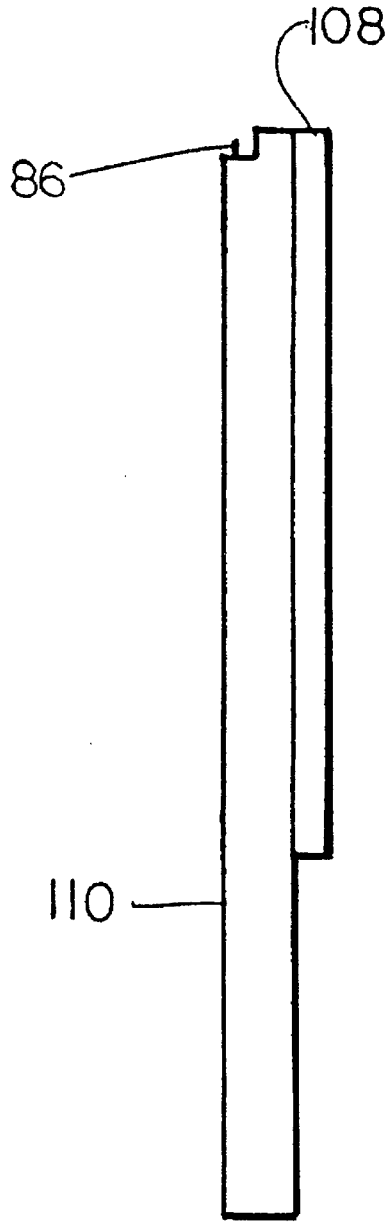

As shown in FIG. 10, for forming a base tier, the base wall panels 108 are secured to a cast-in-place foundation beam 100. Temporary anchor angles 112 securing nuts 116 and stem bolts 114 secure adjacent panels 108 to one another. The anchor angle 112 is placed over bolts 104 on the foundation beam 100 and the adjusting nuts 106 set to level prior to placing the base tier panel 100. The cantilevered tee stem extensions 110 are shown with dotted lines having been inserted through a foundation void 102 and into a drilled shaft void 105. For permanently securing the base wall panels 108, the shaft void 105 is filled with concrete II 8. The base wall panel 108 on the fight of FIG. 10 is shown with the adjacent panel clip 48 attached but the temporary angle base attachment 112 has been removed and installed as shown on the left panel 108. The right panel is shown standing without the angle base attachment 112, because the drilled shaft void 105 has been filled with concrete 118. Filling the foundation void 102 and shaft void 105 around the tee stem extensions 110 provide adequate support for the base wall panel 108 and eliminate the need for either a shear key on the cast-in-place foundation beam or the tie rod assembly that is required for a fill application.

Figure 12:
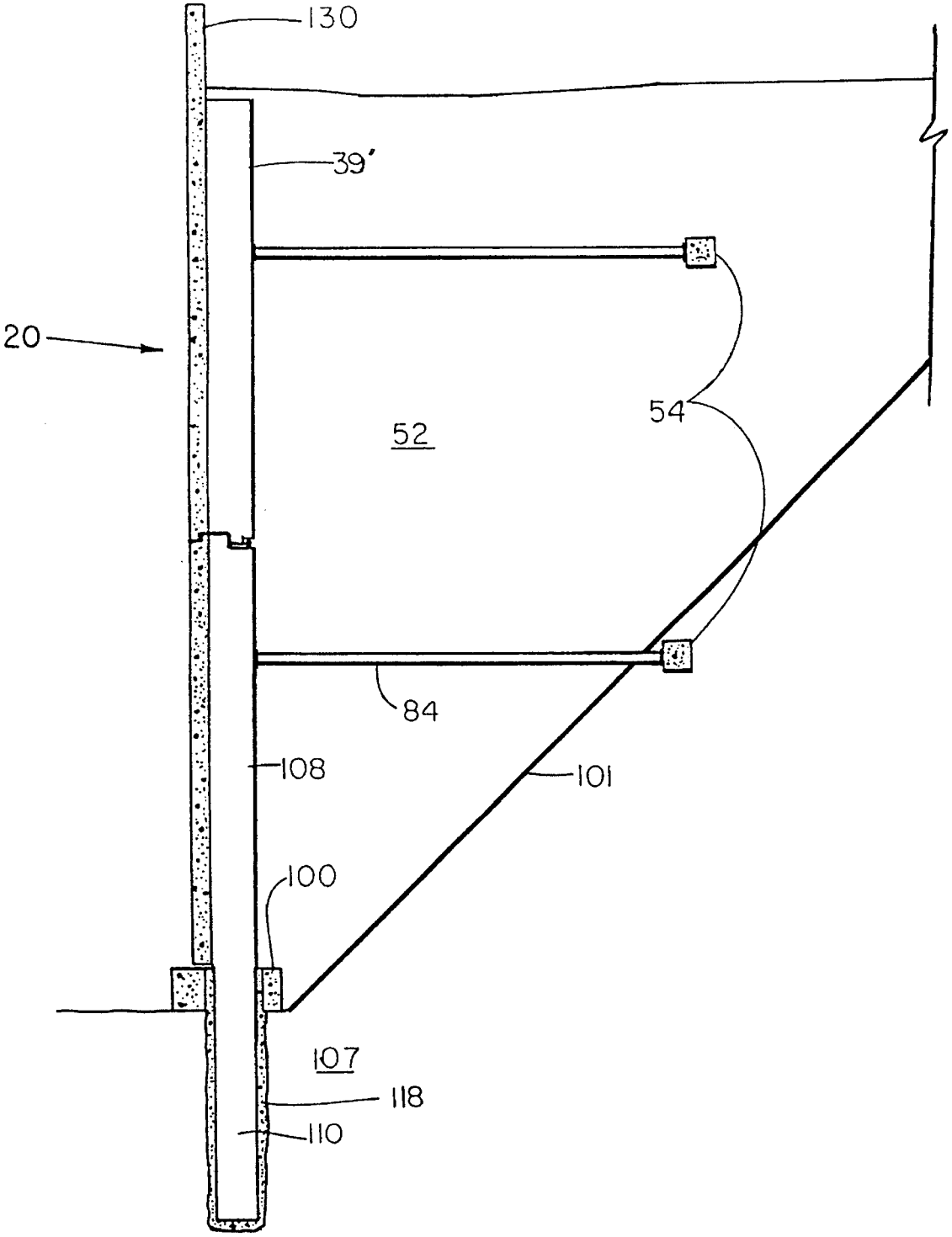
FIG. 12 is a section taken through a cut wall constructed in accordance with the invention.

In FIG. 12 a two tier cantilevered wall system 20 is shown installed over insitu soil 107 that has been formed as a cut slope 101. FIG. 12 depicts a completed wall with the base tier cantilever panel 108 set into a cast-in-place foundation beam 100. The existing cut slope fill line 101 is shown originating at the back of the foundation beam 100 and extending up at approximately 45 degrees. FIG. 12 shows the cut retaining wall application and limited clearance to the face of the cut slope 101. By utilizing the bending moment capacity of the tee stem 110, the panel 108 can be erected and backfill 52 placed up to the anchor block 54 elevation without the use of the bottom anchor previously shown in FIG. 1 and FIG. 3. The strength of the tee stem 110 is transmitted to the insitu soil 107 and foundation beam by the void concrete fill 118. The cantilever panel 108 is used as a base tier panel for the cut wall application to eliminate the need for temporary shoring that would be required for a larger cut if a tie rod assembly 84 was used as shown in FIG. 1 and FIG. 2. The top panel 39' shown in FIG. 12 has a cantilever face extension 130 extending beyond the top of the backfill 54. Depending on the wall application, this face extension 130 may be necessary for a pedestrian or vehicular barrier.

The tee stem extension panel concept as shown in FIGS. 10 and 12 is a key design feature and is cost effective because it eliminates temporary shoring and additional wall excavation.

Figure 13:
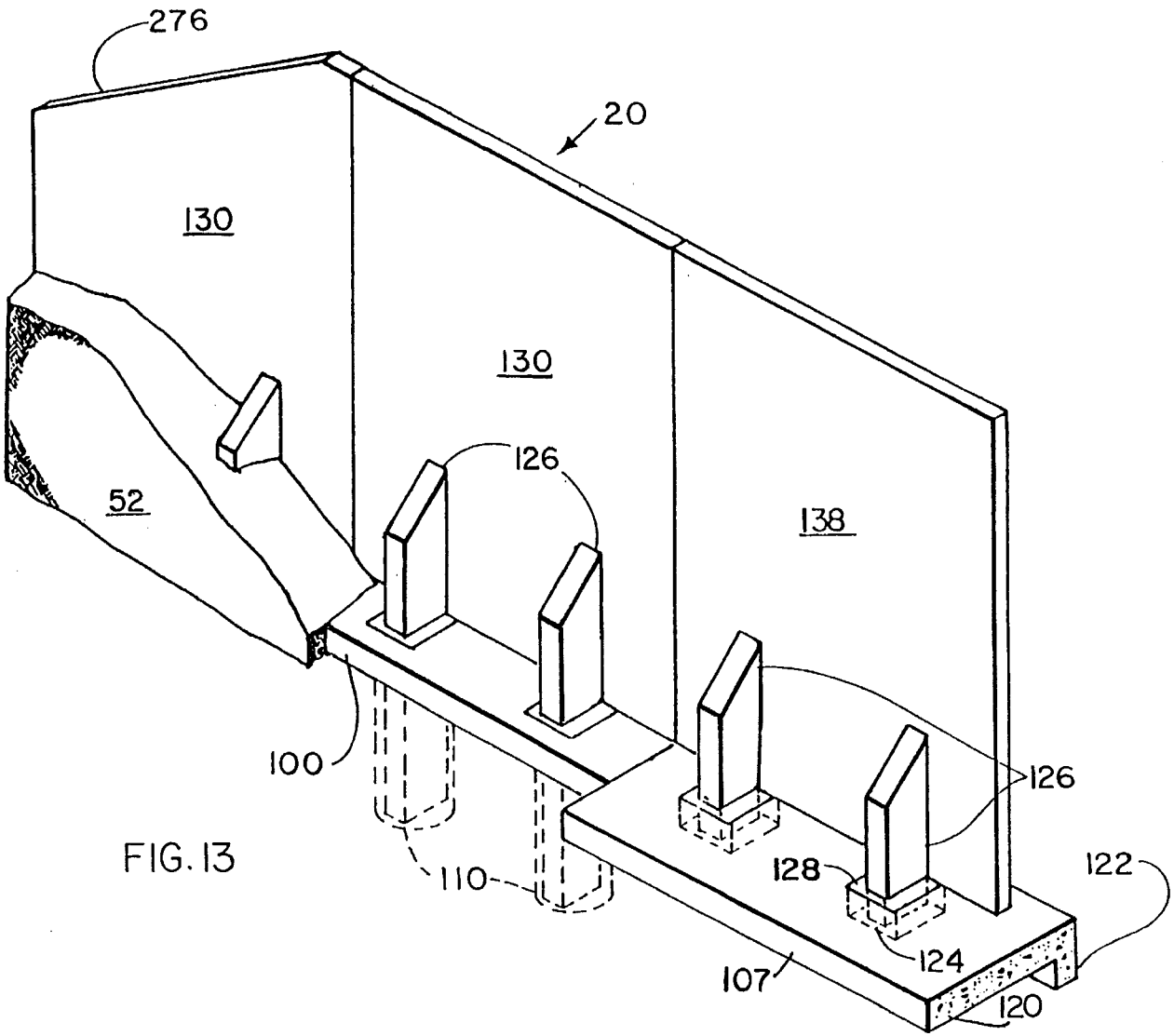
FIG. 13 is an isometric view of a single tier installation for a partially backfilled structure having a standard stem extension panel along with a short extension panel on the fight side.

Referring now to FIG. 13, another cut wall structure is shown. FIG. 13 is a cut wall application depicting a typical condition that occurs at the beginning or end of most retaining wall installations. Typically the wall reaches the highest elevation in the middle of the structures and tapers down to zero at each end. The panel 130 at the left of the isometric view is shown with a tapered top edge 276 and backfill 52 is shown taken to the bottom of the cantilever extension portion of the panel 130.

Two different types of foundation beams are shown in FIG. 13, beam 100 and beam 120. Foundation beam 100 is the standard type for a cut application and was shown in FIG. 10 and 11. The beam 120 is wider than 100 and has larger voids 124 and a shear key 122 at the front of the beam 120. Beam 120 would be required where unanticipated obstacles in the insitu material 107 prevent installation of drilled shafts voids 110. The shear key 122 is additionally required to prevent sliding of the wall. Cast-in-place concrete 128 is shown placed in the foundation voids 124 in the beam 120. The concrete 128 is an effective medium to transfer the earth loads on the panel 138 to the short stem extensions 126 into the foundation beams 120. This foundation beam 120 is suitable for use at the ends of the wall for backfill elevations that are under one half of the panel height.

Figure 14:
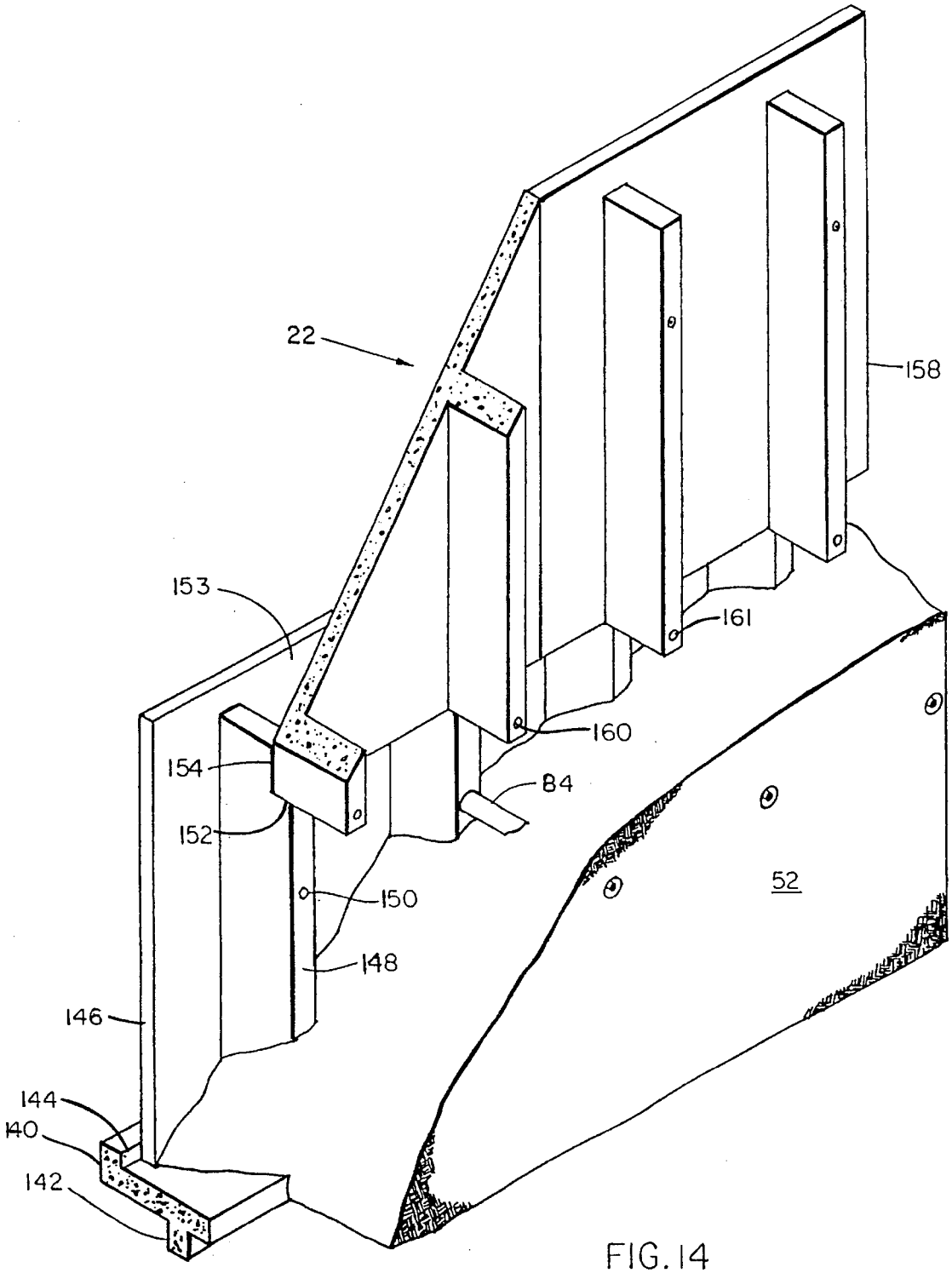
FIG. 14 is a rear partial isometric view of a horizontal offset wall with vertical tiers.
Figure 15:
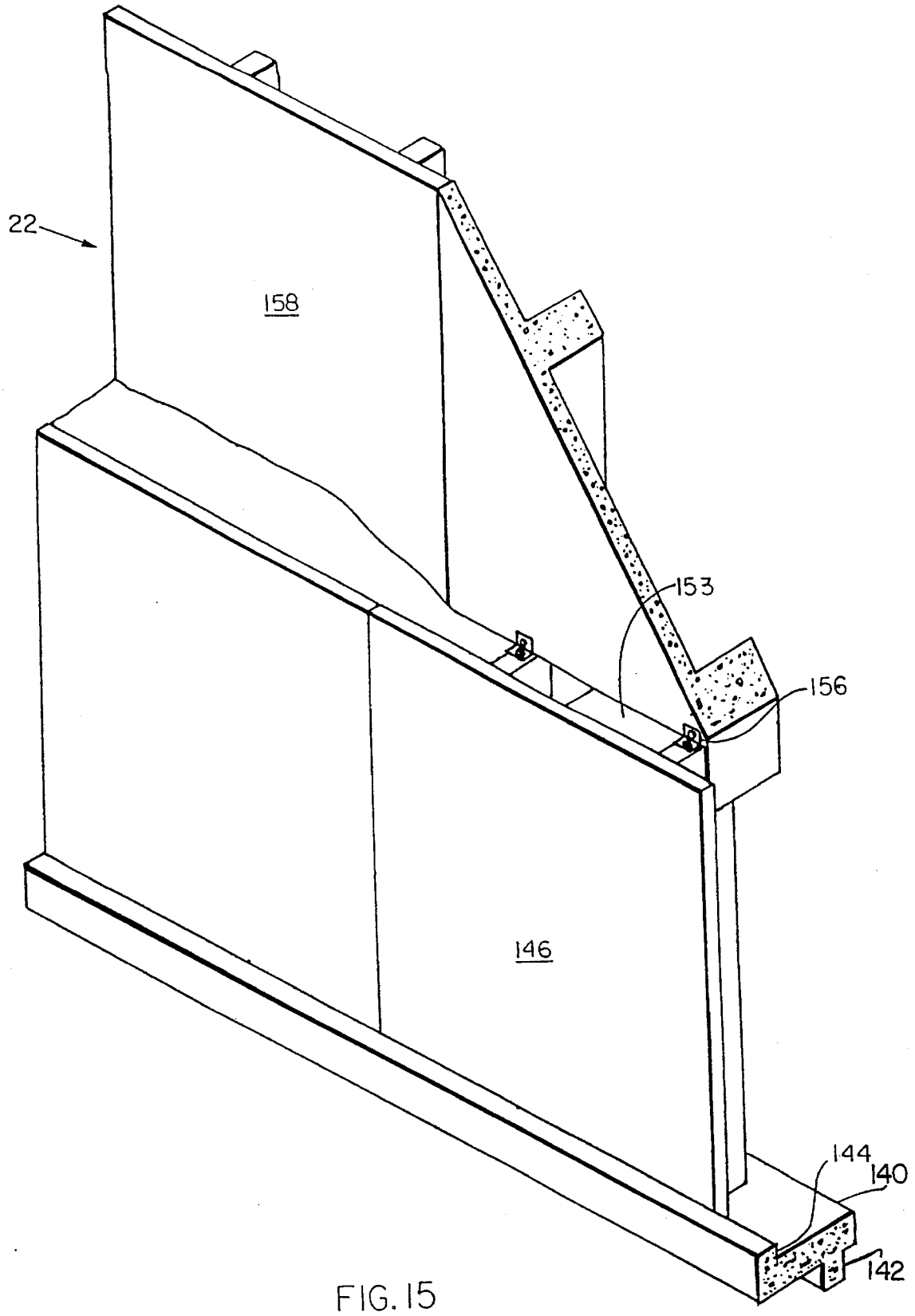
FIG. 15 is a front partial isometric view of a horizontal offset wall with vertical tiers.

Referring now to FIGS. 14 and 15, a horizontal offset wall configuration 22 is shown. The base tier panel 146 is shown in place on the foundation beam 140. Base panel 146 is restrained from sliding at its base due to the vertical bearing flange 144 and the shear key 142 and as shown does not require a bottom tie rod anchor assembly 84 (FIG. 3). The base attachments at the back of the panel 146 to the foundation beam 140 are similar to the hardware shown in the previous configurations. Following placement of backfill 52 the intermediate tier panel 158 is installed on the stem bearing flange 152. Shims (not shown) may be required on these flanges to level the panel 158. Panel anchor bolts 160 are inserted into the voids 161 and tightened to secure the panel 158 against the vertical bearing surface 154. Backfill 52 can then be placed up to the elevation of the anchor block 54 and the tie rod assembly 84 installed. This process of panel 158 erection and backfill is continued until the wall is complete.

As shown in FIG. 15, a horizontal offset distance 153 is formed between the base tier panel 146 and the face of the upper tier panel between tiers. The angle clip assembly 156 may be required to secure the panel from overturning due to wind loading prior to placing backfill 52.

Figure 16:
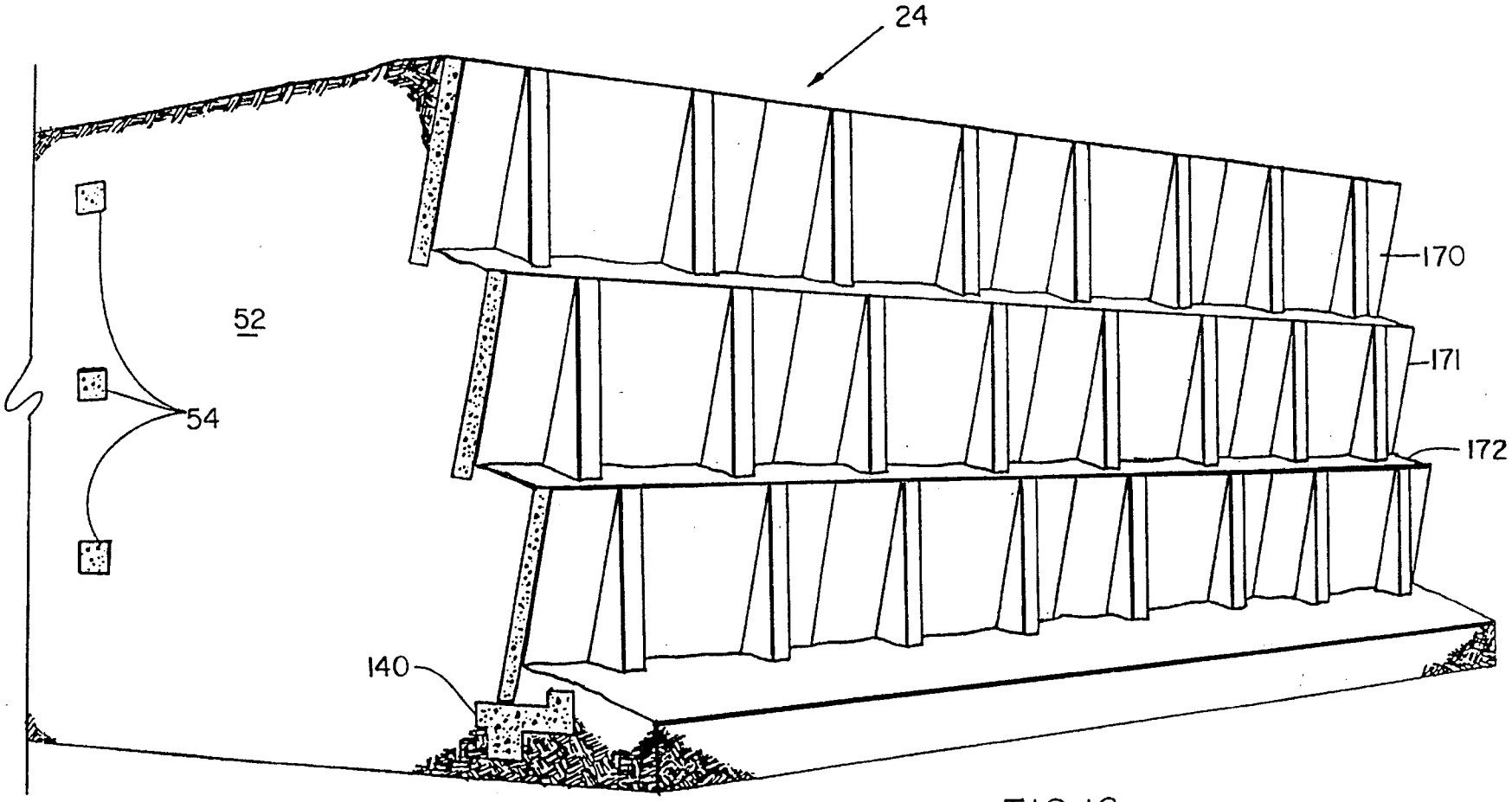
FIG. 16 is a partial front elevation perspective view of an inclined face, horizontal offset, three tier wall.
Figure 17:
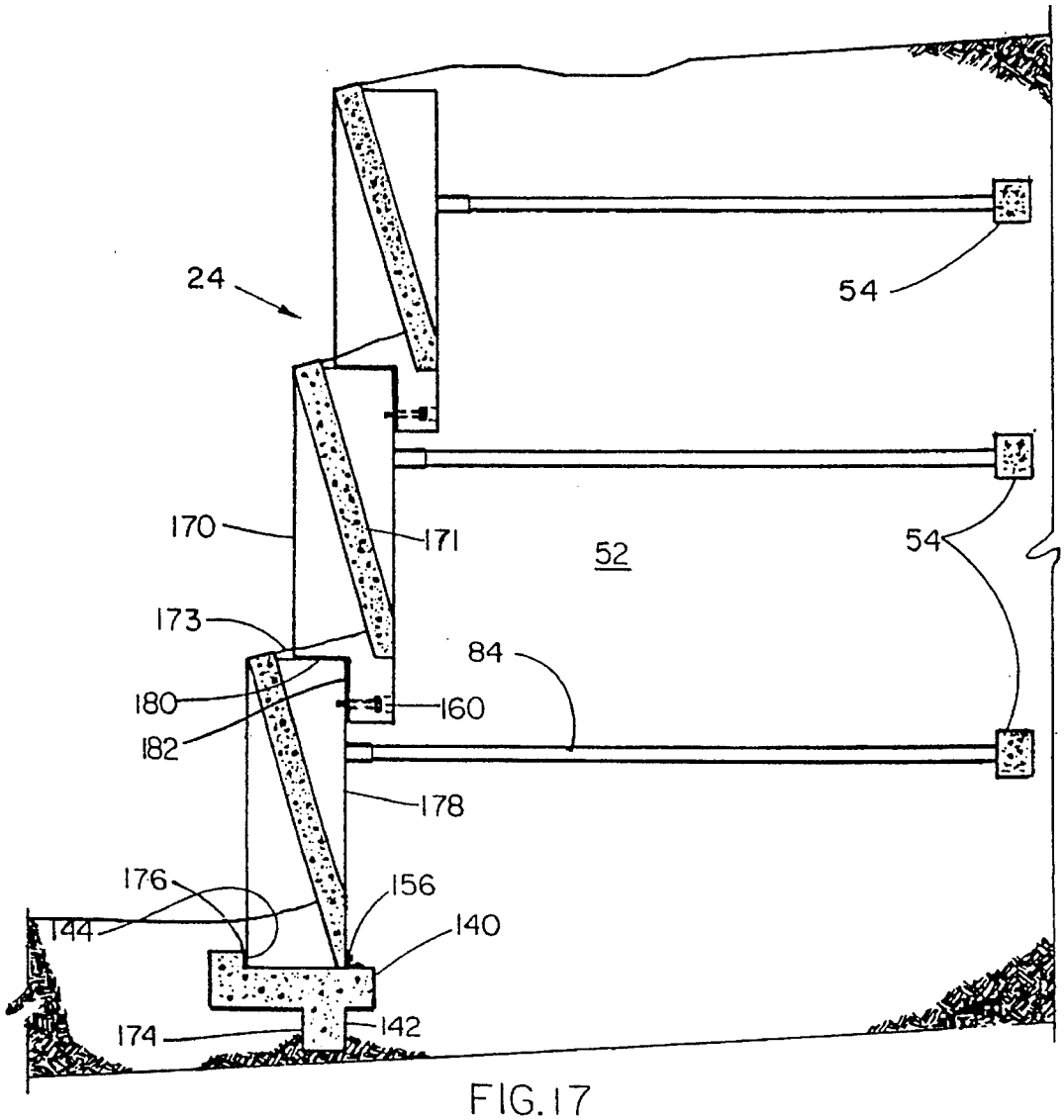
FIG. 17 is a vertical cross-section through the wall shown in FIG. 16.
Figure 18:
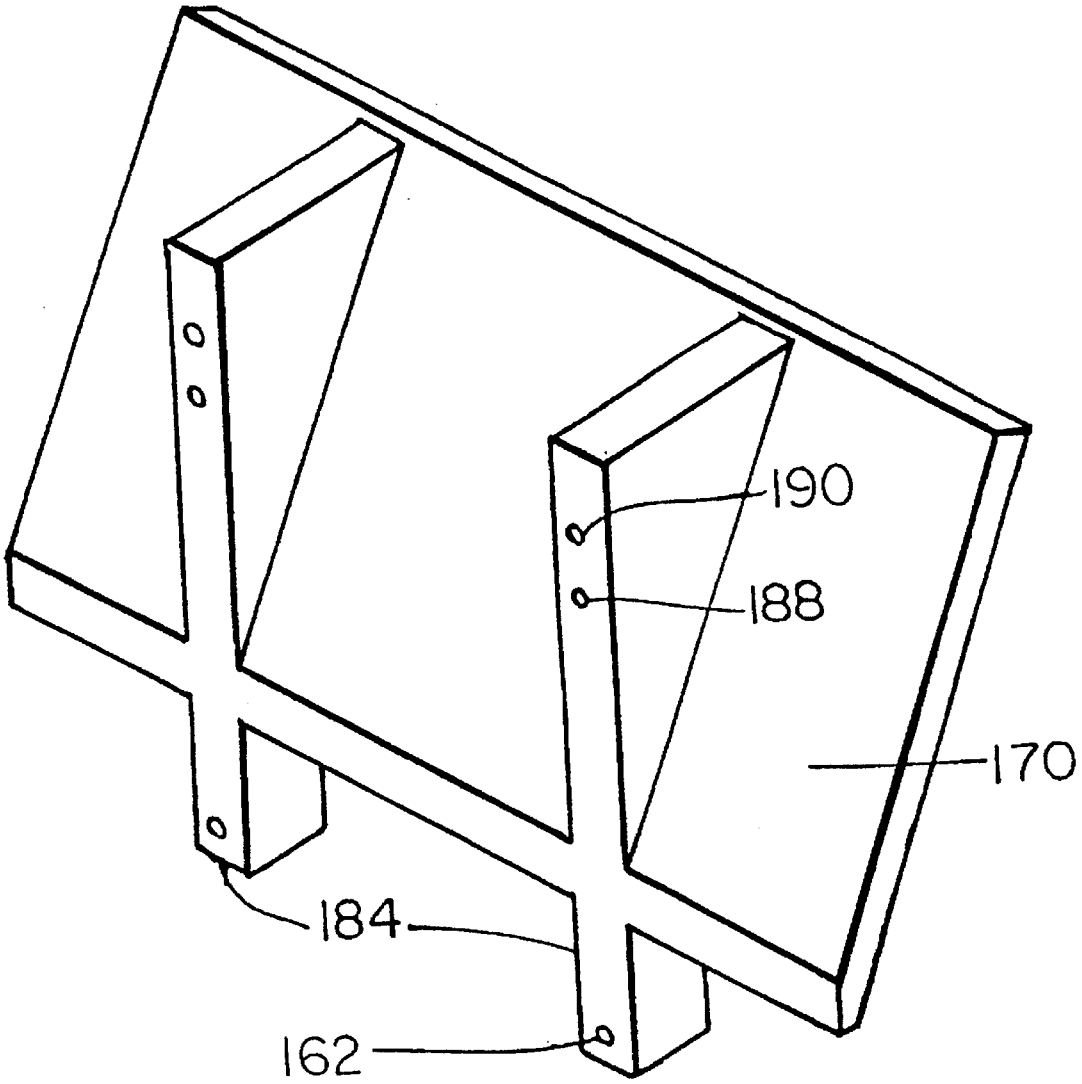
FIG. 18 is a rear isometric view of a typical inclined face "wall" panel.

Referring now to FIGS. 16, 17 and 18, an inclined face horizontal offset wall configuration 24 with three tiers is shown. The batter or vertical offset of the wall face is slight. Because the face 171 of the individual panels 170 are inclined with respect to the tee stem 178, the planting area or horizontal offset 172 is much greater than it would be if the panel face 171 were vertical for the same wall batter. This reverse panel face angle 171 is unique and is a key design of this embodiment of the present invention.

FIG. 17 is a vertical section taken through the panel faces 171 on FIG. 16. The inclined wall panel configuration is erected in a similar fashion to the methods stated for the vertical face horizontal offset wall as shown in FIG. 14. The base tier panel 178 is attached to the foundation beam 140 and secured with the anchor angle and bolt assembly 156 as shown in FIG. 17. The cast-in-place foundation beam 140 has a similar cross-section to the foundation beam used in the vertical face horizontal offset wall 22. A lower tie rod anchor assembly 84 is not used for securing the base tier 178. The shear key 142 resists sliding and the foundation bearing flange 144 transfers the horizontal earth pressure acting on the panel to the foundation beam 140. The panel support connections between the base tier panel 178 and the intermediate tier inclined face panel 170 are the same as shown in FIG. 14 for the vertical face horizontal offset configuration. The intermediate tier inclined face wall panel 170 rests on horizontal bearing surface 180 and transmits the horizontal load into the vertical bearing surface 182 in a similar fashion that is shown in FIG. 4 for the standard wall configuration. Following placement of panel 170 backfill 52 and exposed backfill can be installed. The tie rod assembly 84 and anchor block 54 are also as previously shown.

In FIG. 18 an intermediate inclined face panel 170 for the inclined face horizontal wall 24 is shown. The bottom stem 184 of the panel extends below the bottom of the panel face to increase the overturning resistance of the panel when the anchor bolt 160 (inserted into void 162) is holding the panel prior to the restraining effect of the tie rod assembly 84 and the anchor block 54. The anchor anchor bolt 160 at the bottom portion of the panel extension 184, the resisting moment is increased.

Figure 19:
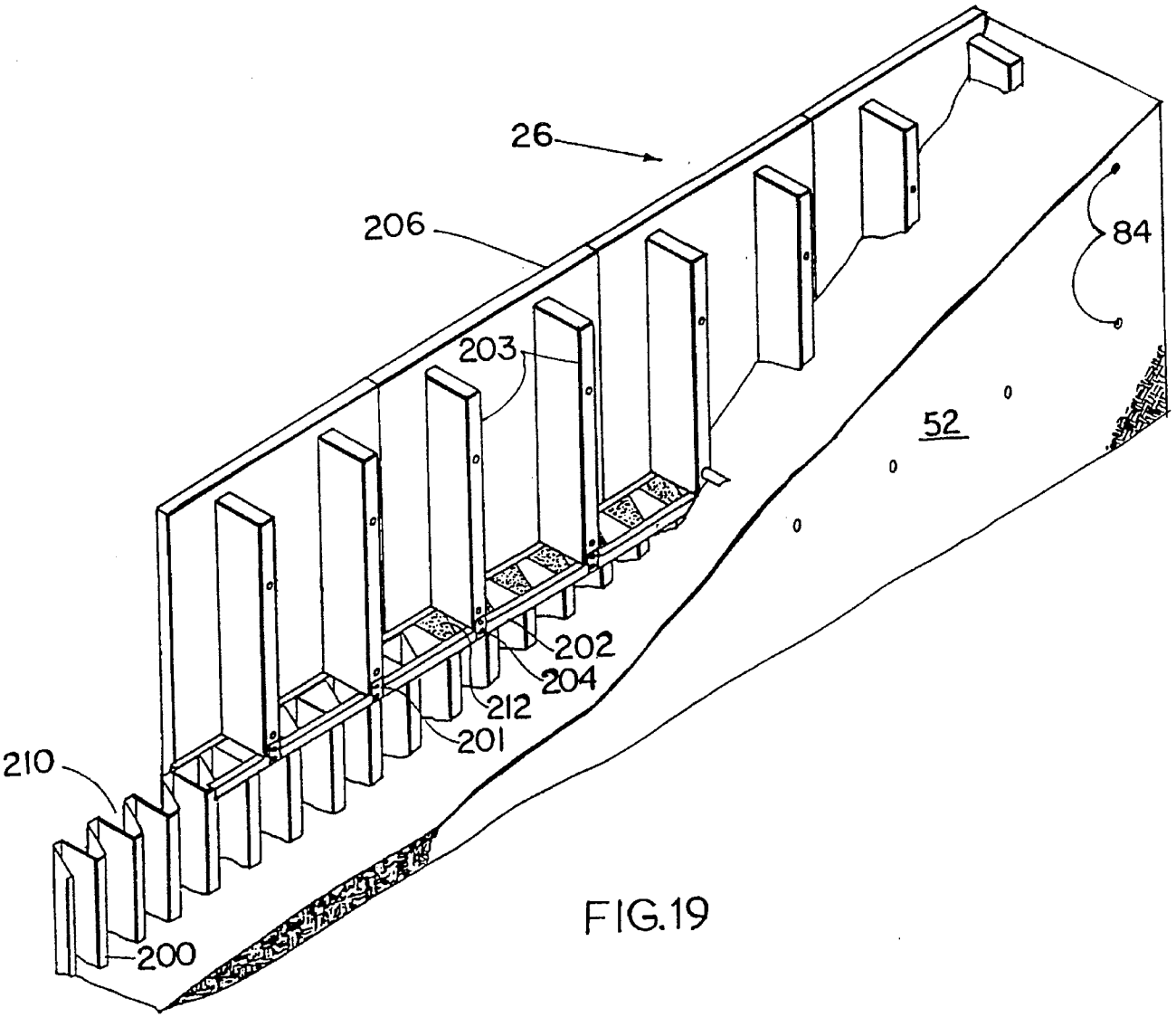
FIG. 19 is a rear isometric view of a sheet pile/anchor wall combination under construction.
Figure 20:
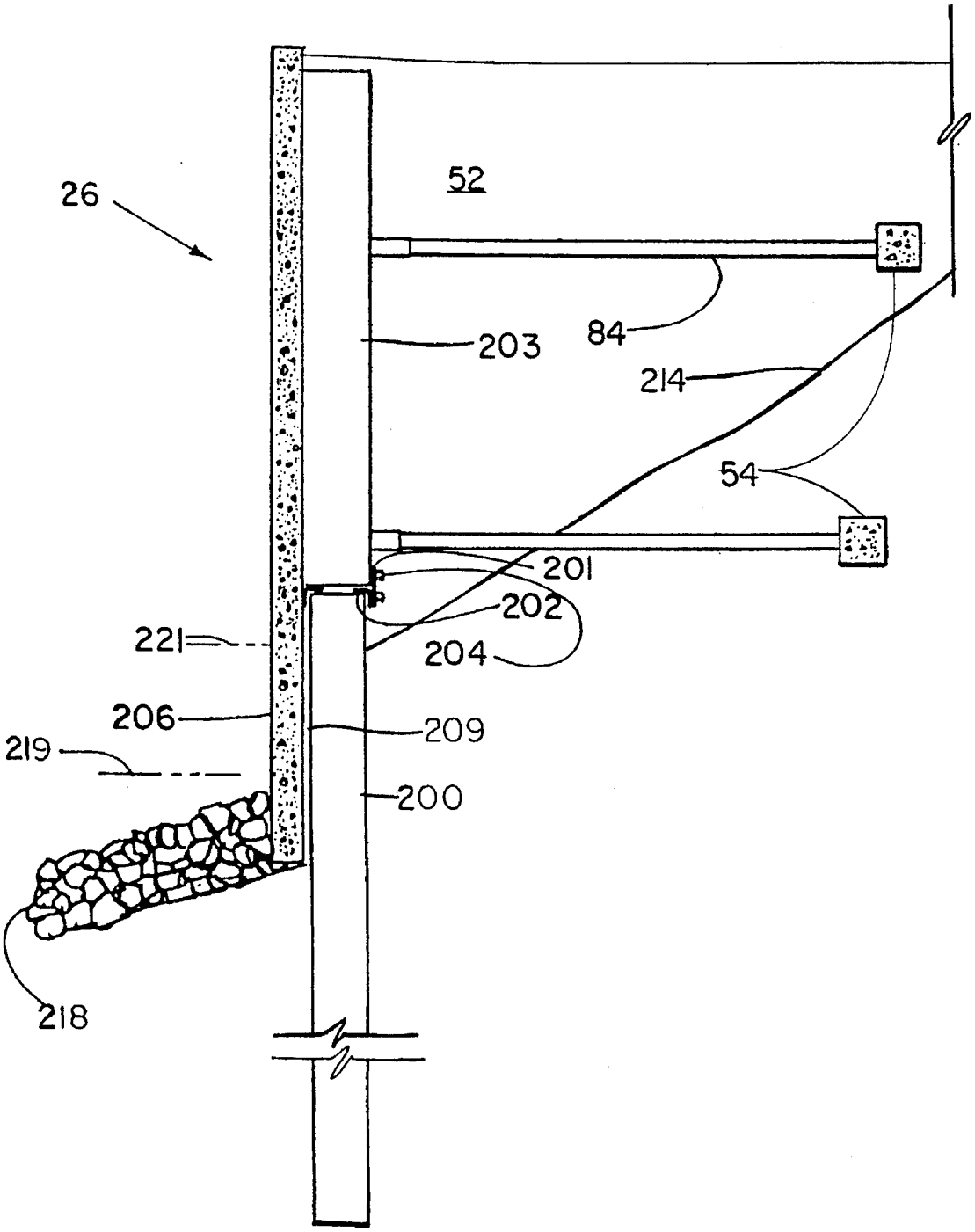
FIG. 20 is a vertical section taken through FIG. 19.

Referring now to FIG. 19 and 20 an erosion control structure 26 is shown as partially backfilled. The left side of the schematic shown in FIG. 19 shows a sheet pile cut off wall 200 installed. Bottom face extension panels 206 are shown secured to the top of the sheet pile wall 200. The panel stems 203 rest on mounting angle brackets 202 installed on the sheet pile wall 200. A securing clip bolt assembly 204 is shown on the rear angle clip 201 that is attached to both the stem 203 and the angle 201. This is one method of holding the panel 206 in placed without the use of erection braces to hold the panel 206. The bottom face panel extension 206 covers the exposed (waterside) face of the sheet pile wall 200. The splash zone or the water surface elevation deviation zone from mean low water to high water level is the portion of the sheet pile wall that is prone to the deleterious effects of corrosion. The advantage and a key design feature of the embodiment of the present invention portrayed in FIG. 19 is the use of the bottom face extension 206 to cover and protect the splash zone corrosion area of the sheet pile wall 200.

To completely cover or encase the exposed sheet pile wall 200, the addition of concrete slurry 212 is necessary and is shown installed in the sheet pile voids 211 and in the space 209 (shown on FIG. 20) between the back of the face extension 206 and the front of the sheet pile wall 200. Filling the void with concrete slurry 212 covers what would otherwise be the exposed sheet pile face 200 and therefore will not only minimize corrosion, but also transfer the tensile restraining effect of the lower anchor assembly 84 to the front face of the sheet pile wall 200 in a continuous manner. Thus, it will be understood that the sheet pile wall 200 shown is utilized as a cut off wall which is a wall type that is used to prevent material from migrating out under the wall structure due to heavy wave action or currents.

The earth pressure forces increase as additional backfill 52 is placed behind the panels 206 and sheet pile section 200. Since the tie rod assemblies 84 are placed within the backfill 52 the tie rod assemblies 84 resist and holds the panels 206 and the portion of the sheet pile wall 200 that is covered with concrete slurry 212. A key design feature of this embodiment of the present invention is the load sharing of the horizontal earth pressures and transfer of those loads from the sheet pile wall 200 to the panel extension 206. This eliminates the use of additional soil anchors that would typically be required to maintain the vertical position of the sheet pile wall 200 if sheet piles were acting alone. The depth that the sheet pile is driven into the soil is also reduced due to the load transfer into the tie rod assembly 84. Following completion of wall backfill toe protection rip rap 218 is typically placed up to a minimum elevation corresponding to the low water elevation 219. The splash zone is the difference in the high water elevation 221 and elevation 219. A key design feature of this embodiment of the present invention is the protection and cover of the corrosion prone sheet pile 200 with the lower panel extension 206.

FIG. 20 is a vertical cross-section taken through the face of the wall panel 206 and sheet pile wall 200 depicted in the rear isometric drawing FIG. 19. It shows the panels 206 placed and secured over the sheet pile cut off wall 200. The sheet piles 200 are shown driven into an existing slope 214. The bottom of sheet piles 200 are driven into the insitu material 214 to a depth sufficient to support the earth loads required for a cut off wall. The mounting top angle system 202 is shown and is required so that the panel stems 203 will be supported. The mounting angle 202 rather than a pile cap is chosen so that following the attachment of the mounting clip 201 and bolts 204 open access is available to fill the waterside sheet pile voids 210 with concrete slurry 212. The concrete slurry filler material 209 flows into the void 210 and covers the waterside sheet pile surfaces from the top of the sheet pile 200 to the bottom of the panel stems 203. Wall tie rod anchor assemblies 84 are installed and backfill 52 placed with similar methods as described for previous stated embodiments of the present invention. The minimal driven depth of the sheet pile wall 200 is possible due to the restraining effect of the tie rod anchor assemblies 84 being transmitted to the face extension 206 and to the filler concrete slurry 212 to the exposed face of the sheet pile 200.

Figure 21:
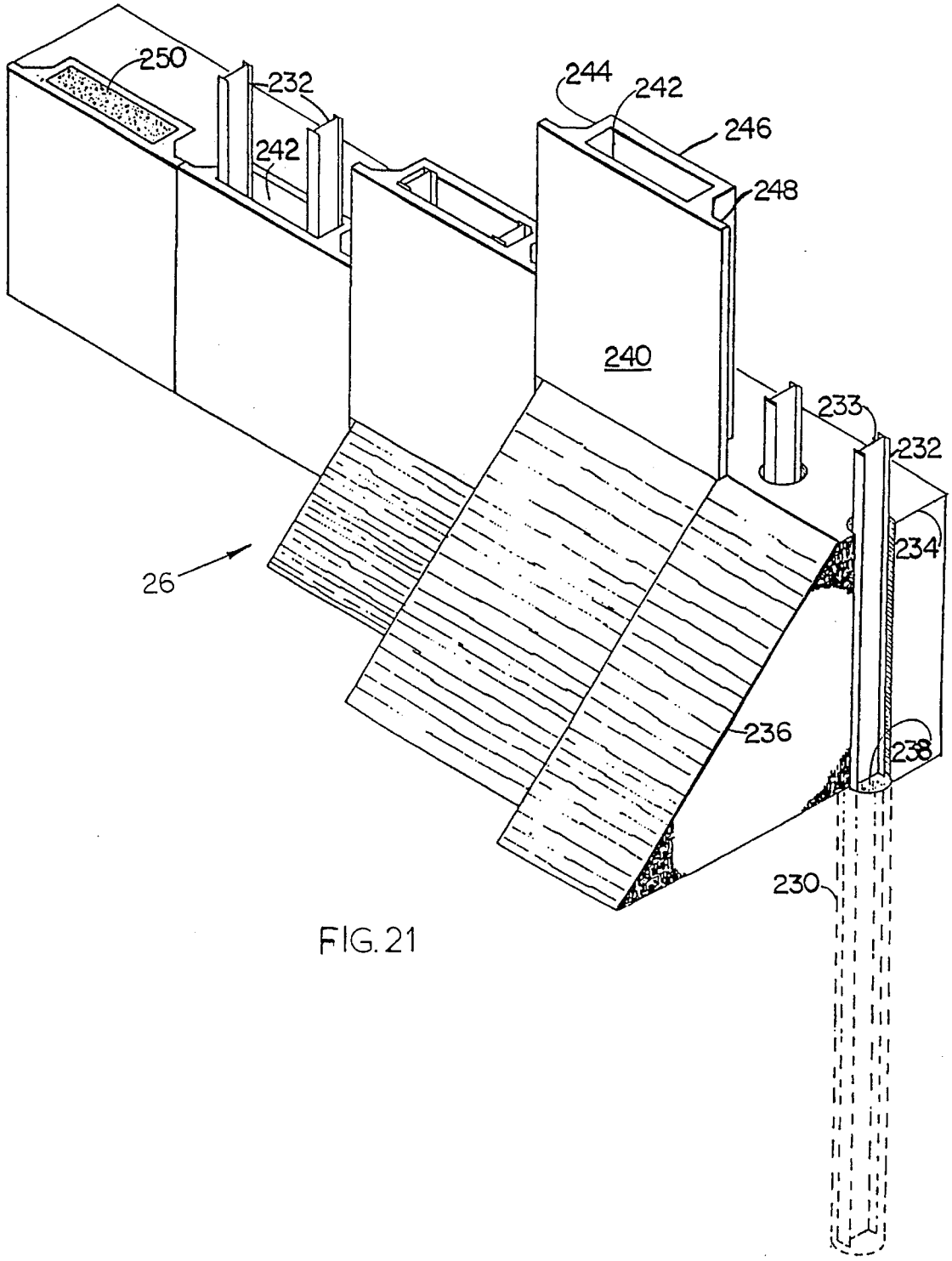
FIG. 21 is a front isometric view of top down box beam panel wall installation sequence.
Figure 22:
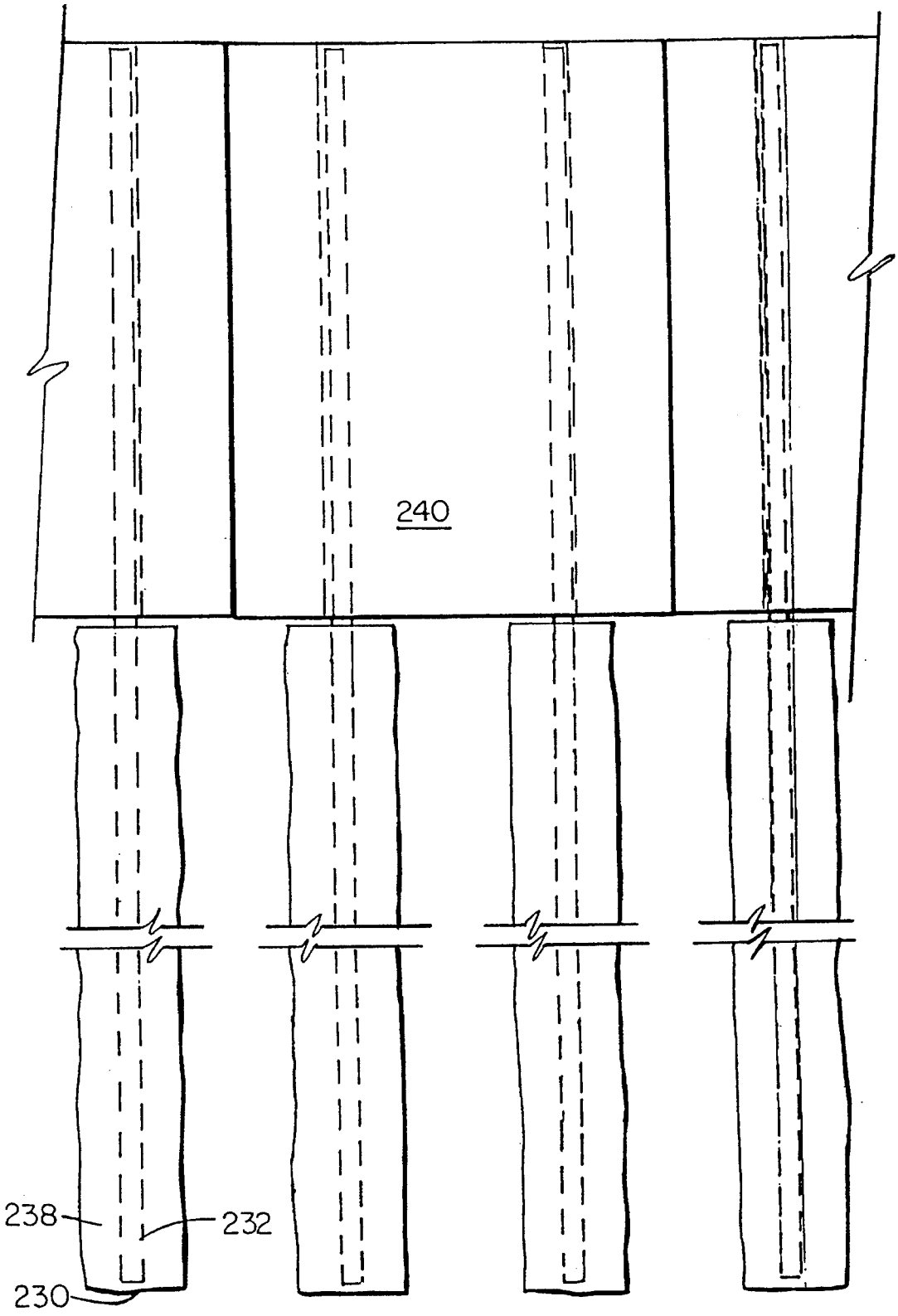
FIG. 22 is a partial front elevation view of a completed box beam panel wall.

Referring now to FIGS. 21 and 22, a cut wall installation using a box beam panel 240 to form a box beam wall structure is shown. The I beams 232 are shown placed in a drilled shaft void 230 and concrete fill 238 placed up to the bottom of wall elevation. The I beam 232 and drilled shaft 230 and concrete 238 combination form an assembly that will maintain a vertical position when subjected to earth loads. The earth loads are transferred to the beams 232 as the box beam panel 240 is lowered over the beams 232 as the soil 236 is excavated from under the panel 240. Panel 240 is shown on the fight side of FIG. 21 setting on the top of the existing embankment 234. The panel to the left of the first panel is shown at a lower elevation than the panel 240 on the fight because a portion of the cut slope 236 has been removed. The beams 232 are shown extended above the fill on the fight side of the drawing to act as a guide for the box beam panel 240 to maintain the vertical position of the panel 240 until it is lowered into position.

Conventional methods of top down construction such as the soldier beam/panel method would require an H beam with a wide flange in order to support the horizontal panels that are slid down between the beams. The H beams require a thick section compared to the I beam 232 shown to compensate for the additional flange width. The box beam panel 240 due to its large size and because it is placed over the beams 232, facilitates efficient installation. Installation without binding is an advantage of the box beam panel compared to the soldier beam panel wall. The panels of lagging tend to bind when forced down and between H beams. Since the box beam flange 244 may vary in width, the void 242 width can change depending on the size of the I beam web 233. Highly loaded walls or taller sections have high loading and require a deep web 233. The box panel 240 section can be changed to accept the appropriate I beam section.

The fourth panel from the right side is shown in FIG. 21 at the proper elevation with the I beam 232 tops protruding above the top of the wall. These extensions are removed and the box beam void 242 is filled with concrete 250 (see the fifth panel from the right side). The concrete filler 250 covers the exposed I beams 232 and not only provides corrosion protection for the I beam 232, but also adds to the strength of the box beam 240 section.

FIG. 22 shows a partial elevation view of a box beam panel 240 wall assembly. The drilled shaft 230 beam 232 combination with filler concrete 238 is shown below the wall placed in the insitu material. The drill depth and I beam length vary depending on the soil characteristics and wall loading.

Figure 23:
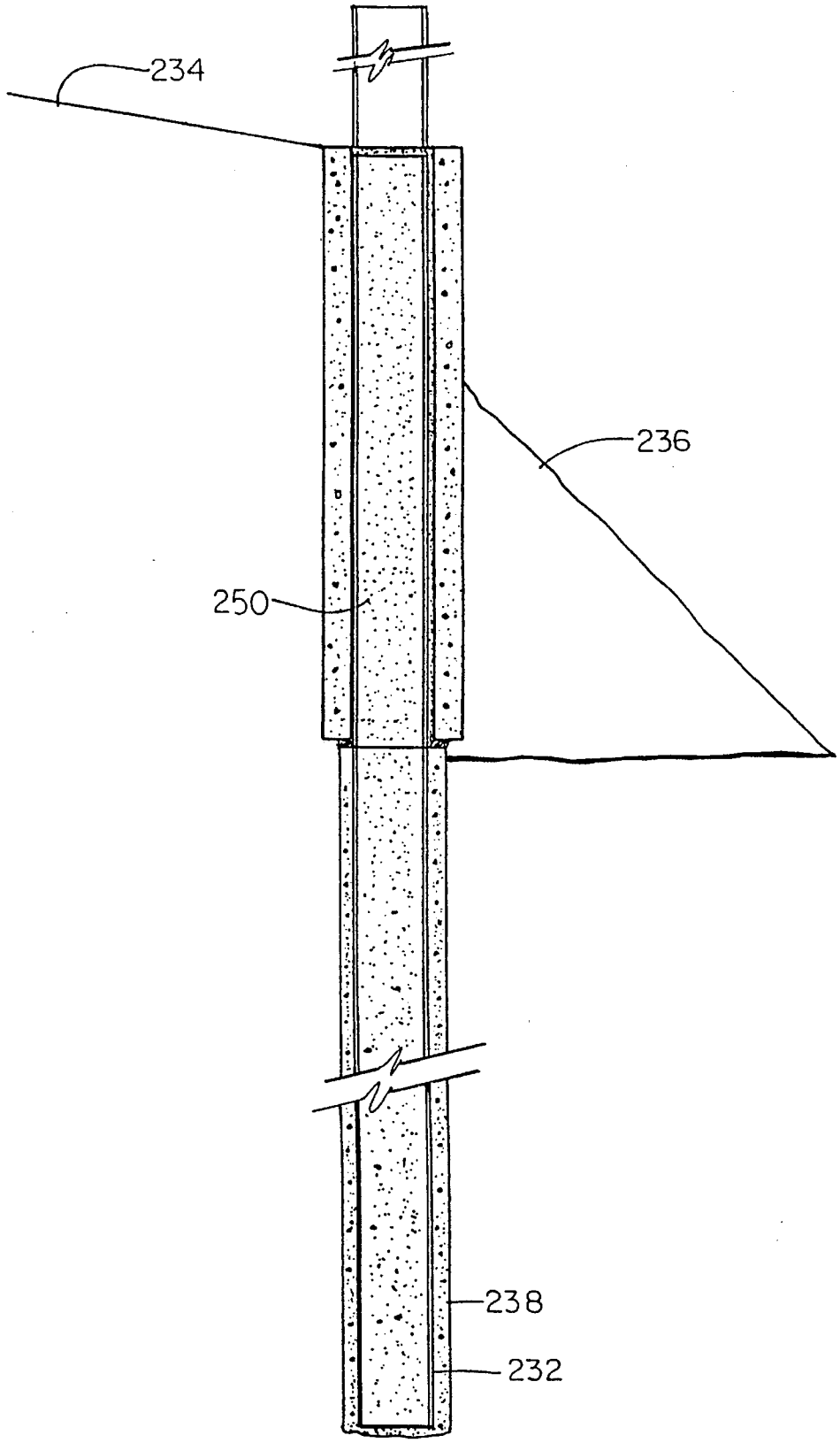
FIG. 23 is a section showing a box beam top down installation taken through the box panel in FIG. 21.

FIG. 23 is a section of a box beam top down installation. The vertical section shown is cut through the box panel in FIG. 21. Box beam void filler concrete 250 is shown coveting the I beam 232. Cut slope 236 is shown in front of the wall and existing slope 234 is at the top of the wall.

Figure 24:
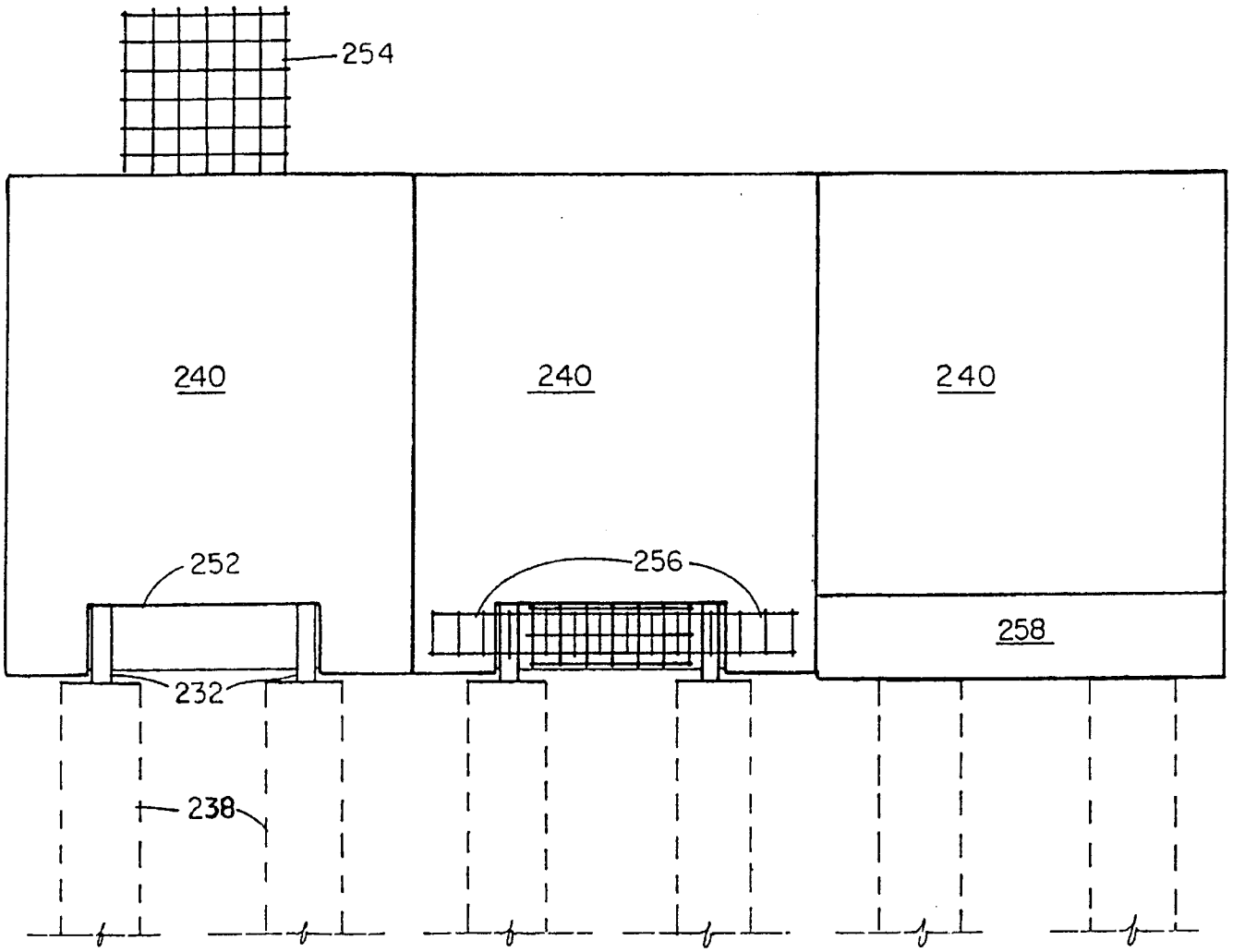
FIG. 24 is a partial front elevation view of a cut out box beam panel wall installation.
Figure 25:
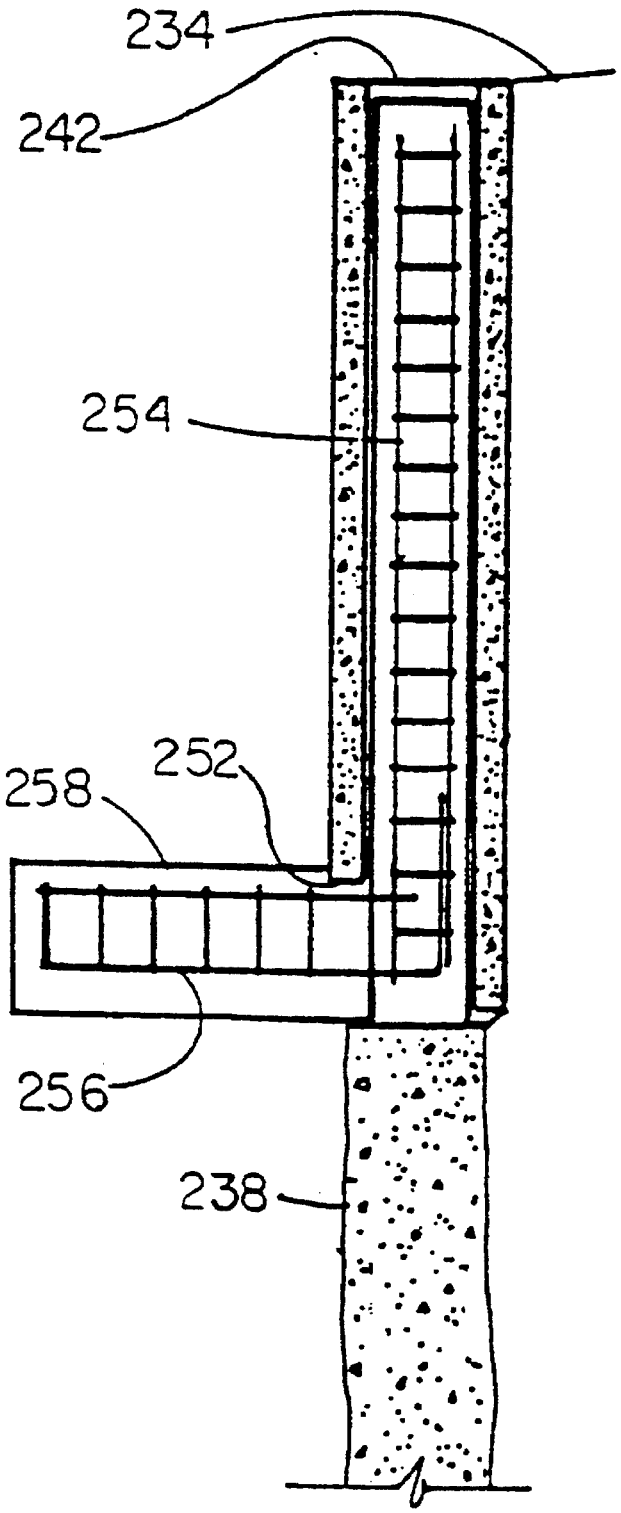
FIG. 25 is a section of a cut out box beam panel installation taken through FIG. 24.

Referring now to FIGS. 24 and 25, another wall constructed using a box beam block out panel 252 is shown. The block out 252 at the bottom of the panel 240 is located at the front face of panel 240. The height of the block out 252 and the width corresponds to the width of the box void 242. This option can be used for extreme load conditions or when the I beam 232 placement depth (elevation below the wall) is reduced. The block out 252 allows access from the front of the panel to facilitate the installation and positioning of the vertical reinforcement cage 254. Following placement of the cage 254, the cast-in-place foundation reinforcement 256 shown on the center panel in FIG. 24 can be installed in front of the panel and the rebars connected to the bars in the cage 254.

FIG. 25 is a section view cut vertically through the fight panel 240 assembly shown in FIG. 25. The vertical section shown is additionally cut through the cast-in-place panel foundation shown in FIG. 24. The box beam panel 240 in this configuration not only acts as an earth retention wall, but also serves as a form for the concrete 250 steel assembly 254 in the void 242 (FIG. 21). The section in FIG. 25 shows the steel cage 256 and vertical cage 254 installed and bars linked due to access possible by the blockout 252. The cast-in-place foundation 258 is shown monolithic with the panel cast-in-place concrete 250. The new combination of I beam 232 and concrete 238 are typically designed to hold the structure against sliding and with a safety factor of the least 1.0 against overturning. This allows the wall to be built from the top down and be stable until the additional foundation 256 can be poured. The block out 252 feature coupled with the box beam panel 240 allows the design to utilize the shortest I beam length and narrowest web in an economic balance with the use of a additional cast-in-place foundation 258. This is another unique feature and key design aspect of this box beam panel 240 invention: casting the foundation for the wall after it was placed. The size of the foundation 258 and steel reinforcement are determined by calculating the overturning service loads in the wall and distributing those loads over the insitu material in front of the wall.

Figure 26A:
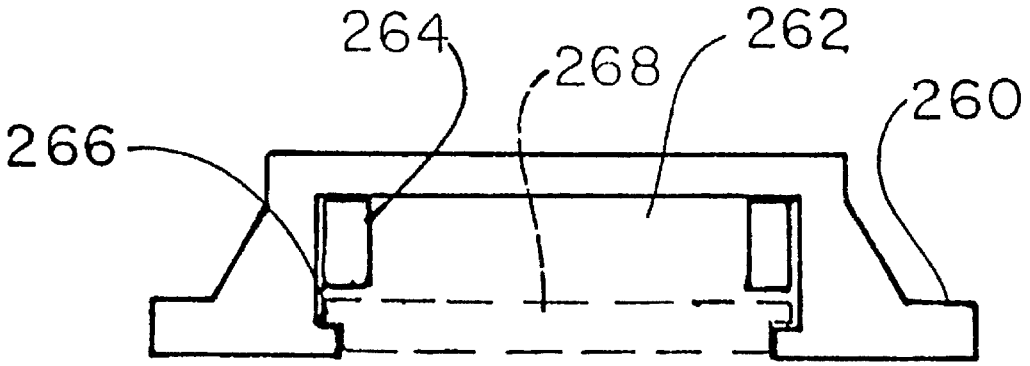
FIGS. 26A and 26B are a top and front view respectively of a U beam panel with a concrete beam for vertical support.
Figure 26B:
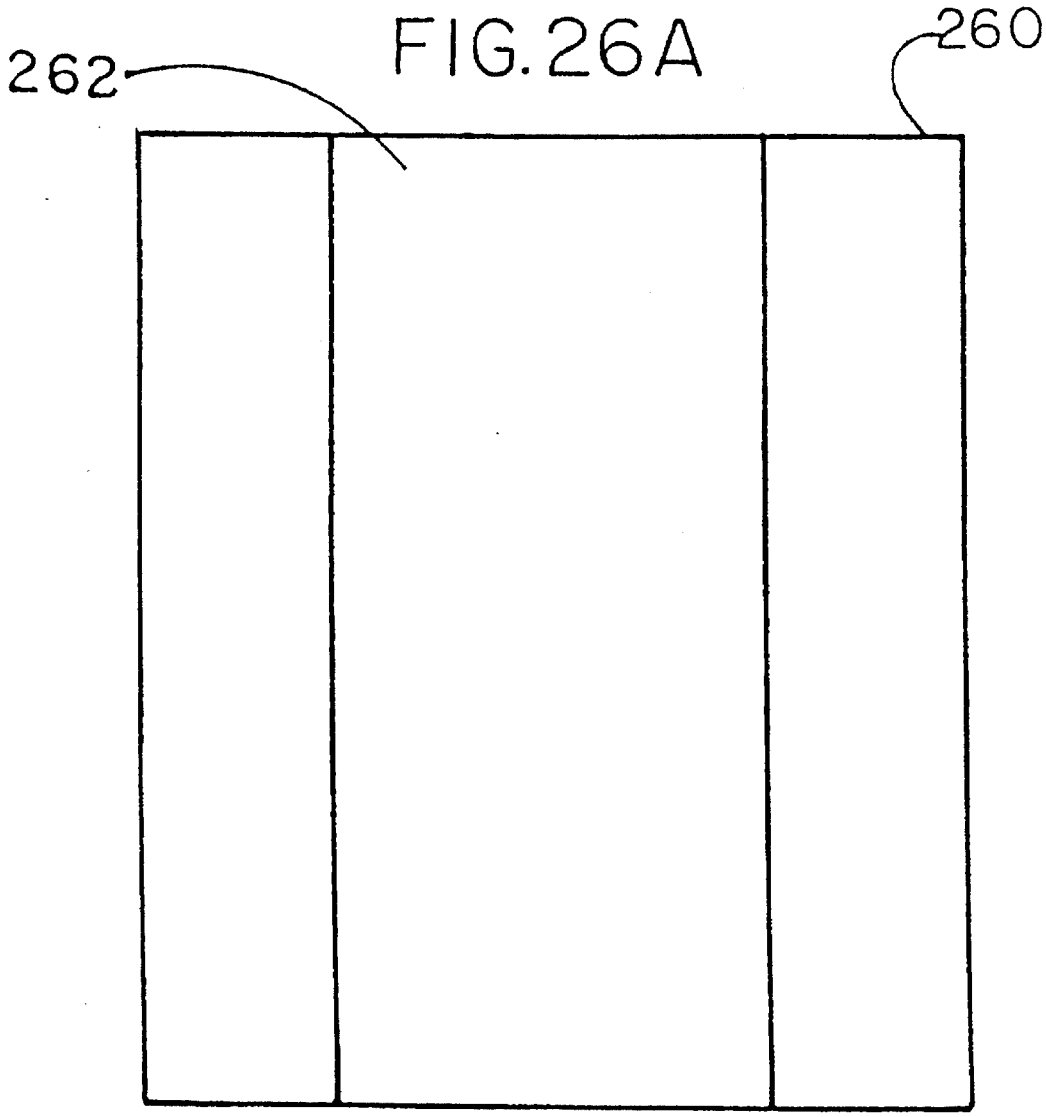

FIGS. 26A and 26B show a front and top view of U beam panel 260. This panel section can be used if required by the specific design to perform the same function as the box beam section panel 240. The U beam panel 260 is more economical to manufacture and in some instances may be easier to install than the box beam panel 240. Slight alignment adjustments are possible with the U beam panel 260 because the vertical insitu support beams 264 can be accessed from the front of the wall. The beams 264 shown in the top view in FIG. 26 are prestressed concrete beams and can be used for the box beam panel 240 as well. The U beam panel 262 is shown with the prestressed beams 260 because the depth of the U is variable and can be modified as required for the design to use the most economical beam either 264 or 232 (shown in previous figures). The bearing flanges 266 shown in the top view in FIG. 26A are provided so that a face panel 260 can be installed following the placement of the panel 260. The U panel 260 can also act as a form for concrete filler 250 within void 262 after the front panel 260 has been installed.

Figure 27:
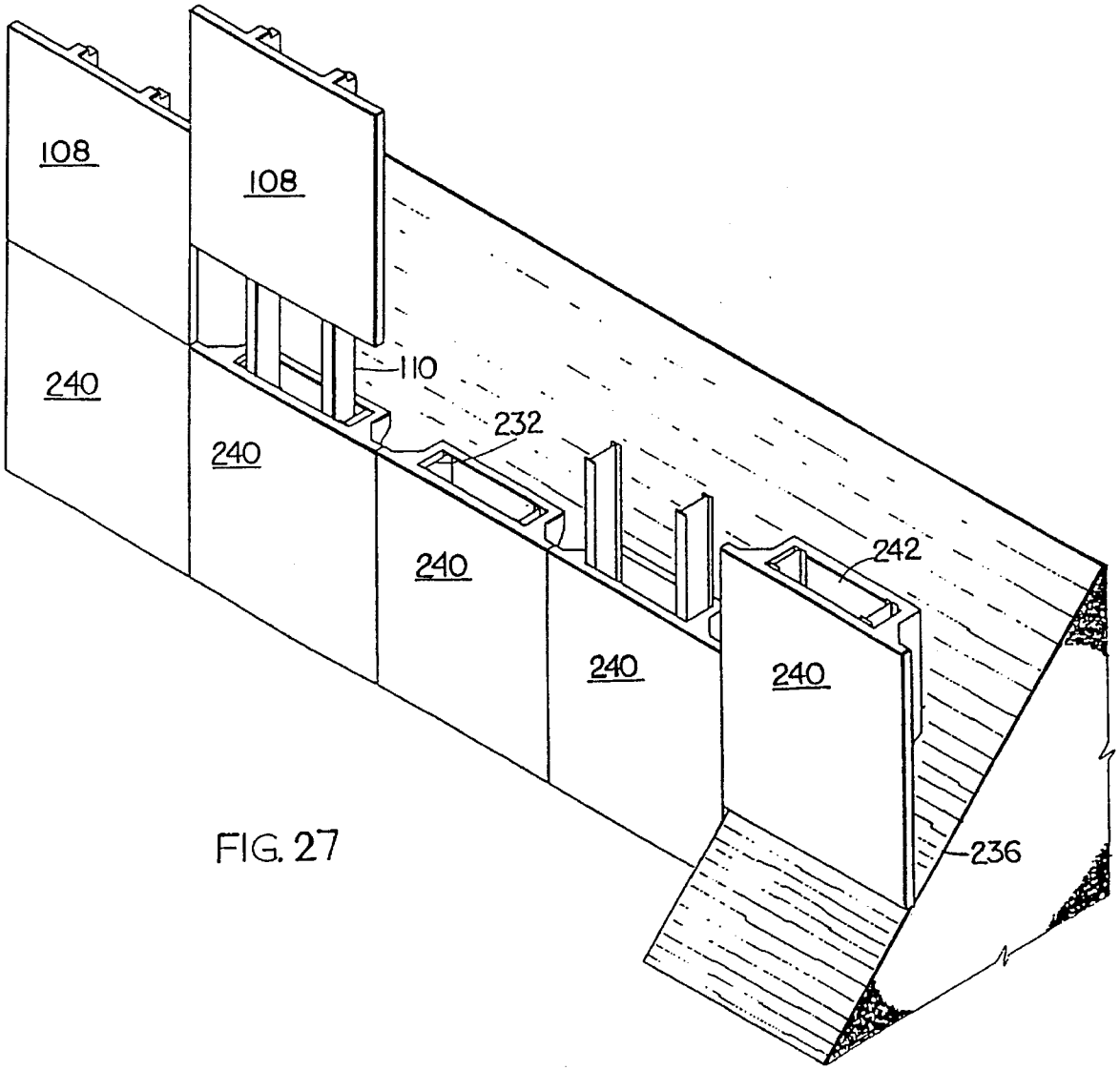
FIG. 27 is a front partial isometric view of a top down box beam panel wall installation showing a cantilever tee stem panel placement.

FIG. 27 is a partial isometric elevation view of a box beam panel 240 installation. The panels are being installed from the fight as was described in FIG. 21. The second panel 240 from the left has been installed to the proper elevation but the filler concrete 250 has not been placed. The extension panel 108 is shown being installed and the tee stem extension 110 being inserted into the void 242. The completed two panel assembly with box panel 240 on the bottom and stem extension panel 108 on top is shown on the left side of FIG. 27. This shows a unique advantage of the box beam design. It provides for an economical wall extension by using the "tee" extension panel 108. This combination of different structural panels with the same front face appearance allows the designer to create an optimum economic wall with a consistent front face appearance. Typically on a cut wall application, the end of the wall "daylights" as the top of the wall and bottom converge to the start or end of the wall. For the isometric view shown in FIG. 27, the box beam panel 240 would be replaced by the T cantilever extension panel 108 as the end of the wall was reached. Although the face of the wall appears to be consistent, the structural capacity and design of each wall panel either 108 or 240 is appropriate for each area of the wall.

Figure 28:
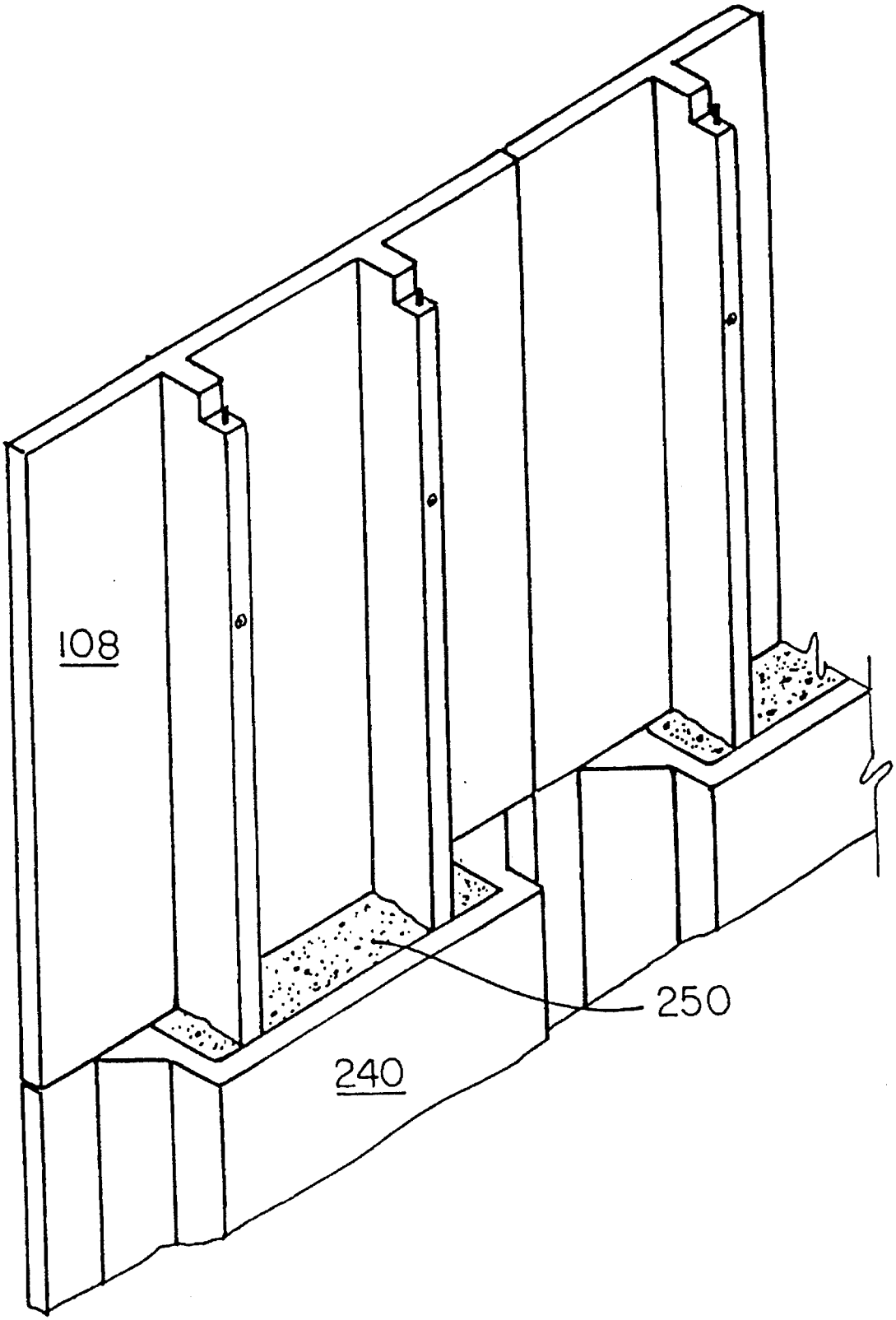
FIG. 28 is a rear partial isometric view of the cantilever tee extension panel installed into the void of a box beam panel.

FIG. 28 is a rear partial isometric view of the cantilever tee extension panel installed into the void of a box beam panel. The concrete filler 250 links the two panel types together structurally.

Figure 29:
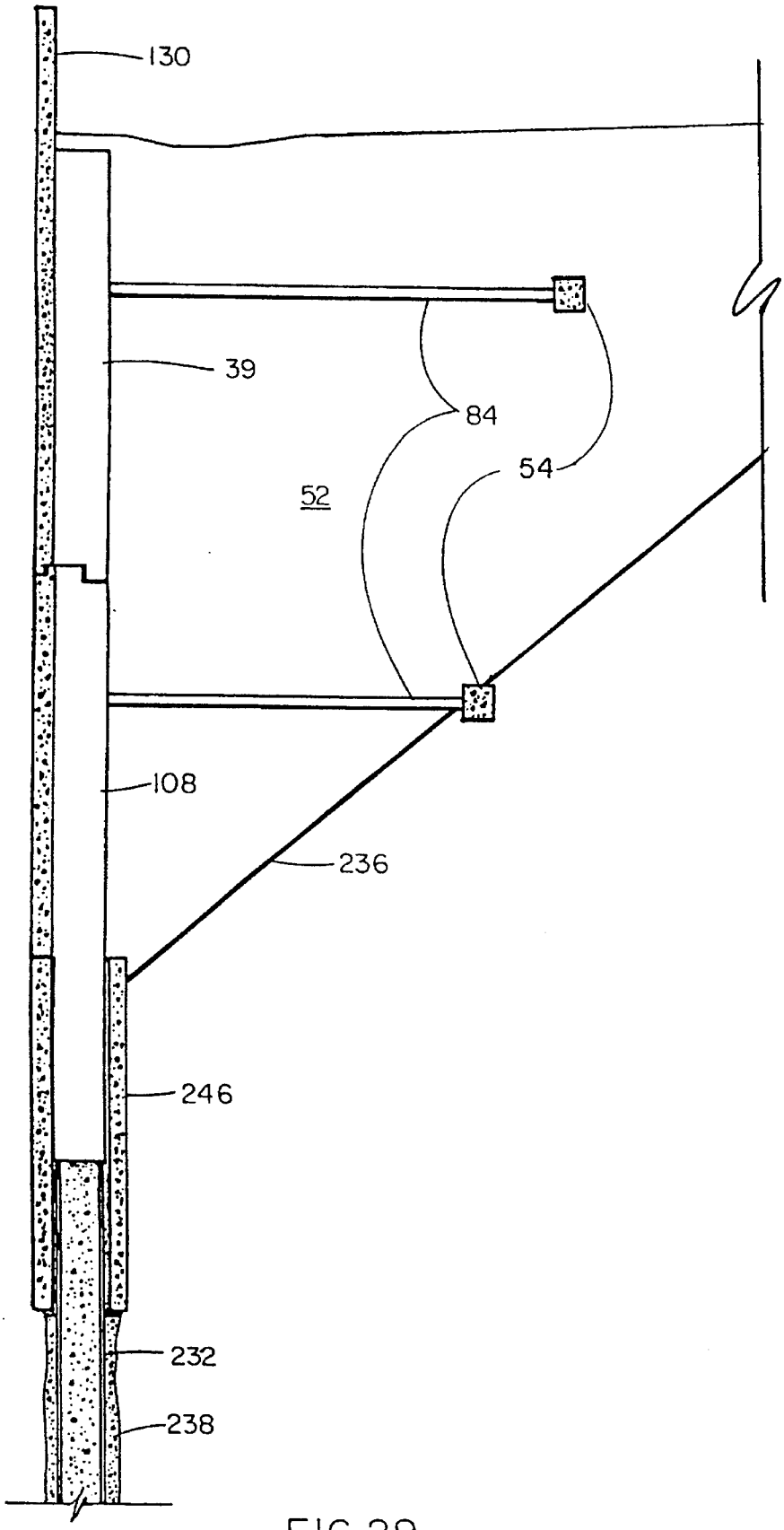
FIG. 29 is a vertical cross-sectional view taken through FIG. 27 of the box beam panel/cantilever panel extension combination.

FIG. 29 is a vertical section taken from the fight side of FIG. 27. An intermediate or top tier panel 39 has been placed over panel 108. FIG. 29 shows a combination wall utilizing various panel types that have been defined in previous figure descriptions. This type of configuration requiting a tight clearance cut application at the bottom of the wall uses the box panel 246 I beam 232 void concrete 238 combination. The stem extension panel 108 is then inserted into box panel 246 and utilizes the structural capacity of the combined panel 246 and I beam 232 to resist wall backfill pressures since it is not feasible for anchor block 54 to resist the horizontal earth forces. A standard intermediate or top tier panel 39 with top extension 130 is then placed on panel 108 and held in place with the tie rod assembly 84 and block 54 combination. Many of the previously mentioned key design features of the present invention are shown in FIG. 29.

Figure 30:
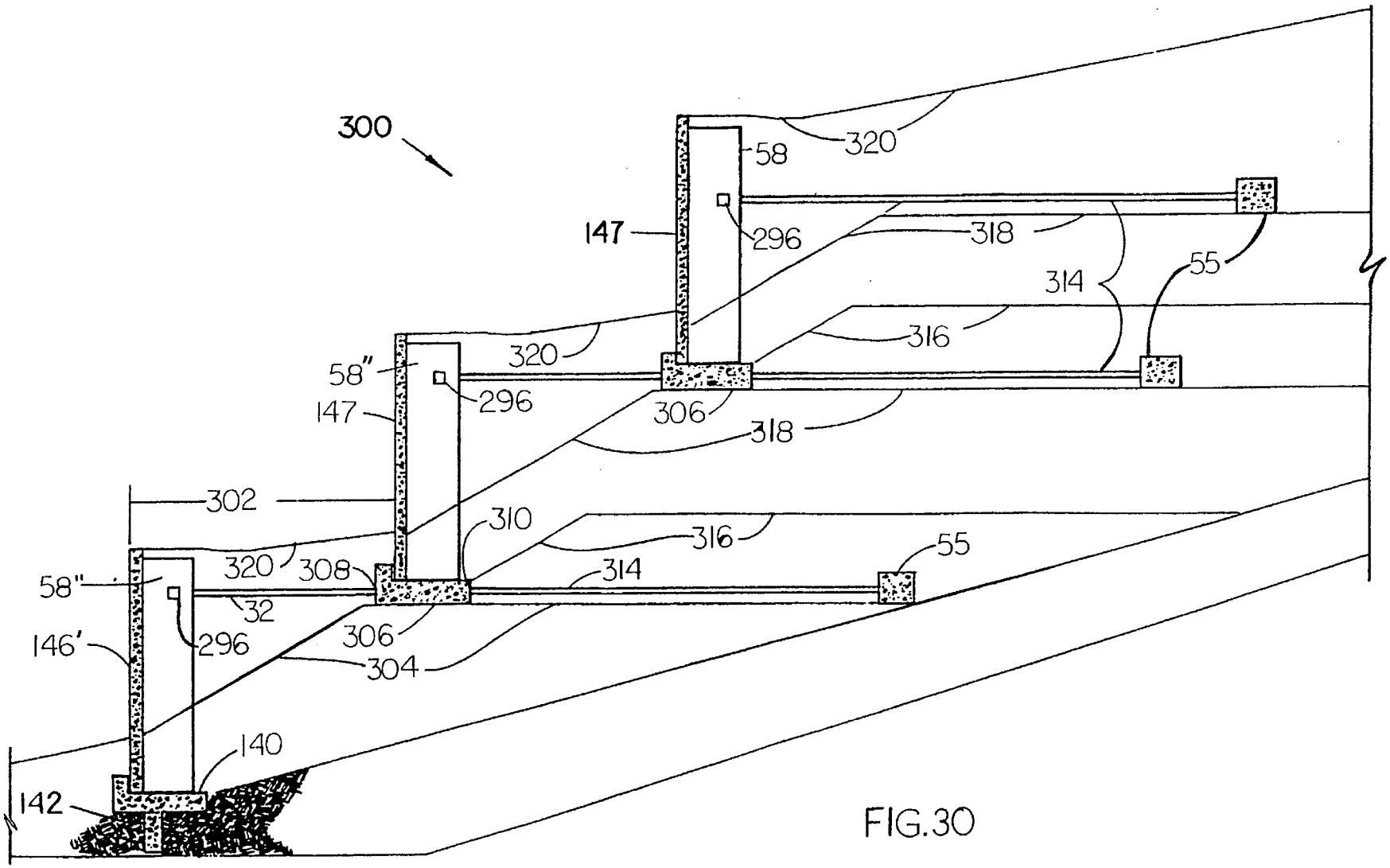
FIG. 30 is a cross-sectional view of an alternate embodiment horizontally setback tier wall.

Another alternate embodiment is shown in FIG. 30. FIG. 30 shows a vertical cross section cut through a horizontal setback tier wall 300 with a vertical wall panel 146'. Due to the setback distance 302, it is not feasible to rely on the lower panel 146' to support upper tier panels as is the case for the previously described horizontal offset wall panel 146 shown in FIG. 15. The setback wall 300 is preferred for some applications where a major portion of the wall is obscured with landscaping or it is more geotechnically conservative to use the horizontal setback design.

The base wall panels 146' are all the same for the wall configuration 300 shown in FIG. 30. Base wall panels 146' are also placed on a cast-in-place foundation beam 140. Each base wall panel 146' is placed on and attached to the cast-in-place foundation beam 140 in a similar manner that has been previously described.

Following placement of the base wall panel 146', Phase I backfill 304 can proceed and the backfill 304 placed to the profile shown on the existing slope 303 up to the base elevation of the first anchor block 55. This elevation of backfill 304 also closely corresponds to the elevation of an intermediate tier foundation beam 306. The second tier and all upper tier foundation beams are the same cross-section and following the Phase I backfill 304 foundation beam 306 can be cast. As part of the form process for foundation beam 306, a front tie rod coupler 308 and a back tie rod coupler 310 are attached to the inside of the form at the proper location. The front tie rod couplers 308 are set at center to center distances corresponding to the distance between the tee stems 58" on the panel 146'. The back tie rod couplers 310 are spaced along the intermediate tier foundation beam 306 corresponding to the optimum spacing as determined by the earth loads on the wall. Since numerous front tie rod assemblies 312 are needed to secure the panels 146' to the foundation beam 306, these front tie rod assemblies 312 will have low tensile forces (loads) compared to loads on the fewer number of back tie rod assemblies 314 set between the foundation beam 306 and anchor block 55. The front tie rod assemblies 312 can then be installed into the front tie rod couplers 308 cast into the foundation beam 306. The front tie rod assemblies 312 are connected to the panel tee stem 58" at void 296 shown in FIG. 8A. Following the placing and attachment of back tie rod assemblies 314 using back tie rod couplers 310, a second phase backfill 316 can be placed behind the second tier foundation beam 306. Following adequate fill placement 316 over the back tie rod assemblies 314, the intermediate tier panel 147 can then be set on the foundation beam 306 as previously described. The cast-in-place foundation beam 306 does not have the shear key 142 required for the base foundation beam 140. This is because the intermediate or upper tier foundation beams 306 are secured from horizontal movement due to earth pressures because of the pullout resistance of the anchor block 55. The foundation beams 306 also transfers the tensile strength of both tie rod assemblies 312 and 314 to the panel 146'. This is a unique feature of this embodiment of the invention: the anchor block 55 and tie rod assemblies 312, 314 act to restrain the top of the base wall panel 146' and the bottom of the panel 147 from horizontal movement simultaneously.

All of the subsequent intermediate tier panels utilize this same multifunction anchor technique for stability. The wall is completed by phasing the backfill as previously described with the exception of adding the backfill 316 at the top of the wall and the top soil 304, 316 between tiers. The backfill order for the intermediate tier panel 147 is backfill 318 placement followed by placement of top soil 320. The subsequent upper tiers are constructed as previously described with backfill done in phases.

Figure 31:
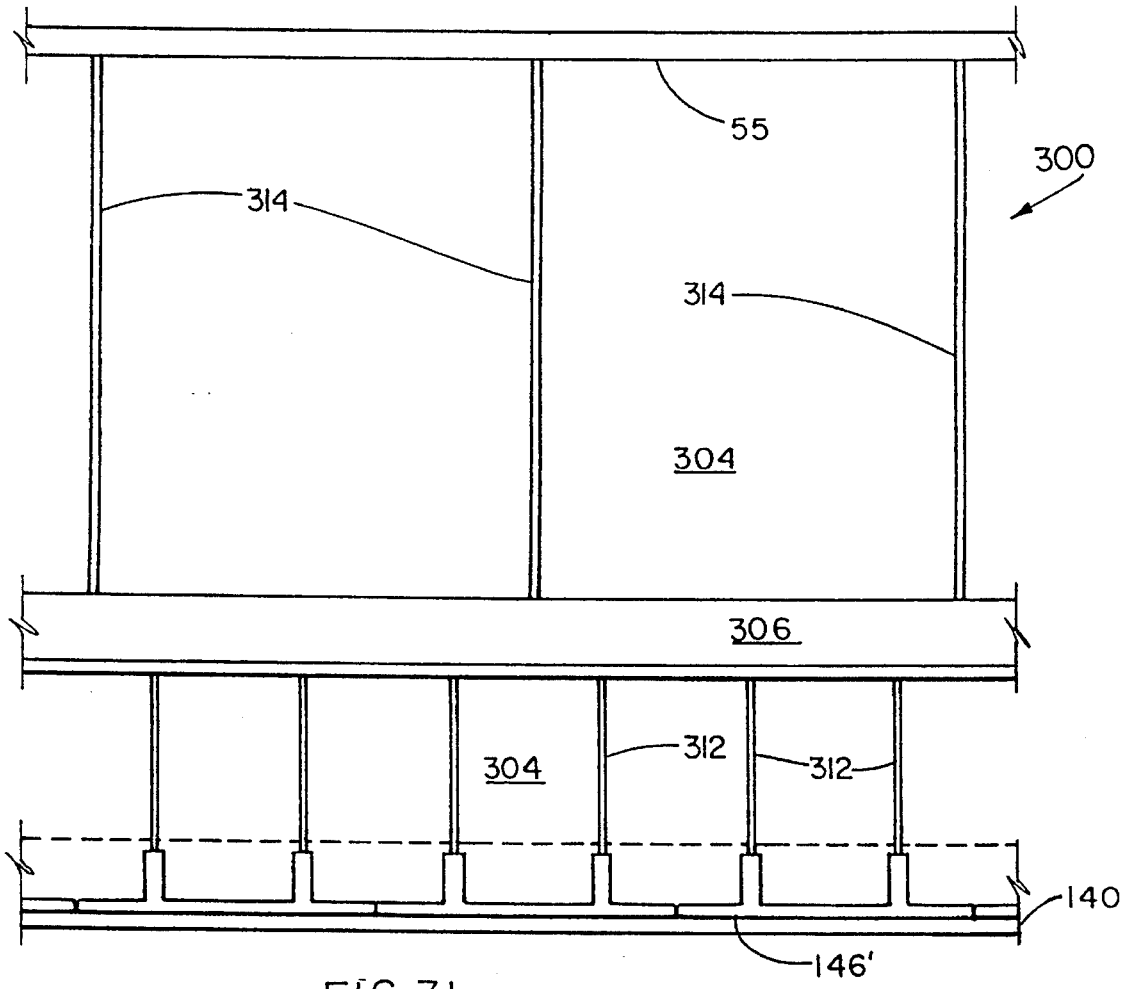
FIG. 31 is a top view of the horizontally setback tier wall shown in FIG. 30 prior to placing the second tier panels.

FIG. 31 is a top view of a horizontal set back wall assembly 300 partially constructed. The base tier panels 146' are shown in place secured to foundation beam 140. Intermediate tier foundation beam 306 and anchor block 55 are shown in place connected by the tie rod assemblies 312 and 314 respectively. Backfill 304 has been placed to the profile shown in FIG. 30. FIG. 31 shows the reduced number of back tie rod assemblies 314 compared to the number of front tie rod assemblies 312.

Figure 32:
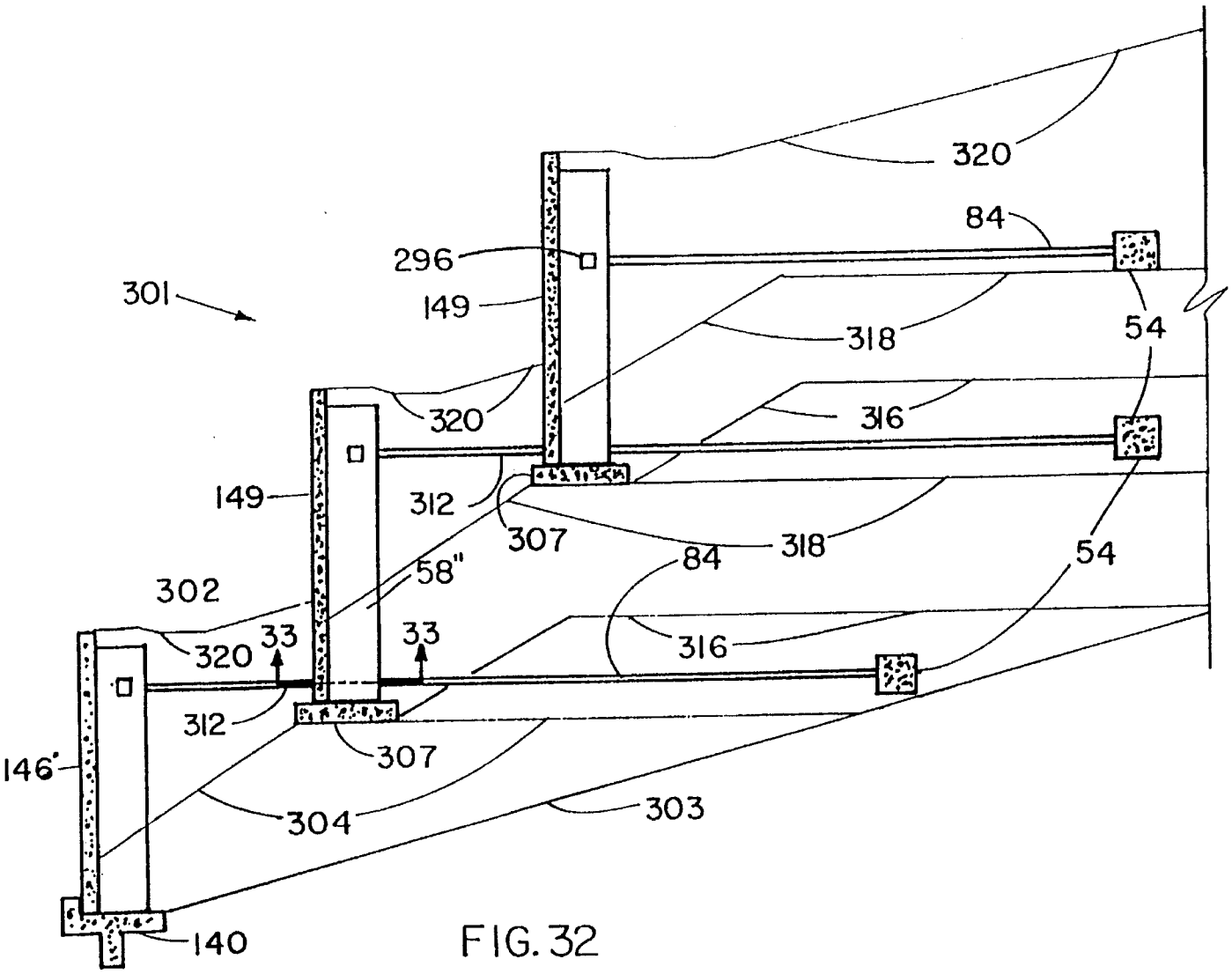
FIG. 32 is a cross-sectional view showing an alternate embodiment of the horizontally setback tier wall shown in FIG. 30.

FIG. 32 is a vertical cross-section cut through a horizontal setback wall assembly 301. The difference between the wall assembly 301 shown in FIG. 32 and the wall assembly 300 shown in FIG. 30 is the method of transferring the tensile loads in the tie rod assemblies 84, 314. Rather than using the foundation beam 306 (FIG. 30) to couple the front 312 and back 84 tie rod assemblies, the intermediate panel 149 is attached to an intermediate foundation beam 307. The panel 149 is utilized as a structural interface between tie rod assemblies 312, 84. The wall assembly 301 is constructed and backfilled in a similar fashion that was previously described for the wall configuration 300 as shown in FIG. 30.

Figure 33:
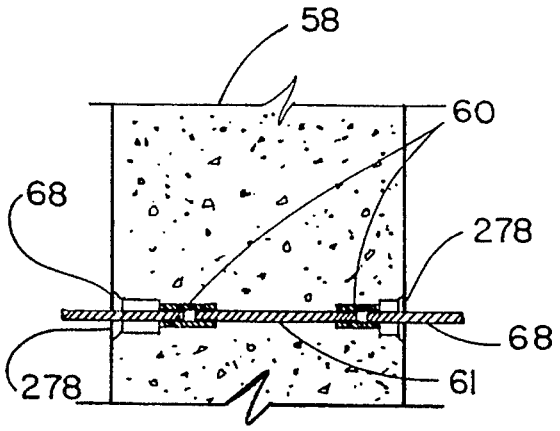
FIG. 33 is a cross-section taken along section line 33—33 of FIG. 32.

The required connections for the panel 149 structural interface are shown in FIG. 33 which is a vertical cross-section cut through the center of the tee stem 58" at the tie rod assembly connection at the base of a typical panel 149. The securing threaded rebar 61 is shown with the tie rod ends 68 shown inserted into couplers 60. The advantage of using the tee stem 58" to transfer tie rod loads is the elimination of precise placement of couplers 60 in cast foundation beams. This may be required in wall applications where field skill is limited.

Figure 34:
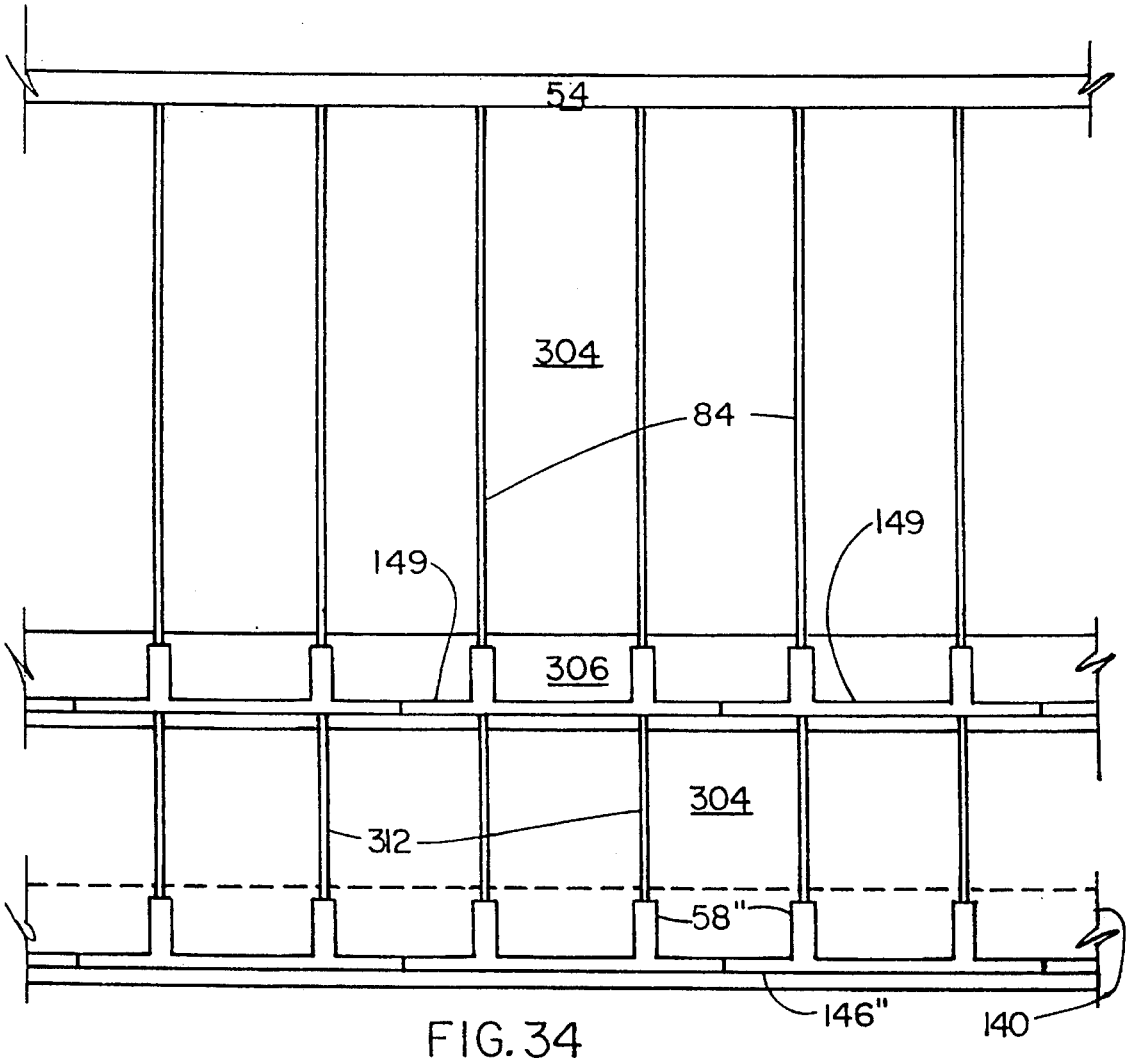
FIG. 34 is a top view of the wall assembly shown in FIG. 32.

FIG. 34 is a top view of a partially constructed wall assembly 301 as described in FIG. 32. The tie rod assemblies 312 and 84 are shown interconnected through the tee stems 58" on the intermediate tier panels 149.

Figure 35:
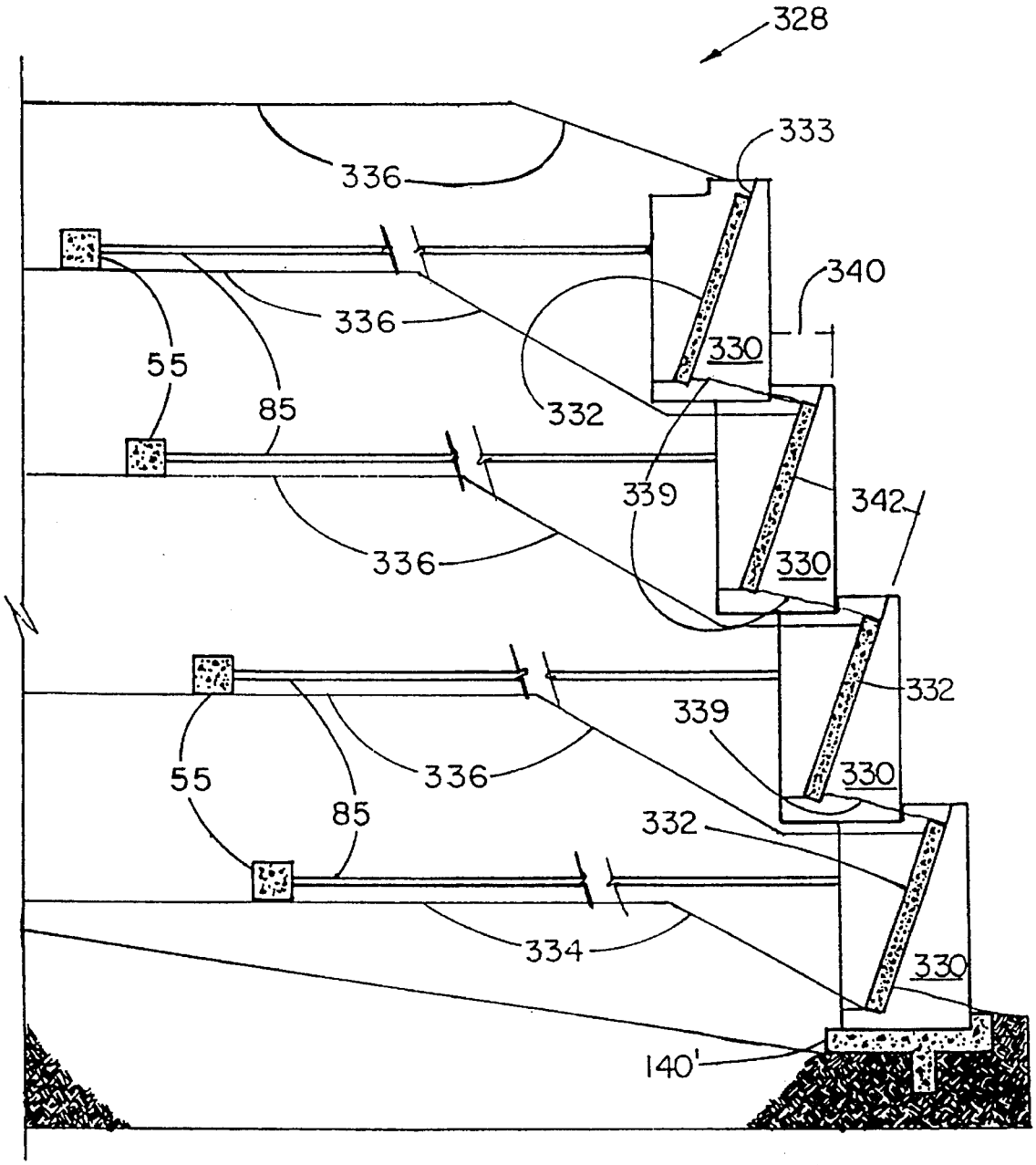
FIG. 35 is a cross-sectional view of an alternate embodiment horizontally setback tier wall assembly having wall panels with inclined bearing flanges for supporting flat inclined panels.

Another alternate embodiment is shown in FIG. 35. FIG. 35 is a vertical cross-section cut through a horizontal setback inclined face wall assembly 328. This structure utilizes vertically connected support tee panels 330 supporting inclined flat panels 332. The use of the support tee panels 330 for isolated support members requires high strength tie rod assemblies 85 because the earth pressure loads are increased on the support tee panels 330 due to the higher overall combined panels area of the support tee panels 330 and inclined flat panels 332. The support tee panels 330 are placed on the non-continuous cast-in-place foundation beam 140' in a manner previously described. The foundation beam 140' is poured in the field in segments corresponding to the location of the support tee panels 330. The support tee panels 330 are erected and connected to the foundation beam 140' in a manner similar to that described for the previous wall configurations. Following placement of the support tee panels 330, the flat panels 332 are placed between the support tee panels 330 on inclined bearing flanges 333 (see also FIG. 37). After the support tee panels 330 have been set, Phase I backfill 334 can be placed to the profile shown up to the anchor block 55 elevation. Following that operation, a high strength tie rod assembly 85 can be installed to the support tee panels 330 and anchor blocks 55. Phase II backfill 336 can then be placed to the profile shown up to the elevation of the subsequent tier anchor block 55 elevation. Following that operation the high strength tie rod assembly 85 can be installed to the support tee panels 330 and anchor blocks 55. Phase II backfill 336 can then be placed to the profile shown up to the elevation of the subsequent anchor blocks 55 elevation. Backfill 336 is also placed in the void space 338 (FIG. 37) between the tee stems 343 of support tee panel 330. The subsequent upper tier support panel 330 can now be installed and secured over the bottom support tee panels 330 as described in previously shown embodiments. Prior to setting the flat panels 332 top soil fill 339 can be placed in the horizontal setback 340 between the bottom and top of support tee panels 330. The top soil fill 339 is also placed in the exposed void space 338 between the tee stems 343.

Subsequent components and backfill phases are completed for upper tiers until the wall assembly 328 is completed. The advantage of this wall is that the overall wall equivalent batter is steep for the provided planting area, which is approximately one half of the overall wall area.

Figure 36:
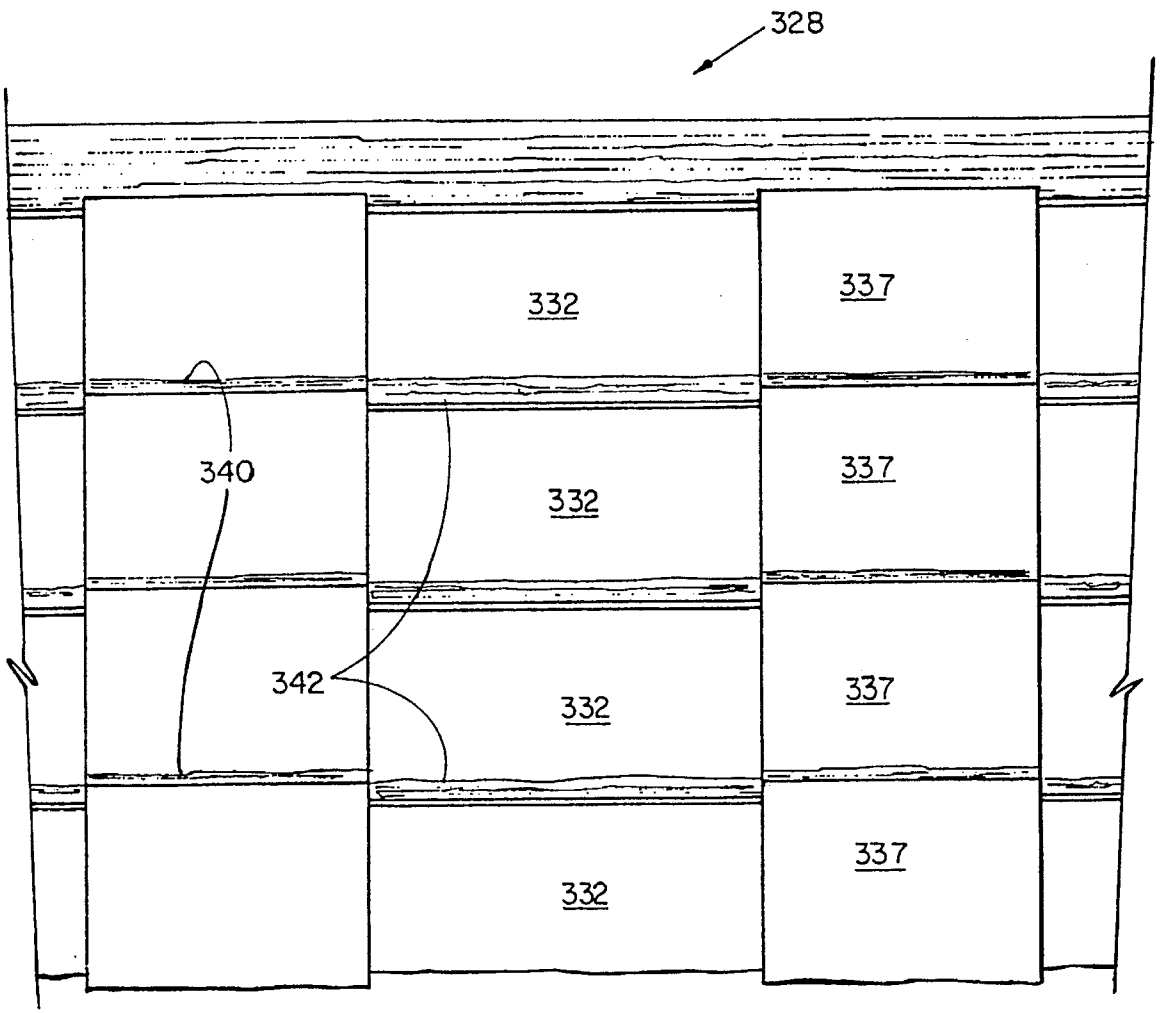
FIG. 36 is a front elevation view of the wall assembly shown in FIG. 35.

FIG. 36 is a partial front elevation view of the inclined panel horizontal offset wall assembly 328 shown in FIG. 35. The vertical exposed faces 337 of the tee support panels 330 are shown. The inclined flat panels 332 are seen in place between the support panels 330. The rectangular planting spaces formed by the exposed void spaces 342,340 are also shown.

Figure 37:
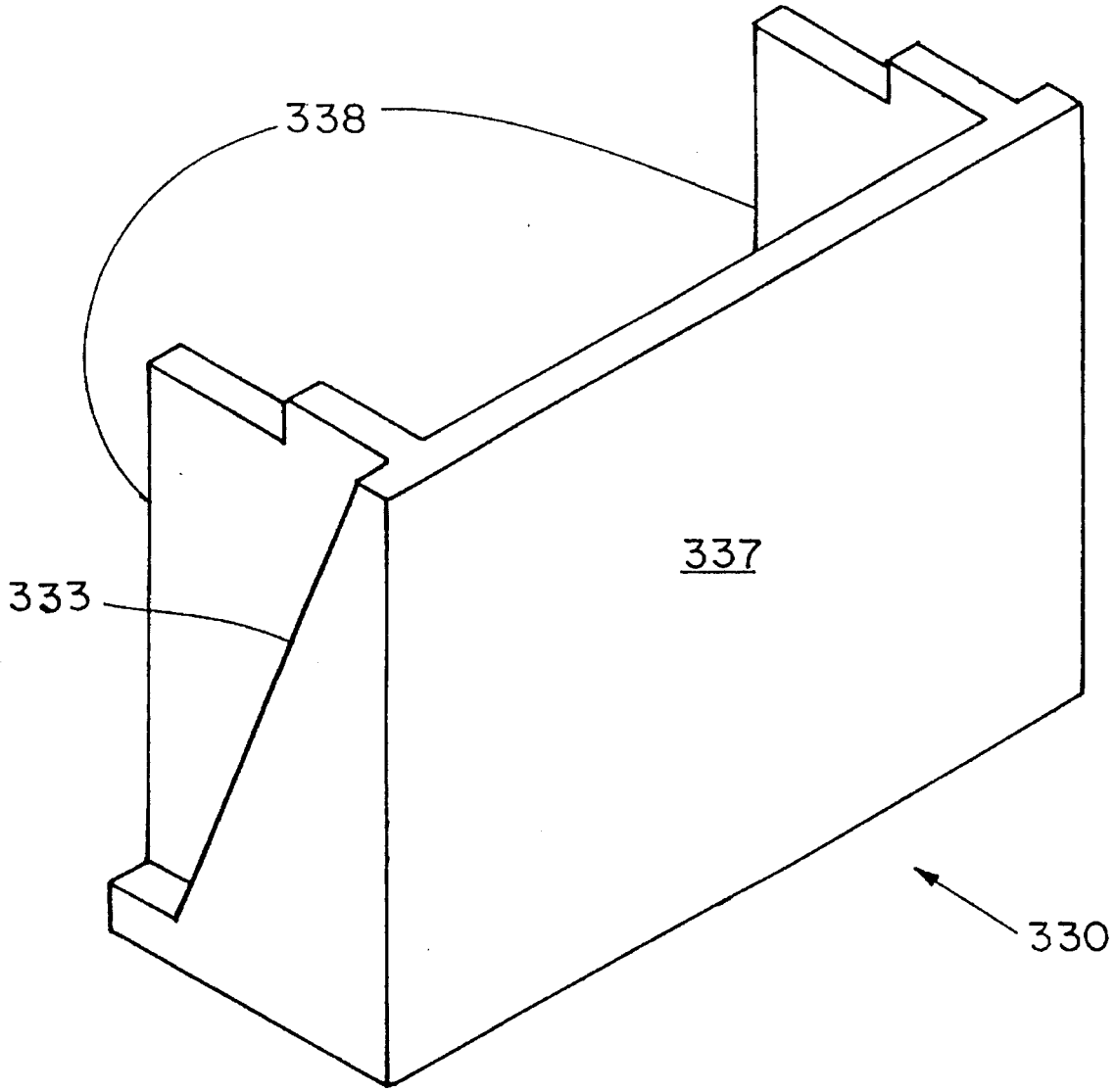
FIG. 37 is an isometric view of a vertical face wall support panel used in the wall assembly of FIG. 35 and showing the inclined bearing flanges.

FIG. 37 is an isometric view of a vertical face tee support panel 336 used for the wall assembly 328 shown in FIG. 35. The tee stems 343 extend behind the support panels 330 and have similar horizontal and vertical bearing flanges for interconnection between panels that has been described for previous embodiments. The tee support panels 330 include inclined bearing flanges 333 on the outside thereof to support the flat wall panels 332.

Figure 38:
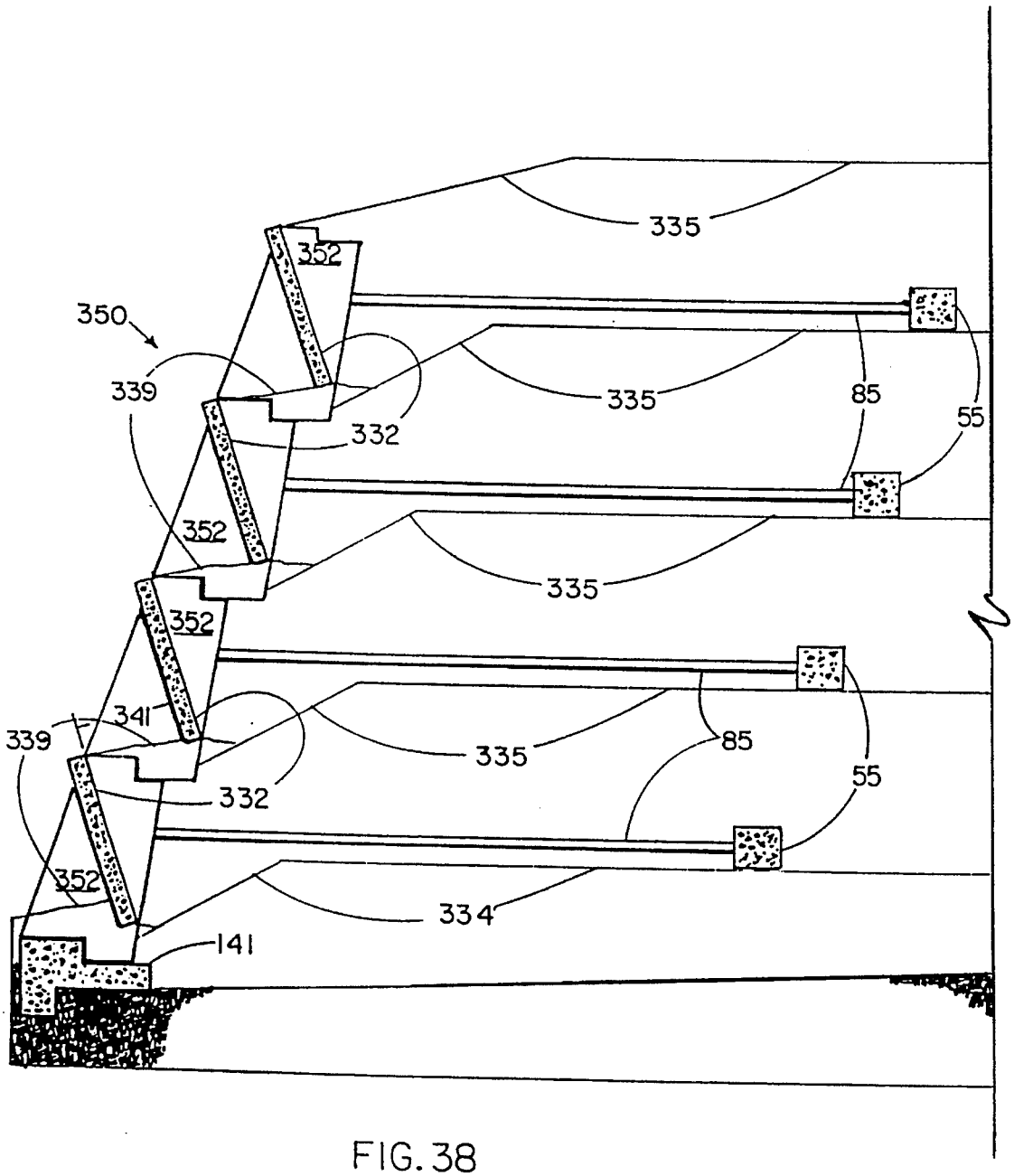
FIG. 38 is a cross-sectional view of an alternate embodiment horizontally setback tier wall.

Another embodiment wall assembly is shown in FIG. 38. FIG. 38 is a vertical cross section cut through an inclined face tee support panel wall assembly 350. The assembly 350 has a cast-in-place foundation beam 141 which has a different cross-section than the foundation beam 140 shown in FIG. 35 for the horizontal offset inclined panel assembly 328. The component placement is similar to that described for wall assembly 328 shown in FIG. 35. Inclined face tee support panels 352 are placed and secured to the foundation beam 141 as previously described for similar embodiments. Flat panels 332 as previously described are then set on inclined bearing flanges 353 (FIG. 40) on the tee stems 354 formed on the support panels 352. Following placement of the flat panels 332 backfill can proceed. The Phase I fill 334 is placed for assembly 350 substantially as previously shown in FIG. 33 prior to placing the subsequent upper tier panels.

Phase II backfill 335 is then placed to the profile shown. The planting space 341 between inclined flat panels can then be backfilled with soil 339 to the profile shown. The process of erecting the support panels 352 or flat panels 332 and anchor blocks 55 and tie rod assembly 85 is completed as previously described for similar embodiments. Wall backfill 335 and planting fill 339 are placed until the wall is completed. This wall is an architectural variation of wall configuration 328 shown in FIG. 35.

Figure 39:
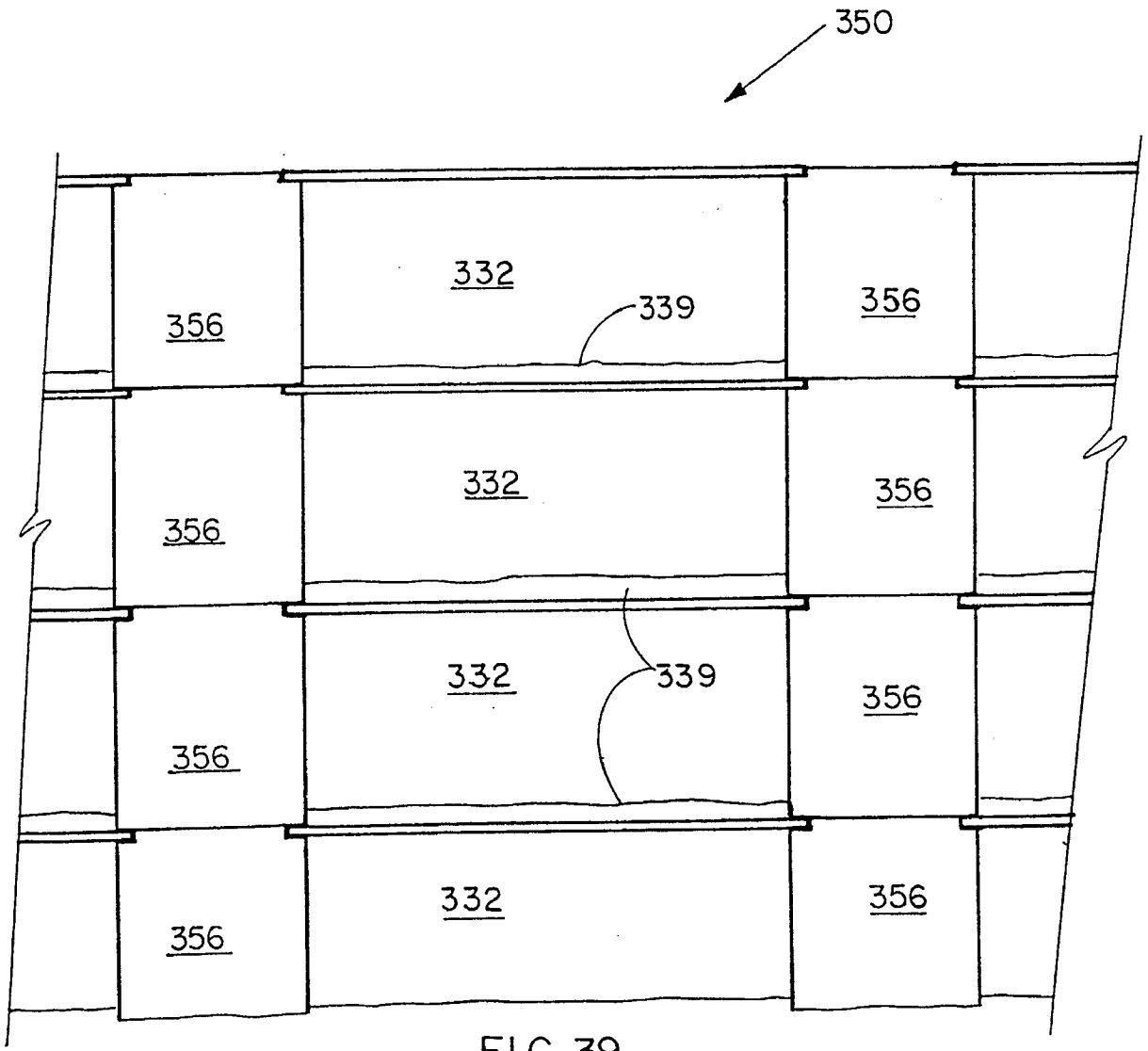
FIG. 39 is a front elevation view of the wall assembly shown in FIG. 38.

FIG. 39 is a partial front elevation view of wall assembly 350 shown in FIG. 38. Planting fill 339 is shown between the panels 332. The smooth inclined faces 356 of the support panels 352 are also shown on both sides of the flat panels 332.

Figure 40:
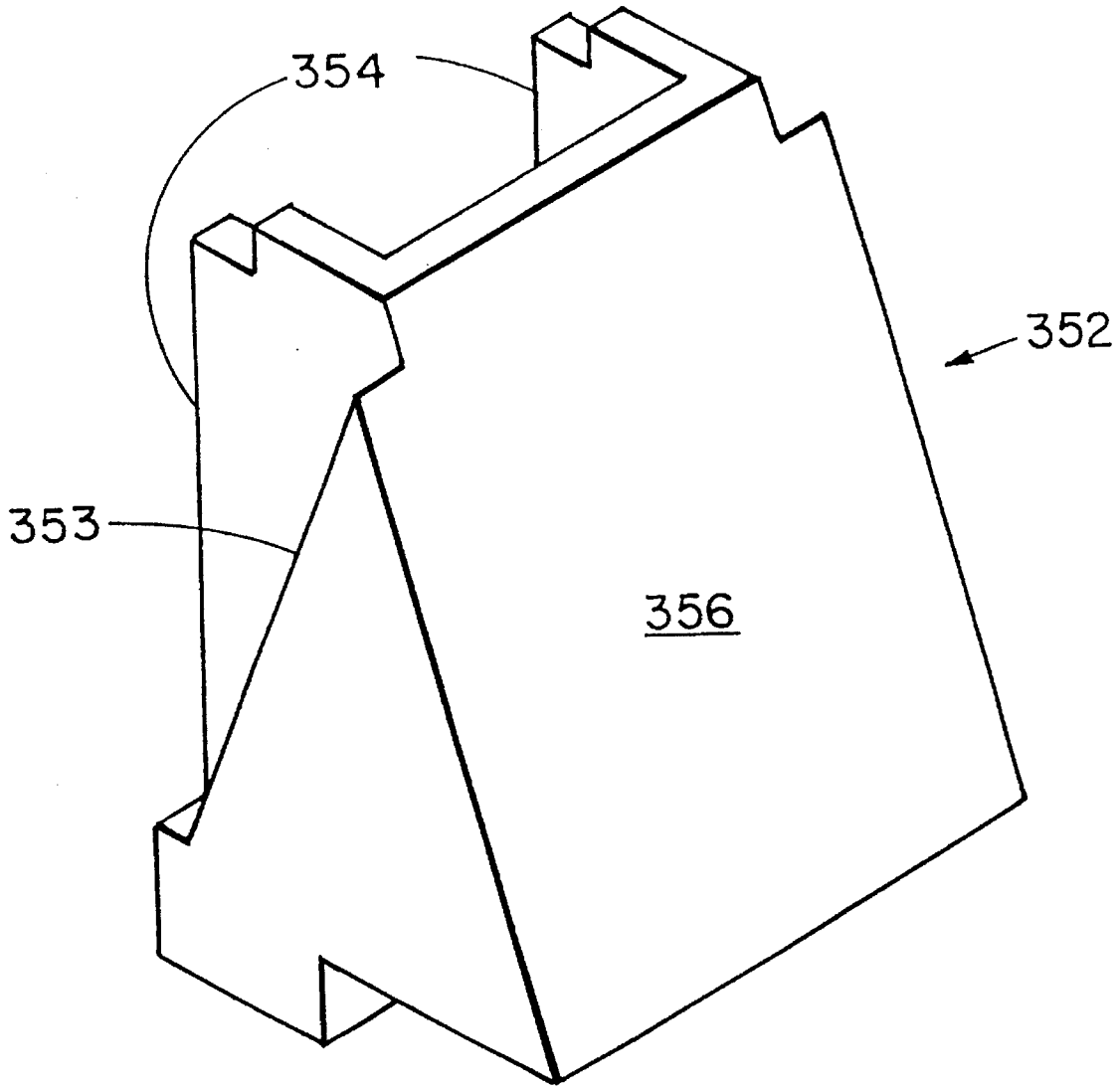
FIG. 40 is an isometric view of an inclined face wall support panel used in the assembly shown in FIG. 38.

FIG. 40 is an isometric view of an inclined tee support panel 352 used for assembling the wall assembly 350 shown in FIG. 38. The inclined face 356 corresponds to the overall batter angle of the wall. The inclined bearing flanges 353 for supporting the flat panels 332 are shown cast into the stem 354.

Figure 41:
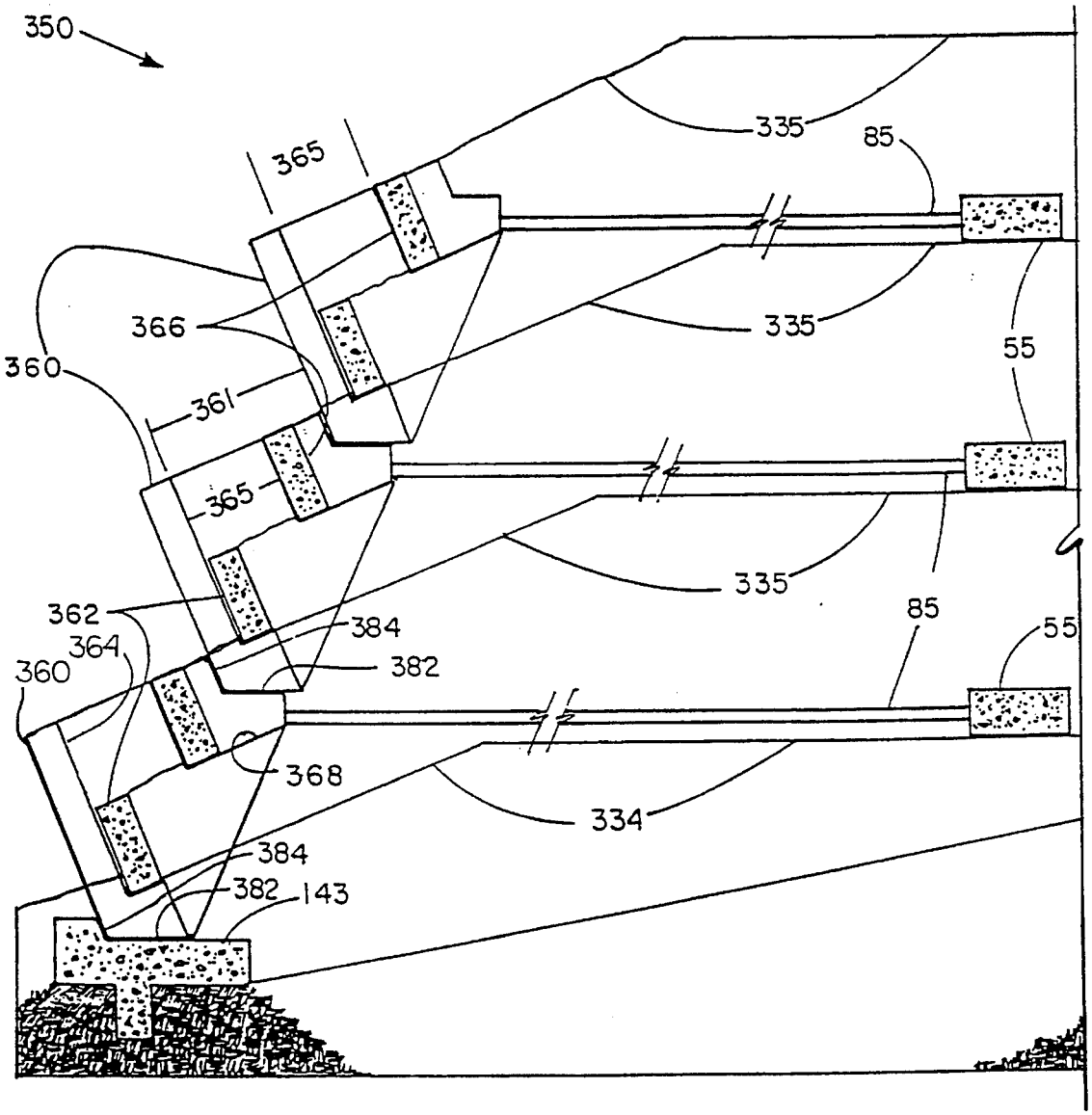
FIG. 41 is a cross-sectional view of an alternate embodiment inclined face horizontally set back wall assembly.

Another alternate embodiment is shown in FIG. 41. FIG. 41 is a vertical section cut through a multi-panel inclined face horizontal setback wall assembly 350' similar in construction to the wall assembly 350. The cast-in-place foundation beam 143 is shown with a multi-panel support tee panel 360 placed on the foundation beam 143. The method of connection, etc. of the support tee panels 360 to the beam 143 is similar to those described in the previous embodiments. Inclined flat wall panels 362 are shown placed on bearing flange 364 cast into the tee stem 370 of the support tee panels 360. Backfill 334 can then be placed to the profile shown so that the tie rod assembly 85 and anchor block 55 can be installed. Flat wall panel 366 is now installed on the bearing flanges 368 cast into the tee stem 370 of support tee panel 360. Backfill 335 can now be placed to the profile shown. The fill 335 is also placed in the horizontal offset space 361 within the tee stem 370 and face 372 confines of the support tee panels 360. Fill 335 is also placed in the planting spaces 365 between the flat panel 362 and flat panel 366. The subsequent tier tee support panels 360 can now be placed and secured in a similar fashion that has been previously described for other embodiments. Following the attachment of support tee panels 360 at the mating horizontal surfaces 382 and inclined surfaces 384, the bottom flat panel 362 can be installed. Fill 334 can be placed as shown and upper flat panel 366 placed. Fill 335 is now completed as previously described. Subsequent tiers are erected and backfilled as described until the structure is completed.

The advantage of the multipanel horizontal setback wall assembly 350 is that available planting space is roughly equivalent to the exposed concrete wall area.

Figure 42:
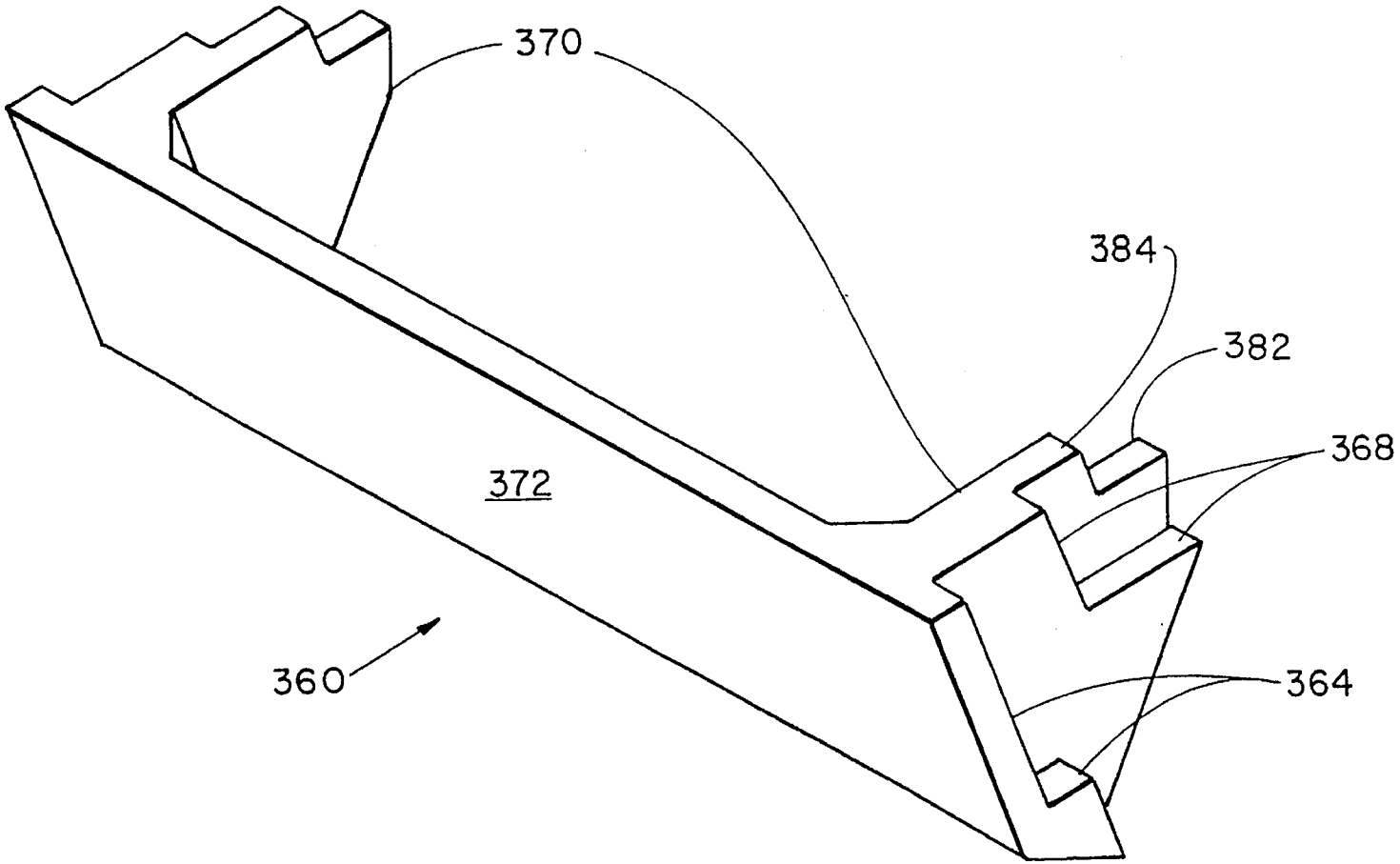
FIG. 42 is an isometric view of a multi-panel horizontal setback wall panel used in the wall assembly of FIG. 41.

FIG. 42 is an isometric view of typical tee stem support panel 360 required for the multi-panel horizontal setback wall assembly 350 shown in FIG. 41. The tee stems 370 of the support tee panels 360 are shown with the panel bearing flanges 364 and 368 cast into the stems. Insert tie rod couplers and erection hardware are not shown, but are similar to that shown on previous embodiments.

One unique feature of the tee support panels 360 is the configuration of the bearing flanges 364 and 368. This configuration allows for the option of either using two half width flat panels 362 and 366 as shown in FIG. 41 or using a full height flat panel 332 as shown in FIG. 35 or FIG. 38. If the full height flat panel 332 is used, it is placed on the front flange 364 cast into the face 372 and stem of panel 360. The ability to use different height panels is another unique feature of this embodiment.

Figure 43:
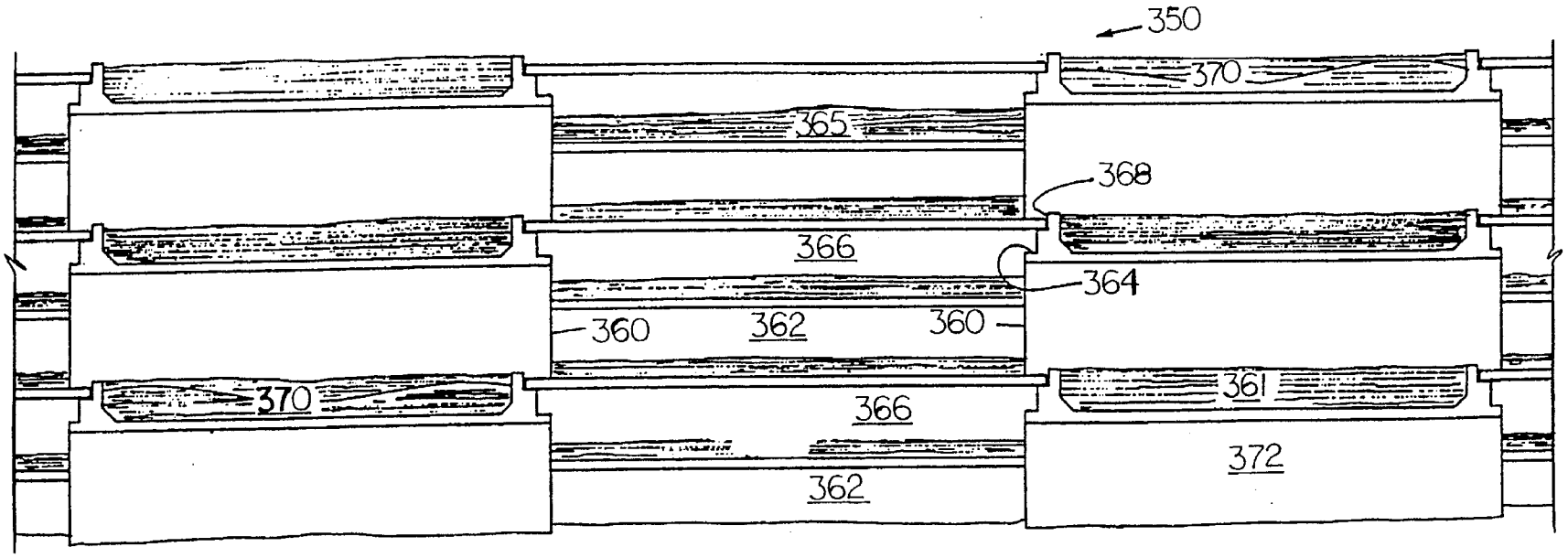
FIG. 43 is a front elevational view of the wall assembly of FIG. 41.
Figure 43A:
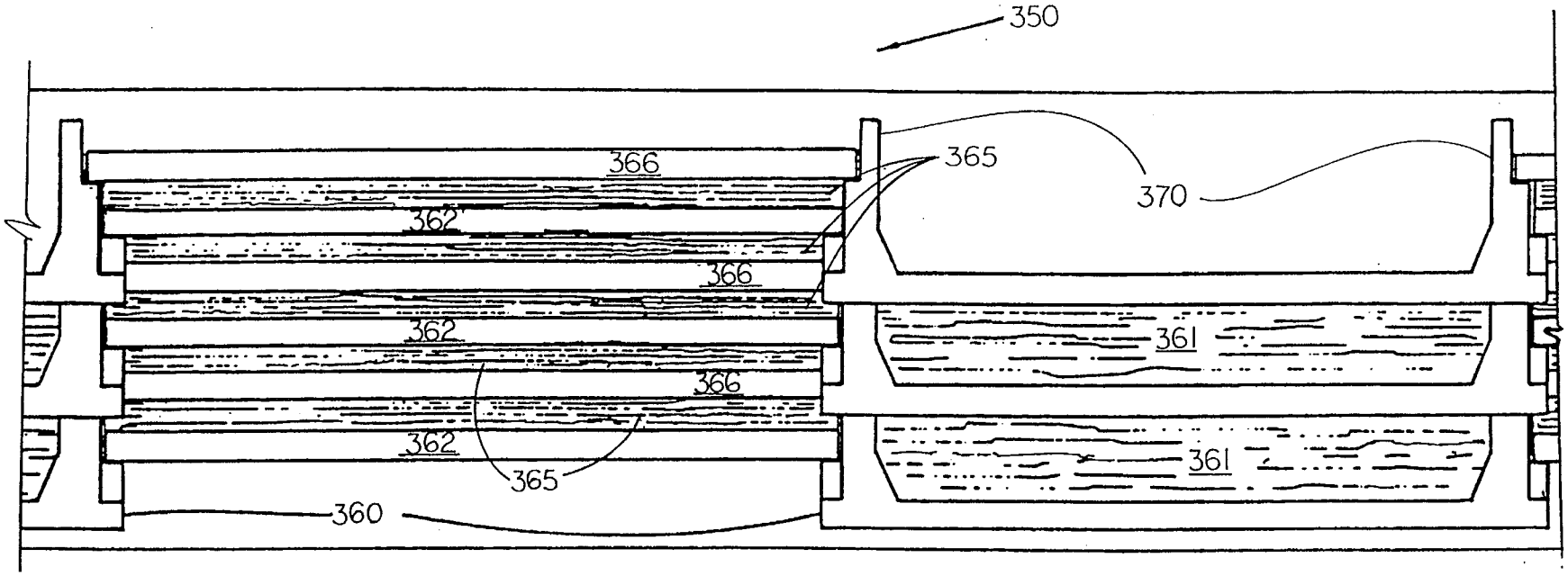
FIG. 43A is a top view of the wall assembly of FIG. 41.

FIG. 43 is a partial elevational view of the wall assembly 350 shown in FIG. 41 and FIG. 43A is a partial top view of the wall assembly 350 shown in FIG. 41. The flat panels 362, 366 are shown supported by the support panels 360 for the three tier assembly 350. The planting spaces 365 between panels 362 and 366 are approximately one half the size of the planting space 361 available in the confines of the support panel 360. This is a unique design feature of the multi-panel wall assembly 350: large planting areas allow for trees, etc. to be planted within the wall structure, while in the adjacent panel tiers formed by half high panels 362, 366, smaller bushes and vines can be grown.

Figure 44:
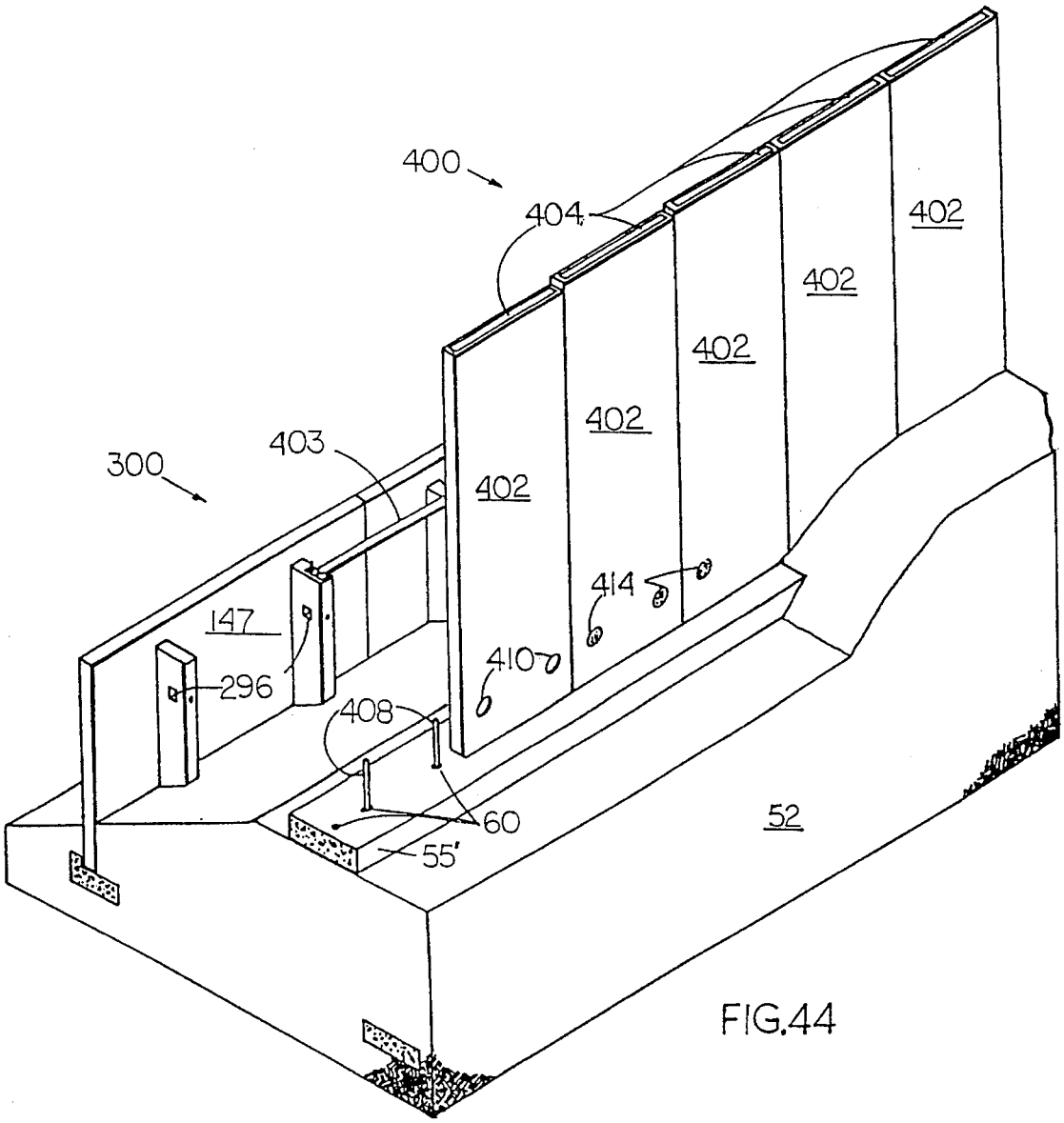
FIG. 44 is an isometric view of a horizontal setback wall assembly using hollow wall panels and a bracket assembly for securing the wall panels.
Figure 48:
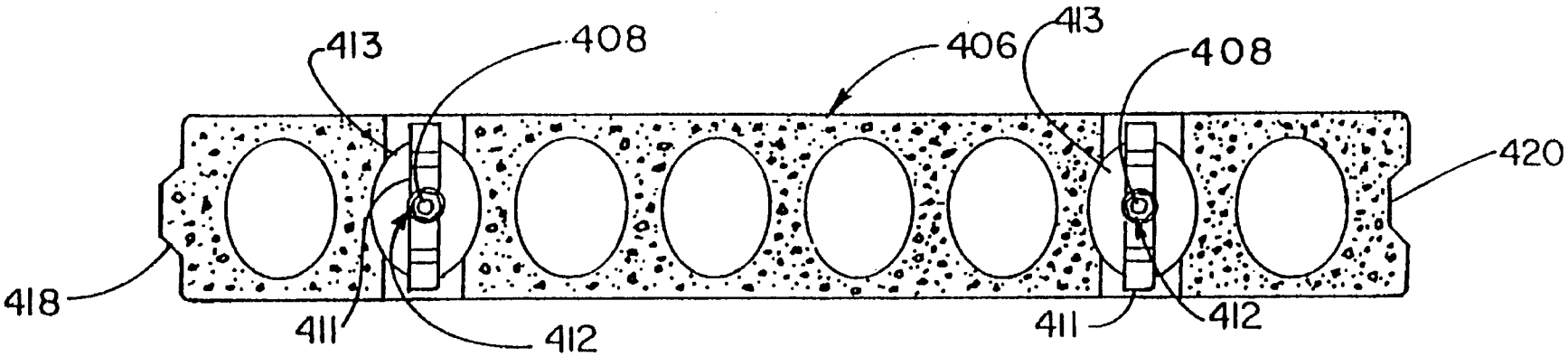
FIG. 48 is a cross section taken along section line 48—48 of FIG. 46.

Another alternate embodiment is shown in FIG. 44. FIG. 44 is a partial isometric view of a horizontal setback wall assembly 300 as shown in FIG. 30 showing a vertical barrier wall assembly 400 erected on the anchor block beam 55'. The top tier panels 147 of the wall assembly 300 are shown in front of the barrier wall 400 and a barrier panel 402 is shown held in place by an erection brace 403 that may be required to maintain stability of the barrier panel 402. A box void 404 is shown at the top of the barrier panels 402. Multi-void panels 406 may also be used which are shown in FIG. 48. The panels 402 are secured to the block beam 55' by the use of vertical tie rods 408 that are installed into the coupler 60 cast into the block 55'. The block 55' is the same as block 55 except that couplers 60 are cast into the block 55' to accept the vertical tie rods 408. Access to the vertical tie rod 408 is available through the void 410. A grouted joint 414 is completed before backfill 52 is placed. The Phase III backfill (not shown) is also placed behind panel 147 and in front of the barrier wall assembly 400 to complete the wall. If a barrier wall 400 is required for a project beyond the reach of the wall assembly 300, the barrier wall 400 is attached to a cast-in-place foundation.

Figure 45:
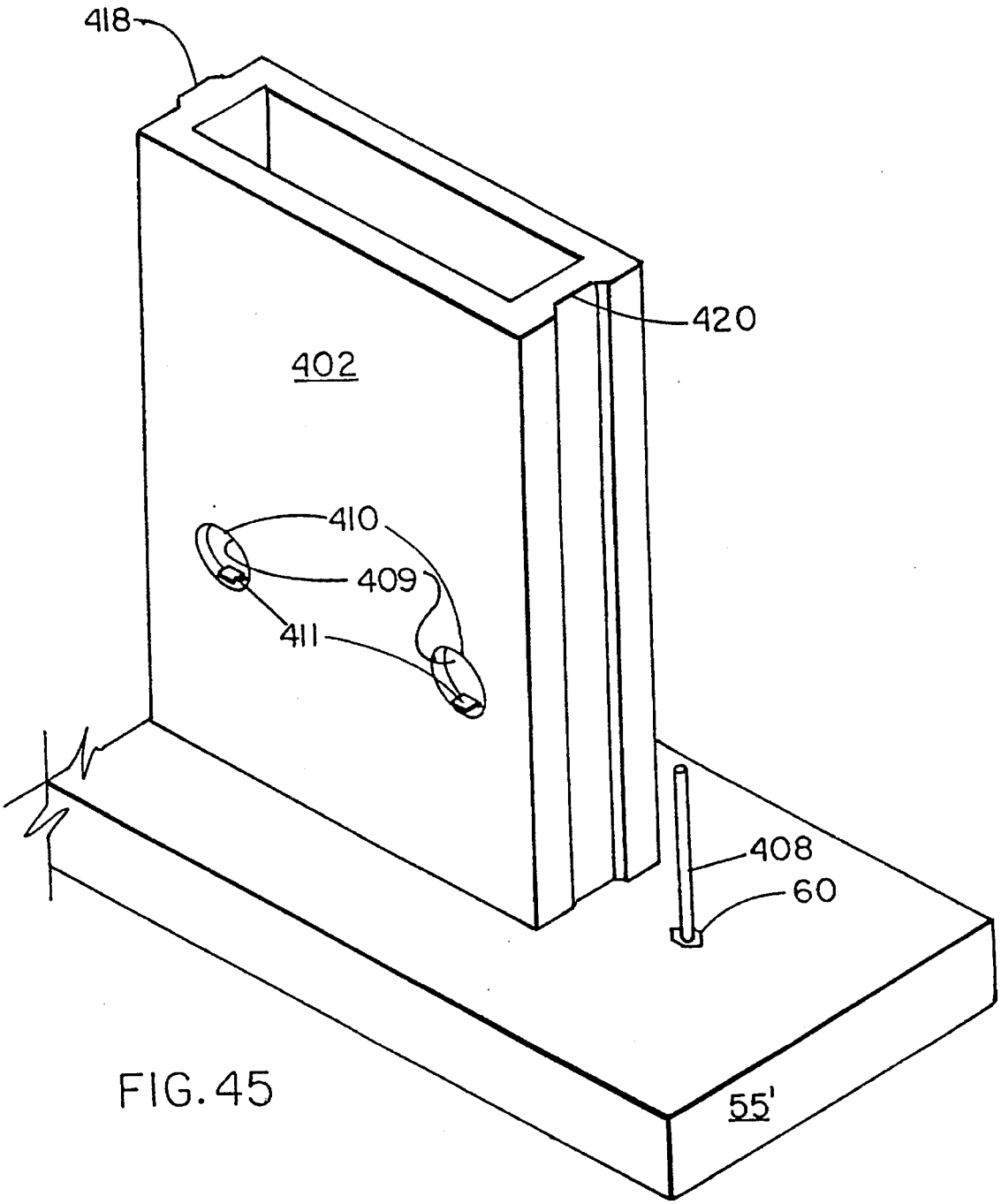
FIG. 45 is an isometric view of a wall panel for the wall assembly of FIG. 44.

FIG. 45 is a partial isometric view of a barrier panel 402 placed on anchor block 55'. The vertical tie rod 408 is shown installed in the cast-in-place coupler 60. A vertical groove joint 420 is shown in the fight edge of the panel 402 and a tongue joint 418 is formed on the left edge of panel 402.

Figure 46:
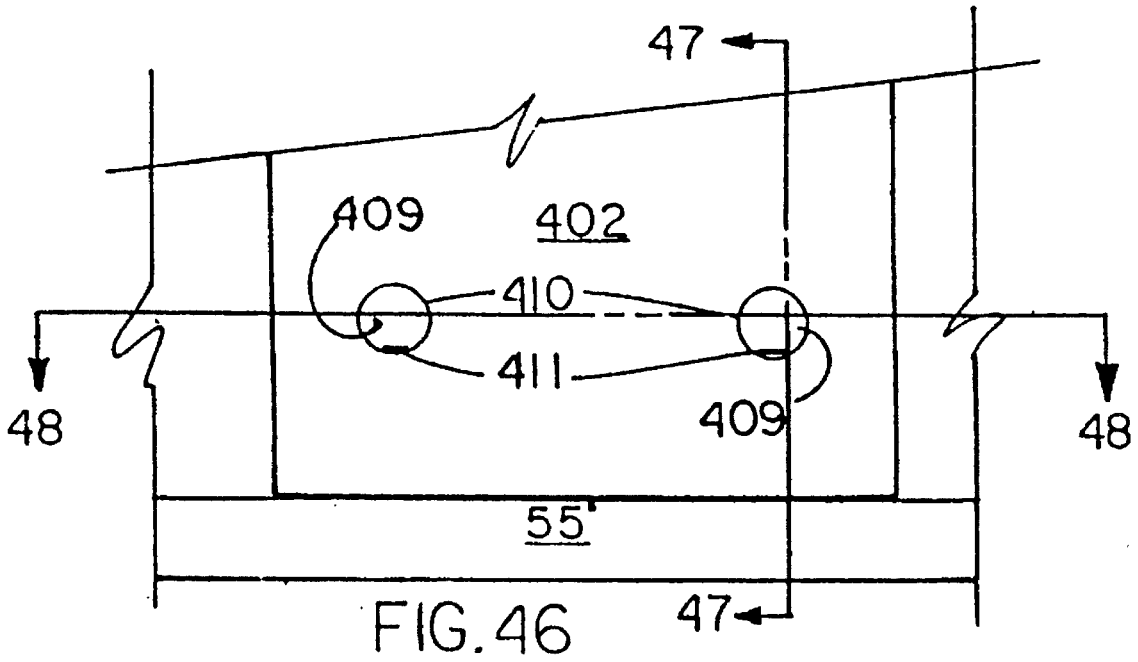
FIG. 46 is a partial front elevation view of the panel shown in FIG. 45.

FIG. 46 is a partial front elevation view of a panel 402 placed on anchor block 55'. The horizontal void 409 is shown with the horizontal void bracket 411 in place, see also FIGS. 47 and 48.

Figure 47:
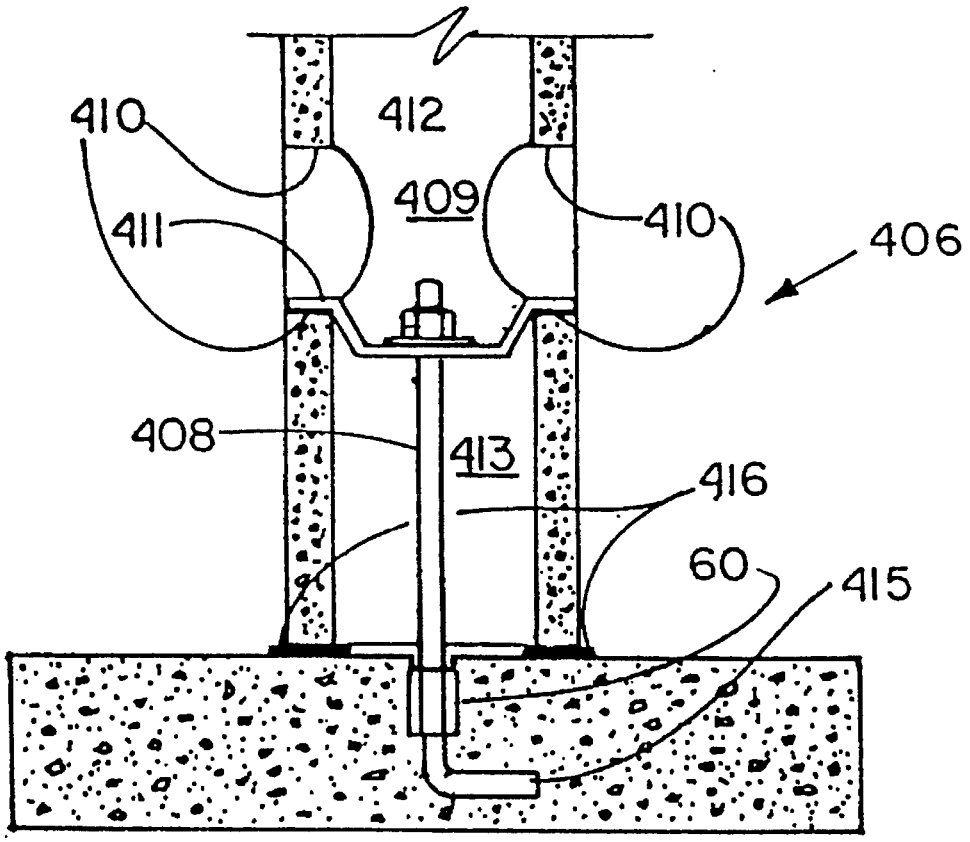
FIG. 47 is a cross-section taken along section line 47—47 of FIG. 46.

FIG. 47 is a vertical cross section cut through the center of a vertical tie rod 408 in multi-void panel 406 shown in FIG. 48. Tie rod 408 is shown installed in coupler 60 attached to cast in tie rod 415. The void outline 410 is shown with the horizontal void bracket 411 in place over the tie rod 408. The void 410 is sized so that adequate access is available to install and tighten the nut and washer assembly 412. Leveling shims 416 may be required under the panel 402. Grout 414 (see FIG. 44) is placed not only in the horizontal void 409, but also in the void space 413 around the tie rod 408. By filling the horizontal void space 409 and vertical void space 413, the panel 406 (or 404) acts as a form to hold the grout 414 (see FIG. 44) to transfer the structural strength of the panel 406 (or 404) to the tie rod 408. This is a unique advantage of the hollow panel with either one or more voids: the horizontal void spaces 409 and vertical void spaces 413 act as a form to transfer the tensile strength of the tie rod 408 to the panel 404.

FIG. 48 is a horizontal section cut through a multi-void panel 406. Either this type of panel 406 (or a single void or box panel 404) can be used in the barrier wall assembly 400. The horizontal void bracket 411 is shown in place over the tie rod 408 secured by the nut and washer assembly 412. The left vertical edge of the panel 406 shows a tongue joint 418. The mating groove joint 420 is shown on the fight side of the panel 406. Multi-void panels 406 are available commercially and may be used for a barrier wall instead of the single void box panel 402 for light load applications.

While this invention has been illustrated and described with reference to preferred embodiments, it is recognized that variations and changes may be made therein, without departing from the invention as set forth in the claims. It is intended therefore that the following claims include such alternate embodiments.

What is claimed:

1. A segmental, anchored, vertical precast retaining wall system, said retaining wall system comprising:

a foundation means for supporting the retaining wall system;

an assembly of base wall panels attached to the foundation means side by side to form a base tier with each base wall panel including a pair of generally T-shaped vertical tee stems formed with a horizontal and a vertical bearing surface; shaped vertical tee stems formed with a horizontal and a vertical bearing surface;

an assembly of upper tier wall panels stacked on the base tier wall panels, each upper tier wall panel including a pair of generally T-shaped vertical tee stems formed with a horizontal and a vertical bearing surface for contact with the horizontal and vertical bearing surfaces of the base wall panel tee stems;

tie rod means attached to the base wall panels and to the upper tier wall panels for securing the wall panels against earth loads;

means for sealing the tie rod means including a tie rod sleeve surrounding each tie rod means;

anchor mean embedded in backfill at different vertical levels and removably attached to the tie rod means; and means for displacing the means for sealing relative to the tie rod means upon settling of the backfill to prevent shear forces at points of attachment of the tie rod means.

2. The wall system as claimed in claim 1 and wherein the foundation means comprises a cast in place foundation beam.

3. The wall system as claimed in claim 2 and wherein anchor bolts are secured to the foundation beam for attaching the base wall panels to the foundation beam during assembly of the wall system.

4. The wall system as claimed in claim 1 and wherein the tie rod means include tie rods having a threaded end attached to threaded couplings precast in the tee stems for the wall panels.

5. The wall system as claimed in claim 4 and wherein the means for sealing comprises tie rod sleeves placed around the tie rods and sealed at either end.

6. The wall system as claimed in claim 5 and wherein the means for settling comprises slotted gaskets at either end of each tie rod sleeve for sealing between the tie rod sleeve and the wall panel and between the tie rod sleeve and the anchor means and with the tie rods located at a bottom of the tie rod sleeves during assembly to accommodate vertical movement of the tie rod sleeve relative to the tie rods without generating shear forces in the tie rods.

7. The wall system as claimed in claim 1 and wherein the anchor means comprises a plurality of elongated precast anchor blocks.

8. The wall system as claimed in claim 7 and wherein the precast anchor block on a vertical level can be interlocked with one another to form a unitary anchor structure.

9. The wall system as claimed in claim 1 and wherein the anchor means comprises an assembly of base wall panels attached to tie rod means to form two parallel spaced base tier walls.

10. The wall system as claimed in claim 1 and wherein the base wall panel tee stems extend past a bottom edge of the base wall panel and are embedded in concrete filled voids formed in the foundation means.

11. The wall system as claimed in claim 1 and wherein the upper tier wall panels extend past a backfill surface to provide a wall.

12. An improved retaining wall comprising:

a cast in place foundation beam;

an assembly of precast wall panels including base wall panels attached to the foundation beam, with each wall panel including a top edge, a bottom edge, a front side and a back side and each wall panel including a pair of generally vertical columns formed for mating contact with an adjacent wall panel on a different vertical level to form tiers for retaining backfill;

a plurality of tie rod assemblies embedded within the backfill and attached to the backside of the vertical columns with each tie rod assembly including a tie rod contained within a tie rod sleeve movable with respect to the tie rod during settlement of the backfill, to prevent stress at connection points, said tie rod Sleeve sealed at either end by a slotted gasket; and a plurality of elongated anchor blocks embedded within the backfill and attached to the tie rod assemblies at different vertical levels with anchor blocks on a vertical level interlocked to form a unitary structure for resisting earth loads.

13. The improved wall system as claimed in claim 12 and wherein the vertical columns have a generally T-shaped cross section to form a cantilevered horizontal bearing surface between wall panels and adjacent vertical tiers and said vertical columns include a cast-in-place threaded coupler for attaching a threaded end of a tie rod.

14. The improved wall system as claimed in claim 13 and wherein the vertical columns include a rectangular notch at the top and bottom to form a vertical bearing surface for interlocking adjacent panels on different vertical levels.

15. The improved wall system as claimed in claim 12 and wherein the anchor block are formed with shiplap joints for interlocking adjacent anchor blocks on a vertical level.

16. The improved wall system as claimed in claim 12 and wherein the foundation beam includes anchor bolts or weld plates for attaching the base wall panels.

17. The improved wall system as claimed in claim 12 and wherein each base wall panel has a front side area of about 80 $ft^2$ to 120 $ft^2$.

18. The improved wall system as claimed in claim 12 and wherein the tie rods are pretensioned during assembly.

19. The improved retaining wall system as claimed in claim 1 and wherein the tie rods are formed of a glassfibre material having formed threads.

20. The improved retaining wall system as claimed in claim 12 and wherein the tie rod sleeves are attached to a flexible connector attached to the vertical columns.

21. An improved retaining wall system for retaining soil, said retaining wall system comprising:

a cast in place foundation beam;

an assembly of precast base panels attached to the foundation beam to form a base tier with each base panel including a pair of vertical tee stems formed with a horizontal and a vertical bearing surface at an upper end and formed with a threaded precast in place coupling on an inside surface;

an assembly of upper tier panels for stacking on the base panels to form an upper tier with each upper tier panel including a pair of vertical tee stems formed with a mating horizontal and a mating vertical bearing surface at a lower end for interlocking with the horizontal and vertical bearing surfaces of the base panel tee stems and formed with a threaded precast in place coupling on an inside surface;

a plurality of tie rods embedded in the backfill and attached to the tee stems of the base panels and the upper tier panels with each tie rod including a threaded end for connection to the threaded couplers;

means for sealing the tie rods including a sealed tie rod sleeve and a slidable sleeve placed around the tie rod sleeve; and a plurality of anchor blocks embedded in the backfill and attached to the tie rods with adjacent anchor blocks on a vertical interlocked to form a unitary anchor structure.

22. The wall system as claimed in claim 21 and wherein the means for sealing the tie rods further comprises a tie rod sleeve, a slotted gasket placed between the tie rod sleeve and a wall panel, and a slotted gasket placed between the tie rod sleeve and an anchor block.

23. The wall system as claimed in claim 21 and wherein the tie rods are formed of rebar having threaded ends.

24. The wall system as claimed in claim 21 and wherein at least one tie rod is formed by separate lengths of rebar connected with a rebar coupler.

25. The wall system as claimed in claim 21 and wherein the tie rods are formed of glassfibre rods having formed threads.

26. The wall system as claimed in claim 21 and wherein the means for sealing the tie rods includes a tie rod sleeve connected to a flexible connector mounted in a void in the tee stem.

27. The wall system as claimed in claim 21 and wherein the foundation beam includes cast-in-place anchor bolts and the base wall panels are attached to the foundation beam and leveled during assembly using base plates attached to the anchor bolts with mounting nuts.

28. The wall system as claimed in claim 21 and wherein adjacent base panels are connected to one another during assembly using metal straps secured with mounting bolts.

29. The wall system as claimed in claim 21 and wherein the tie rods are placed through a void in the anchor blocks and tensioned with a nut attached to a threaded end of the tie rod.

30. The wall system as claimed in claim 29 and wherein the void is counterbored and the counterbore is filled with grout after the tie rod is tensioned.

31. The wall system as claimed in claim 21 and wherein the foundation beam is formed with an L-shaped surface to provide a bearing surface to resist horizontal movement of the base panels.

32. The wall system as claimed in claim 21 and wherein the upper tier panels extend past a surface of the backfill to provide a wall.

33. The wall system as claimed in claim 21 and wherein the wall system is assembled over insitu soil having a cut slope.

34. The wall system as claimed in claim 21 and wherein the foundation beam includes a section formed with a shear key to prevent horizontal movement of the foundation beam.

* * * * *